US007539612B2

(12) United States Patent
Thumpudi et al.

(10) Patent No.: US 7,539,612 B2
(45) Date of Patent: May 26, 2009

(54) CODING AND DECODING SCALE FACTOR INFORMATION

(75) Inventors: Naveen Thumpudi, Sammamish, WA (US); Wei-Ge Chen, Sammamish, WA (US); Chao He, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 642 days.

(21) Appl. No.: 11/183,291

(22) Filed: Jul. 15, 2005

(65) Prior Publication Data

US 2007/0016427 A1 Jan. 18, 2007

(51) Int. Cl.
*G10L 19/00* (2006.01)
*G10L 19/14* (2006.01)

(52) U.S. Cl. ..... 704/200.1; 704/225; 704/230; 704/501

(58) Field of Classification Search ..... 704/216, 704/262, E19.014, E19.023, E19.024, E19.026, 704/E19.029, E19.035, E19.037, E19.038; 375/E7.147, E7.149, E7.255, E7.257, E7.262, 375/E7.265, E7.03, E7.037
See application file for complete search history.

(56) References Cited

U.S. PATENT DOCUMENTS 5,079,547 A 1/1992 Fuchigama et al.
5,260,980 A 11/1993 Akagiri et al.
5,388,181 A 2/1995 Anderson et al.
5,524,054 A 6/1996 Spille
5,627,938 A 5/1997 Johnston
5,629,780 A 5/1997 Watson
5,632,003 A 5/1997 Davidson et al.
5,661,755 A 8/1997 Van De Kerkhof et al.
5,661,823 A 8/1997 Yamauchi et al.
5,682,152 A 10/1997 Wang et al.
5,684,920 A 11/1997 Iwakami et al.
5,686,964 A 11/1997 Tabatabai et al.
5,701,346 A 12/1997 Herre et al.
5,787,390 A * 7/1998 Quinquis et al. ..... 704/219
5,812,971 A 9/1998 Herre
5,822,370 A 10/1998 Graupe
5,826,221 A * 10/1998 Aoyagi ..... 704/200

(Continued)

FOREIGN PATENT DOCUMENTS

EP 0597649 5/1994

(Continued)

OTHER PUBLICATIONS

"ATSC Standard: Digital Audio Compression (AC-3), Revision A," 140 pp. (Aug. 2001).

(Continued)

*Primary Examiner*—David R Hudspeth
*Assistant Examiner*—Brian L Albertalli
(74) *Attorney, Agent, or Firm*—Klarquist Sparkman, LLP

(57) ABSTRACT

Techniques and tools for representing, coding, and decoding scale factor information are described herein. For example, during encoding of scale factors, an encoder uses one or more of flexible scale factor resolution selection, spatial prediction of scale factors, flexible prediction of scale factors, smoothing of noisy scale factor amplitudes, reordering of scale factor prediction residuals, and prediction of scale factor prediction residuals. Or, during decoding, a decoder uses one or more of flexible scale factor resolution selection, spatial prediction of scale factors, flexible prediction of scale factors, reordering of scale factor prediction residuals, and prediction of scale factor prediction residuals.

26 Claims, 27 Drawing Sheets

U.S. PATENT DOCUMENTS

| | | | | |
|---|---|---|---|---|
| 5,835,030 | A | 11/1998 | Tsutsui et al. | |
| 5,845,243 | A | 12/1998 | Smart et al. | |
| 5,890,108 | A * | 3/1999 | Yeldener | 704/208 |
| 5,956,674 | A | 9/1999 | Smyth et al. | |
| 5,960,390 | A | 9/1999 | Ueno et al. | |
| 5,974,380 | A | 10/1999 | Smyth et al. | |
| 5,995,151 | A | 11/1999 | Naveen et al. | |
| 6,029,126 | A | 2/2000 | Malvar | |
| 6,041,295 | A | 3/2000 | Hinderks | |
| RE36,721 | E * | 5/2000 | Akamine et al. | 704/220 |
| 6,058,362 | A | 5/2000 | Malvar | |
| 6,064,954 | A | 5/2000 | Cohen et al. | |
| 6,104,996 | A * | 8/2000 | Yin | 704/500 |
| 6,115,688 | A | 9/2000 | Brandenburg et al. | |
| 6,115,689 | A | 9/2000 | Malvar | |
| 6,167,373 | A * | 12/2000 | Morii | 704/219 |
| 6,182,034 | B1 | 1/2001 | Malvar | |
| 6,240,380 | B1 | 5/2001 | Malvar | |
| 6,249,614 | B1 | 6/2001 | Kolesnik et al. | |
| 6,353,807 | B1 | 3/2002 | Tsutsui et al. | |
| 6,370,128 | B1 | 4/2002 | Raitola | |
| 6,370,502 | B1 | 4/2002 | Wu et al. | |
| 6,404,827 | B1 * | 6/2002 | Uesugi | 375/340 |
| 6,418,405 | B1 | 7/2002 | Satyamurti et al. | |
| 6,424,939 | B1 * | 7/2002 | Herre et al. | 704/219 |
| 6,445,739 | B1 | 9/2002 | Shen et al. | |
| 6,473,561 | B1 | 10/2002 | Heo | |
| 6,594,626 | B2 * | 7/2003 | Suzuki et al. | 704/220 |
| 6,658,162 | B1 | 12/2003 | Zeng et al. | |
| 6,738,074 | B2 | 5/2004 | Rao et al. | |
| 6,757,654 | B1 * | 6/2004 | Westerlund et al. | 704/262 |
| 6,766,293 | B1 | 7/2004 | Herre et al. | |
| 6,771,777 | B1 | 8/2004 | Gbur et al. | |
| 6,807,524 | B1 * | 10/2004 | Bessette et al. | 704/200.1 |
| 6,865,534 | B1 * | 3/2005 | Murashima et al. | 704/262 |
| 6,934,677 | B2 | 8/2005 | Chen et al. | |
| 7,062,445 | B2 | 6/2006 | Kadatch | |
| 7,096,240 | B1 | 8/2006 | Absar et al. | |
| 7,269,559 | B2 * | 9/2007 | Kondo et al. | 704/262 |
| 2002/0143556 | A1 | 10/2002 | Kadatch | |
| 2003/0115041 | A1 | 6/2003 | Chen et al. | |
| 2003/0115042 | A1 | 6/2003 | Chen et al. | |
| 2003/0115050 | A1 | 6/2003 | Chen et al. | |
| 2003/0115051 | A1 | 6/2003 | Chen et al. | |
| 2003/0115052 | A1 | 6/2003 | Chen et al. | |
| 2004/0001608 | A1 * | 1/2004 | Rhoads | 382/100 |
| 2004/0044527 | A1 | 3/2004 | Thumpudi et al. | |
| 2004/0093208 | A1 * | 5/2004 | Yin | 704/230 |

FOREIGN PATENT DOCUMENTS

| | | |
|---|---|---|
| EP | 0669724 | 8/1995 |
| EP | 0910927 | 4/1999 |
| EP | 0924962 | 6/1999 |
| EP | 0931386 | 7/1999 |
| WO | WO 99/43110 | 8/1999 |

OTHER PUBLICATIONS

Beerends, "Audio Quality Determination Based on Perceptual Measurement Techniques," *Applications of Digital Signal Processing to Audio and Acoustics*, Chapter 1, Ed. Mark Kahrs, Karlheinz Brandenburg, Kluwer Acad. Publ., pp. 1-38 (1998).

Caetano et al., "Rate Control Strategy for Embedded Wavelet Video Coders," *Electronics Letters*, pp. 1815-1817 (Oct. 14, 1999).

De Luca, "AN1090 Application Note: STA013 MPEG 2.5 Layer III Source Decoder," STMicroelectronics, 17 pp. (1999).

de Queiroz et al., "Time-Varying Lapped Transforms and Wavelet Packets," *IEEE Transactions on Signal Processing*, vol. 41, pp. 3293-3305 (1993).

Dolby Laboratories, "AAC Technology," 4 pp. [Downloaded from the web site aac-audio.com on World Wide Web on Nov. 21, 2001.].

Fraunhofer-Gesellschaft, "MPEG Audio Layer-3," 4 pp. [Downloaded from the World Wide Web on Oct. 24, 2001.].

Fraunhofer-Gesellscahft, "MPEG-2 AAC," 3 pp. [Downloaded from the World Wide Web on Oct. 24, 2001.].

Gibson et al., *Digital Compression for Multimedia*, Title Page, Contents, "Chapter 7: Frequency Domain Coding," Morgan Kaufman Publishers, Inc., pp. iii, v-xi, and 227-262 (1998).

"ISO/IEC 11172-3, Information Technology—Coding of Moving Pictures and Associated Audio for Digital Storage Media at Up to About 1.5 Mbit/s—Part 3: Audio," 154 pp. (1993).

"ISO/IEC 13818-7, Information Technology—Generic Coding of Moving Pictures and Associated Audio Information—Part 7: Advanced Audio Coding (AAC)," 174 pp. (1997).

ITU, Recommendation ITU-R BS 1115, Low Bit-Rate Audio Coding, 9 pp. (1994).

ITU, Recommendation ITU-R BS 1387, Method for Objective Measurements of Perceived Audio Quality, 89 pp. (1998).

Jesteadt et al., "Forward Masking as a Function of Frequency, Masker Level, and Signal Delay," *Journal of Acoustical Society of America*, vol. 71, pp. 950-962 (1982).

Kondoz, *Digital Speech: Coding for Low Bit Rate Communications Systems*, "Chapter 3.3: Linear Predictive Modeling of Speech Signals" and "Chapter 4: LPC Parameter Quantisation Using LSFs," John Wiley & Sons, pp. 42-53 and 79-97 (1994).

Lutfi, "Additivity of Simultaneous Masking," *Journal of Acoustic Society of America*, vol. 73, pp. 262-267 (1983).

Malvar, "Biorthogonal and Nonuniform Lapped Transforms for Transform Coding with Reduced Blocking and Ringing Artifacts," appeared in *IEEE Transactions on Signal Processing, Special Issue on Multirate Systems, Filter Banks, Wavelets, and Applications*, vol. 46, 29 pp. (1998).

Malvar, *Signal Processing with Lapped Transforms*, Artech House, Norwood, MA, pp. iv, vii-xi, 175-218, and 353-357 (1992).

Malvar, "Lapped Transforms for Efficient Transform/Subband Coding," *IEEE Transactions on Acoustics, Speech and Signal Processing*, vol. 38, No. 6, pp. 969-978 (1990).

OPTICOM GmbH, "Objective Perceptual Measurement," 14 pp. [Downloaded from the World Wide Web on Oct. 24, 2001.].

Phamdo, "Speech Compression," 13 pp. [Downloaded from the World Wide Web on Nov. 25, 2001.].

Ribas Corbera et al., "Rate Control in DCT Video Coding for Low-Delay Communications," *IEEE Transactions on Circuits and Systems for Video Technology*, vol. 9, No. 1, pp. 172-185 (Feb. 1999).

Shlien, "The Modulated Lapped Transform, Its Time-Varying Forms, and Its Applications to Audio Coding Standards," *IEEE Transactions on Speech and Audio Processing*, vol. 5, No. 4, pp. 359-366 (Jul. 1997).

Solari, *Digital Video and Audio Compression*, Title Page, Contents, "Chapter 8: Sound and Audio," McGraw-Hill, Inc., pp. iii, v-vi, and 187-211 (1997).

Srinivasan et al., "High-Quality Audio Compression Using an Adaptive Wavelet Packet Decomposition and Psychoacoustic Modeling," *IEEE Transactions on Signal Processing*, vol. 46, No. 4, pp. 1085-1093 (Apr. 1998).

Terhardt, "Calculating Virtual Pitch," *Hearing Research*, vol. 1, pp. 155-182 (1979).

Wragg et al., "An Optimised Software Solution for an ARM Powered™ MP3 Decoder," 9 pp. [Downloaded from the World Wide Web on Oct. 27, 2001.].

Zwicker et al., *Das Ohr als Nachrichtenempfänger*, Title Page, Table of Contents, "I:Schallschwingungen," Index, Hirzel-Verlag, Stuttgart, pp. III, IX-XI, 1-26, and 231-232 (1967).

Zwicker, *Psychoakustik*Title Page, Table of Contents, "Teil I: Einfuhrung," Index, Springer-Verlag, Berlin Heidelberg, New York, pp. II, IX-XI, 1-30, and 157-162 (1982).

Advanced Television Systems Committee, ATSC Standard: Digital Audio Compression (AC-3), Revision A, 140 pp. (1995).

Bosi et al., "ISO/IEC MPEG-2 Advanced Audio Coding," Journal of the Audio Engineering Society, Audio Engineering Society, vol. 45, No. 10, pp. 789-812 (1997).

Davis, "The AC-3 Multichannel Coder," Dolby Laboratories, 9 pp. (Downloaded from the World Wide Web on Aug. 15, 2002).

Edler et al., "Perceptual Audio Coding Using a Time-Varying Linear Pre- and Post-Filter," in AES 109th Convention, Los Angeles, California, 12 pp. (Sep. 2000).
Herley et al., "Tilings of the Time-Frequency Plane: Construction of Arbitrary Orthogonal Bases and Fast Tiling Algorithms," IEEE Transactions on Signal Processing, vol. 41, No. 12, pp. 3341-3359 (1993).
ISO/IEC 13818-7, Information technology—Generic coding of moving pictures and associated audio information—Part 7: Advanced Audio Coding (AAC), 150 pp. (1997).
Kuo et al., "A Study of Why Cross Channel Prediction is Not Applicable to Perceptual Audio Coding," IEEE Signal Processing Letters, vol. 8, No. 9, 3 pp. (Sep. 2001).
Meares, D.J., "Matrixed Surround Sound in an MPEG Digital World," Journal of the Audio Engineering Society, vol. 46, No. 4, 13 pp. (Apr. 1998).
"MPEG2 Audio for DVD: the Compromise Choice," 5 pp. (Oct. 1996).
Search Report for European Patent Application No. 03 020 110.7.
Search Report for European Patent Application No. 03 020 111.5.
Stuart et al., "Lossless Compression for DVD-Audio," in AES 9th Regional Convention Tokyo, 4 pp. (1999).
Vaidyanathan, Multirate Systems and Filter Banks, Prentice Hall Signal Processing Series, Cover page, pp. 745-751 (1992).
Van Assche et al., "Lossless Compression of Pre-Press Image Using a Novel Color Decorrelation Technique," Proc. SPIE, Very High Resolution and Quality III. vol. 3308, 8 pp. (1998).
Wang et al., "A Multichannel Audio Coding Algorithm for Inter-Channel Redundancy Removal," in AES 110th Convention, Amsterdam, the Netherlands, 6pp. (May 2001).
Wang et al., "EE225a Lecture 13: Karhunen Loéve Transform and Discrete Cosine Transform," Department of EECS, University of California at Berkeley, 10 pp. (Mar. 2002).
Yang et al., "Adaptive Karhunen-Loeve Transform for Enhanced Multichannel Audio Coding," Proc. SPIE vol. 4475, 13 pp., Mathematics of Data/Image Coding, Compression, and Encryption IV San Diego, CA. (Jul. 29-Aug. 3, 2001).
Yang et al., "An Inter-Channel Redundancy Removal Approach for High-Quality Multichannel Audio Compression," in AES 109th Convention, Los Angeles, California, 8 pp. (Sep. 2000).
Geiger et al., "Audio Coding Based on Integer Transforms," AES Convention Paper 5471, 111th AES Covention, New York, NY, Sep. 21-24, 2001.
Lopez et al., "Software Toolbox for Multichannel Sound Reproduction," Proceedings of Digital Audio Effects Conference (DAFX), Barcelona, Spain, Dec. 1998.
Brandenburg, "Aspec Coding", *AES 10th International Conference*, pp. 81-90 (1991).
"ISO/IEC 13818-7, Information Technology—Generic Coding of Moving Pictures and Associated Audio Information—Part 7: Advanced Audio Coding (AAC), Technical Corrigendum 1" 22 pp. (1998).

* cited by examiner

Software 180 implementing audio encoder and/or decoder technologies, including selecting a scale factor prediction mode from plural scale factor prediction modes and/or selecting a a scale factor spectral resolution from six pre-defined resolutions.

CODING AND DECODING SCALE FACTOR INFORMATION

BACKGROUND

Engineers use a variety of techniques to process digital audio efficiently while still maintaining the quality of the digital audio. To understand these techniques, it helps to understand how audio information is represented and processed in a computer.

I. Representing Audio Information in a Computer.

A computer processes audio information as a series of numbers representing the audio information. For example, a single number can represent an audio sample, which is an amplitude value at a particular time. Several factors affect the quality of the audio information, including sample depth, sampling rate, and channel mode.

Sample depth (or precision) indicates the range of numbers used to represent a sample. The more values possible for the sample, the higher the quality because the number can capture more subtle variations in amplitude. For example, an 8-bit sample has 256 possible values, while a 16-bit sample has 65,536 possible values.

The sampling rate (usually measured as the number of samples per second) also affects quality. The higher the sampling rate, the higher the quality because more frequencies of sound can be represented. Some common sampling rates are 8,000, 11,025, 22,050, 32,000, 44,100, 48,000, and 96,000 samples/second.

Mono and stereo are two common channel modes for audio. In mono mode, audio information is present in one channel. In stereo mode, audio information is present in two channels usually labeled the left and right channels. Other modes with more channels such as 5.1 channel, 7.1 channel, or 9.1 channel surround sound (the "1" indicates a sub-woofer or low-frequency effects channel) are also possible. Table 1 shows several formats of audio with different quality levels, along with corresponding raw bit rate costs.

TABLE 1

Bit rates for different quality audio information.

| | Sample Depth (bits/sample) | Sampling Rate (samples/second) | Channel Mode | Raw Bit Rate (bits/second) |
|---|---|---|---|---|
| Internet telephony | 8 | 8,000 | mono | 64,000 |
| Telephone | 8 | 11,025 | mono | 88,200 |
| CD audio | 16 | 44,100 | stereo | 1,411,200 |

Surround sound audio typically has even higher raw bit rate. As Table 1 shows, a cost of high quality audio information is high bit rate. High quality audio information consumes large amounts of computer storage and transmission capacity. Companies and consumers increasingly depend on computers, however, to create, distribute, and play back high quality audio content.

II. Processing Audio Information in a Computer.

Many computers and computer networks lack the resources to process raw digital audio. Compression (also called encoding or coding) decreases the cost of storing and transmitting audio information by converting the information into a lower bit rate form. Compression can be lossless (in which quality does not suffer) or lossy (in which quality suffers but bit rate reduction from subsequent lossless compression is more dramatic). For example, lossy compression is used to approximate original audio information, and the approximation is then losslessly compressed. Decompression (also called decoding) extracts a reconstructed version of the original information from the compressed form.

One goal of audio compression is to digitally represent audio signals to provide maximum perceived signal quality with the least possible amounts of bits. With this goal as a target, various contemporary audio encoding systems make use of human perceptual models. Encoder and decoder systems include certain versions of Microsoft Corporation's Windows Media Audio ("WMA") encoder and decoder and WMA Pro encoder and decoder. Other systems are specified by certain versions of the Motion Picture Experts Group, Audio Layer 3 ("MP3") standard, the Motion Picture Experts Group 2, Advanced Audio Coding ("AAC") standard, and Dolby AC3.

Conventionally, an audio encoder uses a variety of different lossy compression techniques. These lossy compression techniques typically involve perceptual modeling/weighting and quantization after a frequency transform. The corresponding decompression involves inverse quantization, inverse weighting, and inverse frequency transforms.

Frequency transform techniques convert data into a form that makes it easier to separate perceptually important information from perceptually unimportant information. The less important information can then be subjected to more lossy compression, while the more important information is preserved, so as to provide the best perceived quality for a given bit rate. A frequency transform typically receives audio samples and converts them into data in the frequency domain, sometimes called frequency coefficients or spectral coefficients.

Perceptual modeling involves processing audio data according to a model of the human auditory system to improve the perceived quality of the reconstructed audio signal for a given bit rate. For example, an auditory model typically considers the range of human hearing and critical bands. Using the results of the perceptual modeling, an encoder shapes distortion (e.g., quantization noise) in the audio data with the goal of minimizing the audibility of the distortion for a given bit rate. While the encoder must at times introduce distortion to reduce bit rate, the weighting allows the encoder to put more distortion in bands where it is less audible, and vice versa.

Typically, the perceptual model is used to derive scale factors (also called weighting factors or mask values) for masks (also called quantization matrices). The encoder uses the scale factors to control the distribution of quantization noise. Since the scale factors themselves do not represent the audio waveform, scale factors are sometimes designated as overhead or side information. In many scenarios, a significant portion (10-15%) of the total number of bits used for encoding is used to represent the scale factors.

Quantization maps ranges of input values to single values, introducing irreversible loss of information but also allowing an encoder to regulate the quality and bit rate of the output. Sometimes, the encoder performs quantization in conjunction with a rate controller that adjusts the quantization to regulate bit rate and/or quality. There are various kinds of quantization, including adaptive and non-adaptive, scalar and vector, uniform and non-uniform. Perceptual weighting can be considered a form of non-uniform quantization.

Conventionally, an audio encoder uses one or more of a variety of different lossless compression techniques, which are also called entropy coding techniques. In general, lossless compression techniques include run-length encoding, run-level coding variable length encoding, and arithmetic coding.

The corresponding decompression techniques (also called entropy decoding techniques) include run-length decoding, run-level decoding, variable length decoding, and arithmetic decoding.

Inverse quantization and inverse weighting reconstruct the weighted, quantized frequency coefficient data to an approximation of the original frequency coefficient data. An inverse frequency transform then converts the reconstructed frequency coefficient data into reconstructed time domain audio samples.

Given the importance of compression and decompression to media processing, it is not surprising that compression and decompression are richly developed fields. Whatever the advantages of prior techniques and systems for scale factor compression and decompression, however, they do not have various advantages of the techniques and systems described herein.

SUMMARY

Techniques and tools for representing, coding, and decoding scale factor information are described herein. In general, the techniques and tools reduce the bit rate associated with scale factors with no penalty or only a negligible penalty in terms of scale factor quality. Or, the techniques and tools improve the quality associated with the scale factors with no penalty or only a negligible penalty in terms of bit rate for the scale factors.

According to a first set of techniques and tools, a tool such as an encoder or decoder selects a scale factor prediction mode from multiple scale factor prediction modes. Each of the multiple scale factor prediction modes is available for processing a particular mask. For example, the multiple scale factor prediction modes include temporal scale factor prediction mode, a spectral scale factor prediction mode, and a spatial scale factor prediction mode. The selecting can occur on a mask-by-mask basis or some other basis. The tool then performs scale factor prediction according to the selected scale factor prediction mode.

According to a second set of techniques and tools, a tool such as an encoder or decoder selects a scale factor spectral resolution from multiple scale factor spectral resolutions. The multiple scale factor spectral resolutions include multiple sub-critical band resolutions. The tool then processes spectral coefficients with scale factors at the selected scale factor spectral resolution.

According to a third set of techniques and tools, a tool such as an encoder or decoder selects a scale factor spectral resolution from multiple scale factor spectral resolutions. Each of the multiple scale factor spectral resolutions is available for processing a particular sub-frame of spectral coefficients. The tool then processes spectral coefficients including the particular sub-frame of spectral coefficients with scale factors at the selected scale factor spectral resolution.

According to a fourth set of techniques and tools, a tool such as an encoder or decoder reorders scale factor prediction residuals and processes results of the reordering. For example, during encoding, the reordering occurs before run-level encoding of reordered scale factor prediction residuals. Or, during decoding, the reordering occurs after run-level decoding of reordered scale factor prediction residuals. The reordering can be based upon critical band boundaries for scale factors having sub-critical band spectral resolution.

According to a fifth set of techniques and tools, a tool such as an encoder or decoder performs a first scale factor prediction for scale factors then performs a second scale factor prediction on results of the first scale factor prediction. For example, during encoding, an encoder performs a spatial or temporal scale factor prediction followed by a spectral scale factor prediction. Or, during decoding, a decoder performs a spectral scale factor prediction followed by a spatial or temporal scale factor prediction. The spectral scale factor prediction can be a critical band bounded spectral prediction for scale factors having sub-critical band spectral resolution.

According to a sixth set of techniques and tools, a tool such as an encoder or decoder performs critical band bounded spectral prediction for scale factors of a mask. The critical band bounded spectral prediction includes resetting the spectral prediction at each of multiple critical band boundaries.

According to a seventh set of techniques and tools, a tool such as an encoder receives a set of scale factor amplitudes. The tool smoothes the set of scale factor amplitudes without reducing amplitude resolution. The smoothing reduces noise in the scale factor amplitudes while preserving one or more scale factor valleys. For example, for scale factors at sub-critical band spectral resolution, the smoothing selectively replaces non-valley amplitudes with a per critical band average amplitude while preserving valley amplitudes. The threshold for valley amplitudes can be set adaptively.

According to an eighth set of techniques and tools, a tool such as an encoder or decoder predicts current scale factors for a current original channel of multi-channel audio from anchor scale factors for an anchor original channel of the multi-channel audio. The tool then processes the current scale factors based at least in part on results of the predicting.

According to a ninth set of techniques and tools, a tool such as an encoder or decoder processes first spectral coefficients in a first original channel of multi-channel audio with a first set of scale factors. The tool then processes second spectral coefficients in a second original channel of the multi-channel audio with the first set of scale factors.

The foregoing and other objects, features, and advantages of the invention will become more apparent from the following detailed description, which proceeds with reference to the accompanying figures.

DETAILED DESCRIPTION

Various techniques and tools for representing, coding, and decoding of scale factors are described. These techniques and tools facilitate the creation, distribution, and playback of high quality audio content, even at very low bit rates.

The various techniques and tools described herein may be used independently. Some of the techniques and tools may be used in combination (e.g., in different phases of a combined encoding and/or decoding process).

Various techniques are described below with reference to flowcharts of processing acts. The various processing acts shown in the flowcharts may be consolidated into fewer acts or separated into more acts. For the sake of simplicity, the relation of acts shown in a particular flowchart to acts described elsewhere is often not shown. In many cases, the acts in a flowchart can be reordered.

Much of the detailed description addresses representing, coding, and decoding scale factors for audio information. Many of the techniques and tools described herein for representing, coding, and decoding scale factors for audio information can also be applied to scale factors for video information, still image information, or other media information.

I. Example Operating Environments for Encoders and/or Decoders

Figure 1:
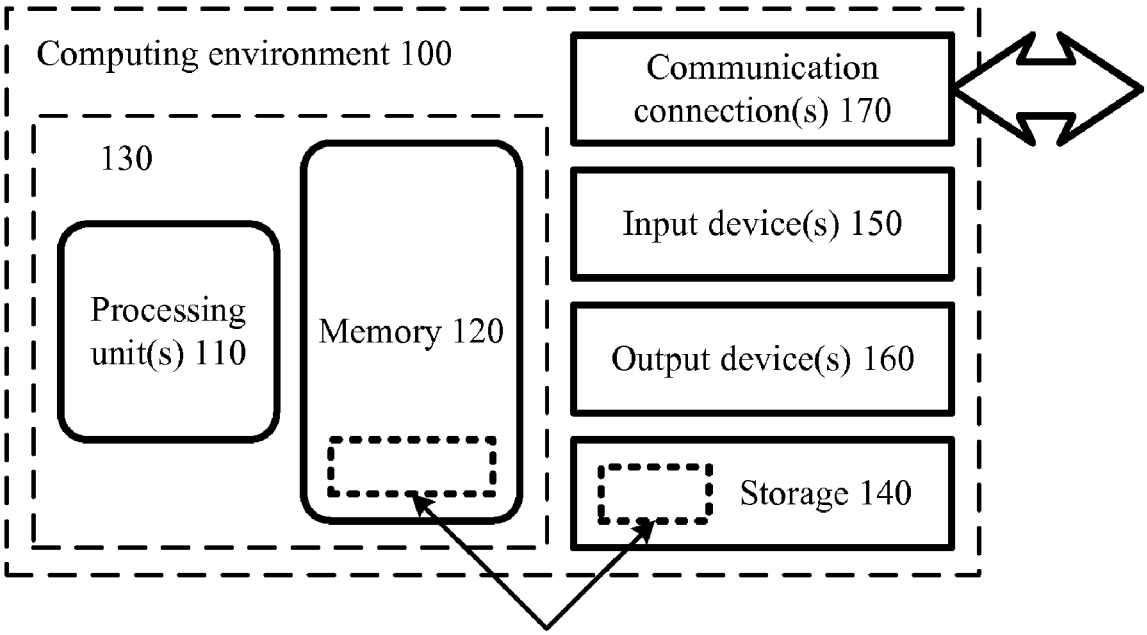
FIG. 1 is a block diagram of a generalized operating environment in conjunction with which various described embodiments may be implemented.

FIG. 1 illustrates a generalized example of a suitable computing environment (100) in which several of the described embodiments may be implemented. The computing environment (100) is not intended to suggest any limitation as to scope of use or functionality, as the described techniques and tools may be implemented in diverse general-purpose or special-purpose computing environments.

With reference to FIG. 1, the computing environment (100) includes at least one processing unit (110) and memory (120). In FIG. 1, this most basic configuration (130) is included within a dashed line. The processing unit (110) executes computer-executable instructions and may be a real or a virtual processor. In a multi-processing system, multiple processing units execute computer-executable instructions to increase processing power. The memory (120) may be volatile memory (e.g., registers, cache, RAM), non-volatile memory (e.g., ROM, EEPROM, flash memory, etc.), or some combination of the two. The memory (120) stores software (180) implementing an encoder and/or decoder that uses one or more of the techniques described herein.

A computing environment may have additional features. For example, the computing environment (100) includes storage (140), one or more input devices (150), one or more output devices (160), and one or more communication connections (170). An interconnection mechanism (not shown) such as a bus, controller, or network interconnects the components of the computing environment (100). Typically, operating system software (not shown) provides an operating environment for other software executing in the computing environment (100), and coordinates activities of the components of the computing environment (100).

The storage (140) may be removable or non-removable, and includes magnetic disks, magnetic tapes or cassettes, CD-ROMs, DVDs, or any other medium which can be used to store information and which can be accessed within the computing environment (100). The storage (140) stores instructions for the software (180).

The input device(s) (150) may be a touch input device such as a keyboard, mouse, pen, or trackball, a voice input device, a scanning device, or another device that provides input to the computing environment (100). For audio or video encoding, the input device(s) (150) may be a microphone, sound card, video card, TV tuner card, or similar device that accepts audio or video input in analog or digital form, or a CD-ROM or CD-RW that reads audio or video samples into the computing environment (100). The output device(s) (160) may be a display, printer, speaker, CD-writer, or another device that provides output from the computing environment (100).

The communication connection(s) (170) enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The techniques and tools can be described in the general context of computer-readable media. Computer-readable media are any available media that can be accessed within a computing environment. By way of example, and not limitation, with the computing environment (100), computer-readable media include memory (120), storage (140), communication media, and combinations of any of the above.

The techniques and tools can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "signal," "determine," and "apply" to describe computer operations in a computing environment. These terms are high-level abstractions for operations performed by a computer, and should not be confused with acts performed by a human being. The actual computer operations corresponding to these terms vary depending on implementation.

II. Example Encoders and Decoders

Figure 2:
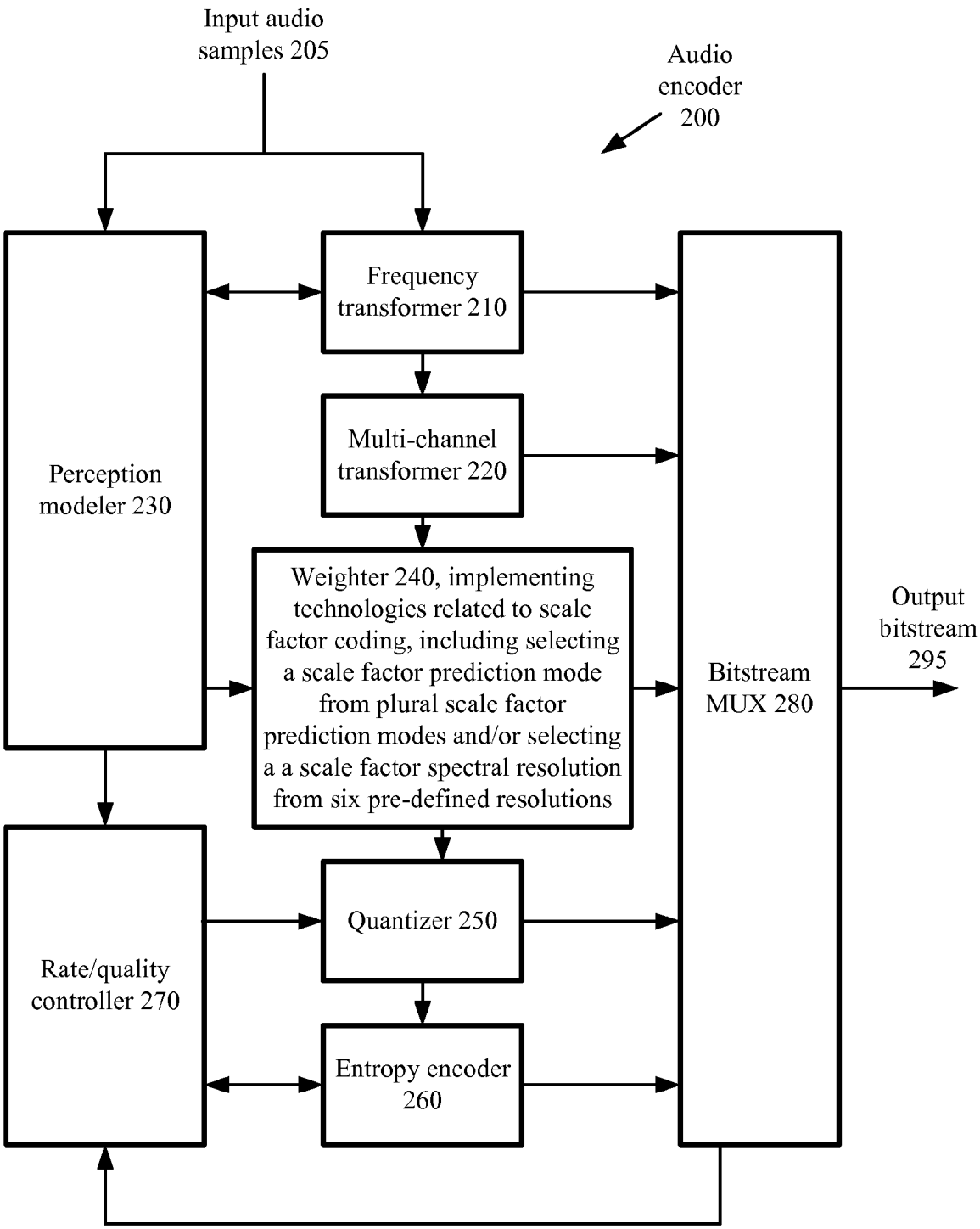
FIGS. 2, 3, 4, and 5 are block diagrams of generalized encoders and/or decoders in conjunction with which various described embodiments may be implemented.
Figure 3:
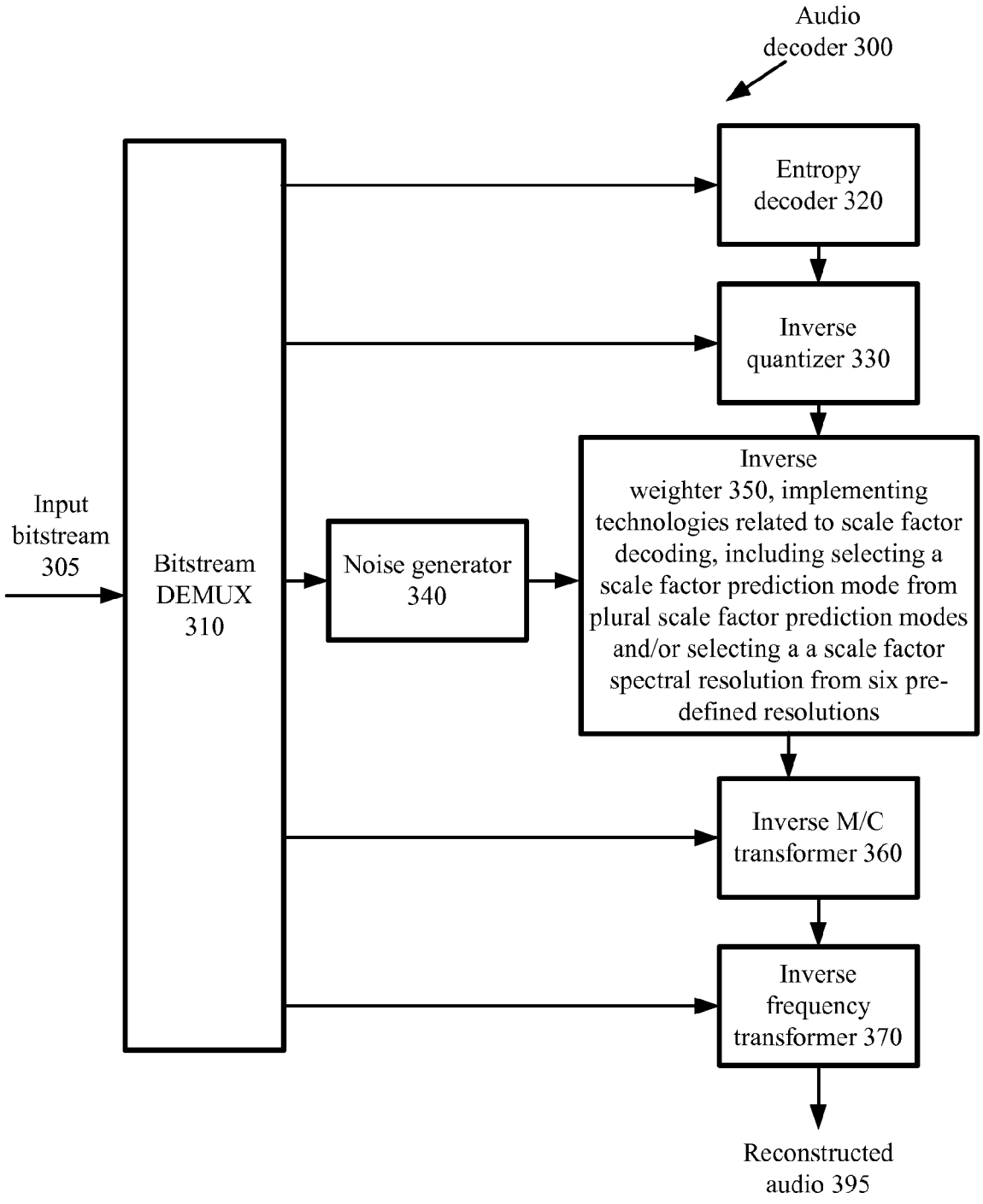

FIG. 2 shows a first audio encoder (200) in which one or more described embodiments may be implemented. The encoder (200) is a transform-based, perceptual audio encoder (200). FIG. 3 shows a corresponding audio decoder (300).

Figure 4:
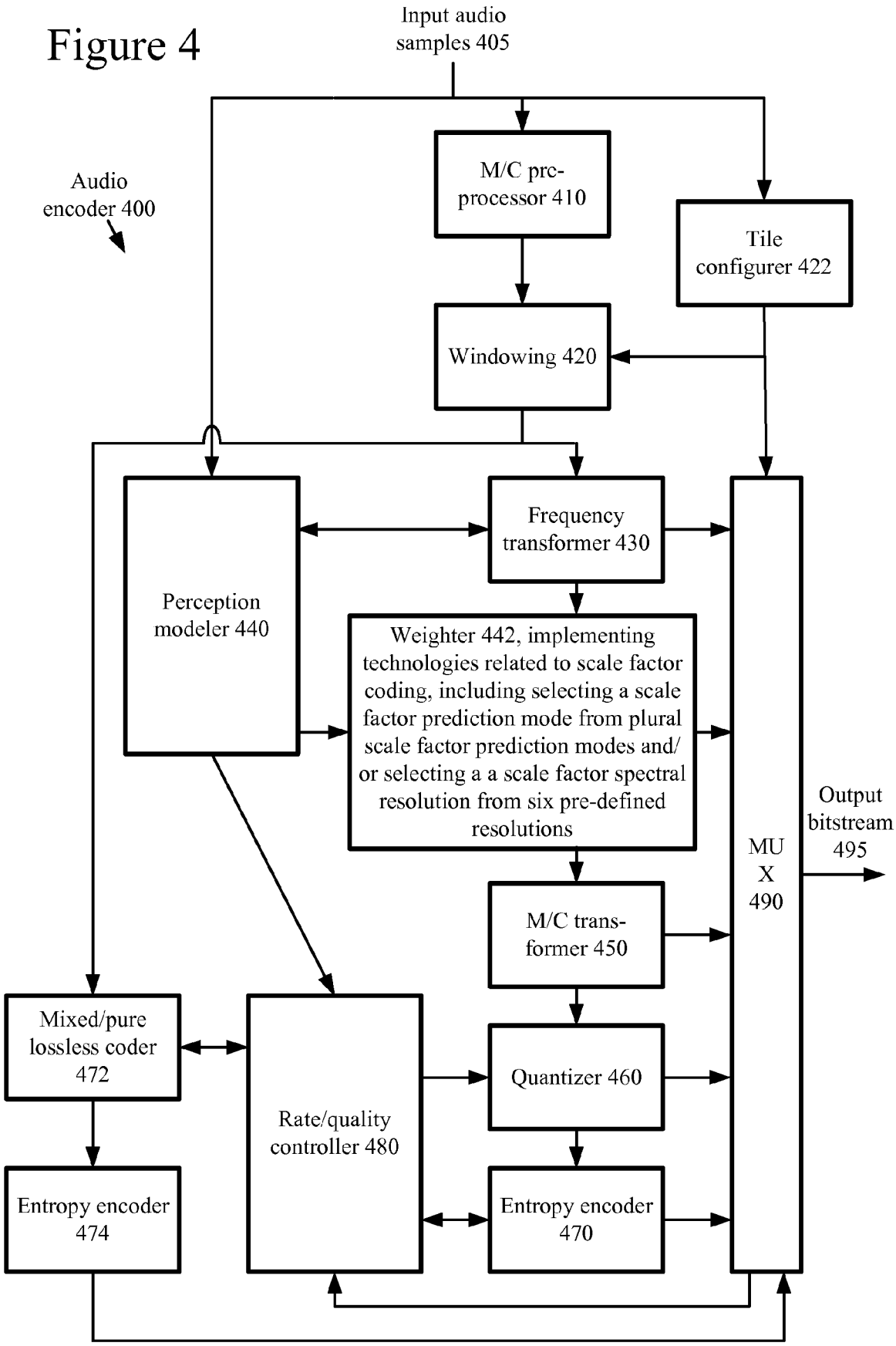
Figure 5:
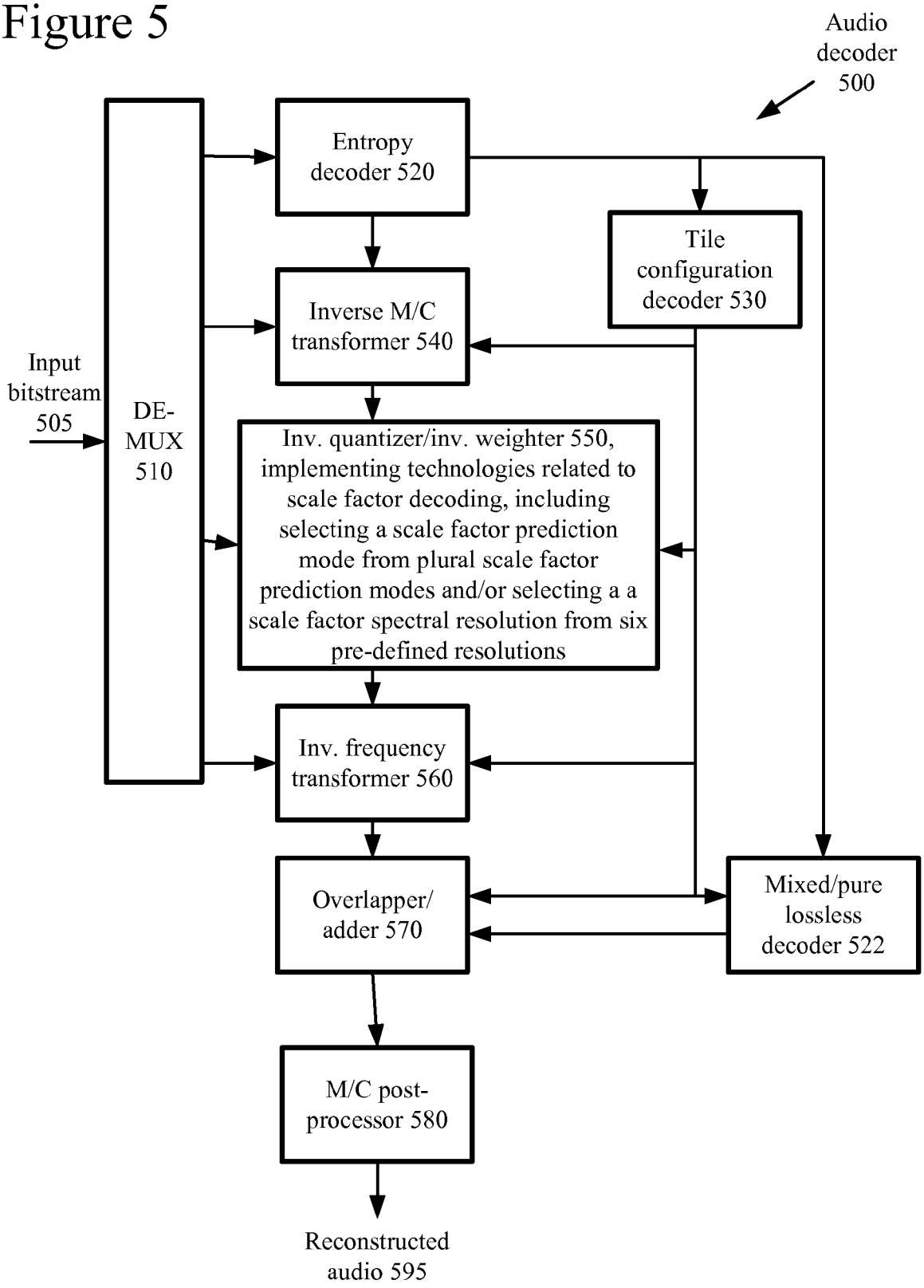

FIG. 4 shows a second audio encoder (400) in which one or more described embodiments may be implemented. The encoder (400) is again a transform-based, perceptual audio encoder, but the encoder (400) includes additional modules for processing multi-channel audio. FIG. 5 shows a corresponding audio decoder (500).

Though the systems shown in FIGS. 2 through 5 are generalized, each has characteristics found in real world systems. In any case, the relationships shown between modules within the encoders and decoders indicate flows of information in the encoders and decoders; other relationships are not shown for the sake of simplicity. Depending on implementation and the type of compression desired, modules of an encoder or decoder can be added, omitted, split into multiple modules, combined with other modules, and/or replaced with like modules. In alternative embodiments, encoders or decoders with different modules and/or other configurations process audio data or some other type of data according to one or more described embodiments. For example, modules in FIG. 2 through 5 that process spectral coefficients can be used to process only coefficients in a base band or base frequency sub-range(s) (such as lower frequencies), with different modules (not shown) processing spectral coefficients in other frequency sub-ranges (such as higher frequencies).

A. First Audio Encoder.

Overall, the encoder (200) receives a time series of input audio samples (205) at some sampling depth and rate. The input audio samples (205) are for multi-channel audio (e.g., stereo) or mono audio. The encoder (200) compresses the audio samples (205) and multiplexes information produced by the various modules of the encoder (200) to output a bitstream (295) in a format such as a WMA format, Advanced Streaming Format ("ASF"), or other format.

The frequency transformer (210) receives the audio samples (205) and converts them into data in the spectral domain. For example, the frequency transformer (210) splits the audio samples (205) of frames into sub-frame blocks, which can have variable size to allow variable temporal resolution. Blocks can overlap to reduce perceptible discontinuities between blocks that could otherwise be introduced by later quantization. The frequency transformer (210) applies to blocks a time-varying Modulated Lapped Transform ("MLT"), modulated DCT ("MDCT"), some other variety of MLT or DCT, or some other type of modulated or non-modulated, overlapped or non-overlapped frequency transform, or use subband or wavelet coding. The frequency transformer (210) outputs blocks of spectral coefficient data and outputs side information such as block sizes to the multiplexer ("MUX") (280).

For multi-channel audio data, the multi-channel transformer (220) can convert the multiple original, independently coded channels into jointly coded channels. Or, the multi-channel transformer (220) can pass the left and right channels through as independently coded channels. The multi-channel transformer (220) produces side information to the MUX (280) indicating the channel mode used. The encoder (200) can apply multi-channel rematrixing to a block of audio data after a multi-channel transform.

The perception modeler (230) models properties of the human auditory system to improve the perceived quality of the reconstructed audio signal for a given bit rate. The perception modeler (230) uses any of various auditory models and passes excitation pattern information or other information to the weighter (240). For example, an auditory model typically considers the range of human hearing and critical bands (e.g., Bark bands). Aside from range and critical bands, interactions between audio signals can dramatically affect perception. In addition, an auditory model can consider a variety of other factors relating to physical or neural aspects of human perception of sound.

The perception modeler (230) outputs information that the weighter (240) uses to shape noise in the audio data to reduce the audibility of the noise. For example, using any of various techniques, the weighter (240) generates scale factors (sometimes called weighting factors) for quantization matrices (sometimes called masks) based upon the received information. The scale factors for a quantization matrix include a weight for each of multiple quantization bands in the matrix, where the quantization bands are frequency ranges of frequency coefficients. Thus, the scale factors indicate proportions at which noise/quantization error is spread across the quantization bands, thereby controlling spectral/temporal distribution of the noise/quantization error, with the goal of minimizing the audibility of the noise by putting more noise in bands where it is less audible, and vice versa. The scale factors can vary in amplitude and number of quantization bands from block to block. A set of scale factors can be compressed for more efficient representation. Various mechanisms for representing and coding scale factors in some embodiments are described in detail in section III.

The weighter (240) then applies the scale factors to the data received from the multi-channel transformer (220).

The quantizer (250) quantizes the output of the weighter (240), producing quantized coefficient data to the entropy encoder (260) and side information including quantization step size to the MUX (280). In FIG. 2, the quantizer (250) is an adaptive, uniform, scalar quantizer. The quantizer (250) applies the same quantization step size to each spectral coefficient, but the quantization step size itself can change from one iteration of a quantization loop to the next to affect the bit rate of the entropy encoder (260) output. Other kinds of quantization are non-uniform, vector quantization, and/or non-adaptive quantization.

The entropy encoder (260) losslessly compresses quantized coefficient data received from the quantizer (250), for example, performing run-level coding and vector variable length coding. The entropy encoder (260) can compute the number of bits spent encoding audio information and pass this information to the rate/quality controller (270).

The controller (270) works with the quantizer (250) to regulate the bit rate and/or quality of the output of the encoder (200). The controller (270) outputs the quantization step size to the quantizer (250) with the goal of satisfying bit rate and quality constraints.

In addition, the encoder (200) can apply noise substitution and/or band truncation to a block of audio data.

The MUX (280) multiplexes the side information received from the other modules of the audio encoder (200) along with the entropy encoded data received from the entropy encoder (260). The MUX (280) can include a virtual buffer that stores the bitstream (295) to be output by the encoder (200).

B. First Audio Decoder.

Overall, the decoder (300) receives a bitstream (305) of compressed audio information including entropy encoded data as well as side information, from which the decoder (300) reconstructs audio samples (395).

The demultiplexer ("DEMUX") (310) parses information in the bitstream (305) and sends information to the modules of the decoder (300). The DEMUX (310) includes one or more buffers to compensate for short-term variations in bit rate due to fluctuations in complexity of the audio, network jitter, and/or other factors.

The entropy decoder (320) losslessly decompresses entropy codes received from the DEMUX (310), producing quantized spectral coefficient data. The entropy decoder (320) typically applies the inverse of the entropy encoding techniques used in the encoder.

The inverse quantizer (330) receives a quantization step size from the DEMUX (310) and receives quantized spectral coefficient data from the entropy decoder (320). The inverse quantizer (330) applies the quantization step size to the quantized frequency coefficient data to partially reconstruct the frequency coefficient data, or otherwise performs inverse quantization.

From the DEMUX (310), the noise generator (340) receives information indicating which bands in a block of data are noise substituted as well as any parameters for the form of the noise. The noise generator (340) generates the patterns for the indicated bands, and passes the information to the inverse weighter (350).

The inverse weighter (350) receives the scale factors from the DEMUX (310), patterns for any noise-substituted bands from the noise generator (340), and the partially reconstructed frequency coefficient data from the inverse quantizer (330). As necessary, the inverse weighter (350) decompresses the scale factors. Various mechanisms for decoding scale factors in some embodiments are described in detail in section III. The inverse weighter (350) applies the scale factors to the partially reconstructed frequency coefficient data for bands that have not been noise substituted. The inverse weighter (350) then adds in the noise patterns received from the noise generator (340) for the noise-substituted bands.

The inverse multi-channel transformer (360) receives the reconstructed spectral coefficient data from the inverse weighter (350) and channel mode information from the DEMUX (310). If multi-channel audio is in independently coded channels, the inverse multi-channel transformer (360) passes the channels through. If multi-channel data is in jointly coded channels, the inverse multi-channel transformer (360) converts the data into independently coded channels.

The inverse frequency transformer (370) receives the spectral coefficient data output by the multi-channel transformer (360) as well as side information such as block sizes from the DEMUX (310). The inverse frequency transformer (370) applies the inverse of the frequency transform used in the encoder and outputs blocks of reconstructed audio samples (395).

C. Second Audio Encoder.

With reference to FIG. 4, the encoder (400) receives a time series of input audio samples (405) at some sampling depth and rate. The input audio samples (405) are for multi-channel audio (e.g., stereo, surround) or mono audio. The encoder (400) compresses the audio samples (405) and multiplexes information produced by the various modules of the encoder (400) to output a bitstream (495) in a format such as a WMA Pro format or other format.

The encoder (400) selects between multiple encoding modes for the audio samples (405). In FIG. 4, the encoder (400) switches between a mixed/pure lossless coding mode and a lossy coding mode. The lossless coding mode includes the mixed/pure lossless coder (472) and is typically used for high quality (and high bit rate) compression. The lossy coding mode includes components such as the weighter (442) and quantizer (460) and is typically used for adjustable quality (and controlled bit rate) compression. The selection decision depends upon user input or other criteria.

For lossy coding of multi-channel audio data, the multi-channel pre-processor (410) optionally re-matrixes the time-domain audio samples (405). For example, the multi-channel pre-processor (410) selectively re-matrixes the audio samples (405) to drop one or more coded channels or increase inter-channel correlation in the encoder (400), yet allow reconstruction (in some form) in the decoder (500). The multi-channel pre-processor (410) may send side information such as instructions for multi-channel post-processing to the MUX (490).

The windowing module (420) partitions a frame of audio input samples (405) into sub-frame blocks (windows). The windows may have time-varying size and window shaping functions. When the encoder (400) uses lossy coding, variable-size windows allow variable temporal resolution. The windowing module (420) outputs blocks of partitioned data and outputs side information such as block sizes to the MUX (490).

In FIG. 4, the tile configurer (422) partitions frames of multi-channel audio on a per-channel basis. The tile configurer (422) independently partitions each channel in the frame, if quality/bit rate allows. This allows, for example, the tile configurer (422) to isolate transients that appear in a particular channel with smaller windows, but use larger windows for frequency resolution or compression efficiency in other channels. This can improve compression efficiency by isolating transients on a per channel basis, but additional information specifying the partitions in individual channels is needed in many cases. Windows of the same size that are co-located in time may qualify for further redundancy reduction through multi-channel transformation. Thus, the tile configurer (422) groups windows of the same size that are co-located in time as a tile.

Figure 6:
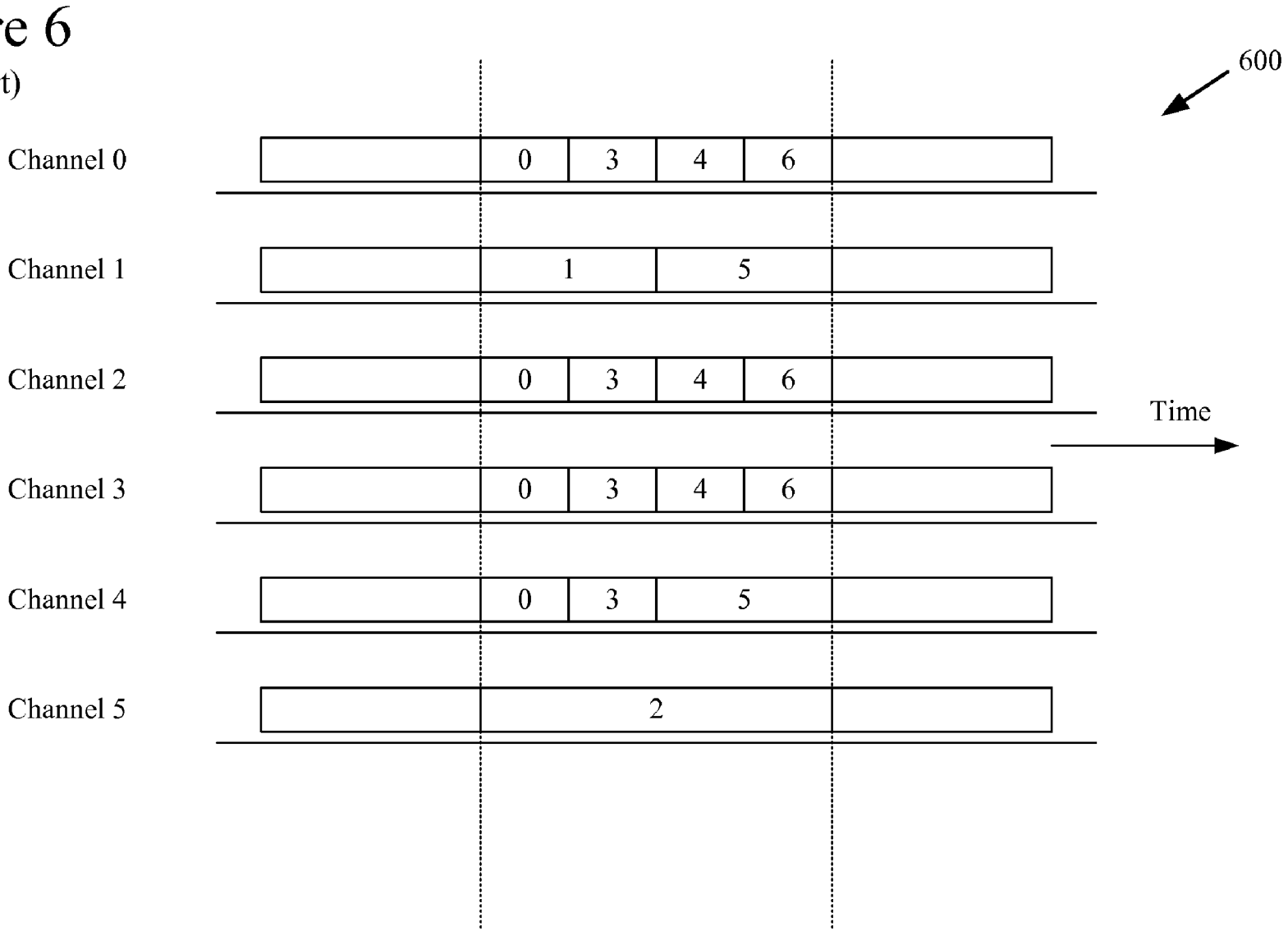
Figure 6 (Prior Art)
FIG. 6 is a diagram showing an example tile configuration.

FIG. 6 shows an example tile configuration (600) for a frame of 5.1 channel audio. The tile configuration (600) includes seven tiles, numbered 0 through 6. Tile 0 includes samples from channels 0, 2, 3, and 4 and spans the first quarter of the frame. Tile 1 includes samples from channel 1 and spans the first half of the frame. Tile 2 includes samples from channel 5 and spans the entire frame. Tile 3 is like tile 0, but spans the second quarter of the frame. Tiles 4 and 6 include samples in channels 0, 2, and 3, and span the third and fourth quarters, respectively, of the frame. Finally, tile 5 includes samples from channels 1 and 4 and spans the last half of the frame. As shown, a particular tile can include windows in non-contiguous channels.

The frequency transformer (430) receives audio samples and converts them into data in the frequency domain, applying a transform such as described above for the frequency transformer (210) of FIG. 2. The frequency transformer (430) outputs blocks of spectral coefficient data to the weighter (442) and outputs side information such as block sizes to the MUX (490). The frequency transformer (430) outputs both the frequency coefficients and the side information to the perception modeler (440).

The perception modeler (440) models properties of the human auditory system, processing audio data according to an auditory model, generally as described above with reference to the perception modeler (230) of FIG. 2.

The weighter (442) generates scale factors for quantization matrices based upon the information received from the perception modeler (440), generally as described above with reference to the weighter (240) of FIG. 2. The weighter (442) applies the scale factors to the data received from the frequency transformer (430). The weighter (442) outputs side information such as the quantization matrices and channel weight factors to the MUX (490). The quantization matrices can be compressed. Various mechanisms for representing and coding scale factors in some embodiments are described in detail in section III.

For multi-channel audio data, the multi-channel transformer (450) may apply a multi-channel transform. For example, the multi-channel transformer (450) selectively and flexibly applies the multi-channel transform to some but not all of the channels and/or quantization bands in the tile. The multi-channel transformer (450) selectively uses pre-defined matrices or custom matrices, and applies efficient compression to the custom matrices. The multi-channel transformer (450) produces side information to the MUX (490) indicating, for example, the multi-channel transforms used and multi-channel transformed parts of tiles.

The quantizer (460) quantizes the output of the multi-channel transformer (450), producing quantized coefficient data to the entropy encoder (470) and side information including quantization step sizes to the MUX (490). In FIG. 4, the quantizer (460) is an adaptive, uniform, scalar quantizer that computes a quantization factor per tile, but the quantizer (460) may instead perform some other kind of quantization.

The entropy encoder (470) losslessly compresses quantized coefficient data received from the quantizer (460), generally as described above with reference to the entropy encoder (260) of FIG. 2.

The controller (480) works with the quantizer (460) to regulate the bit rate and/or quality of the output of the encoder (400). The controller (480) outputs the quantization factors to the quantizer (460) with the goal of satisfying quality and/or bit rate constraints.

The mixed/pure lossless encoder (472) and associated entropy encoder (474) compress audio data for the mixed/pure lossless coding mode. The encoder (400) uses the mixed/pure lossless coding mode for an entire sequence or switches between coding modes on a frame-by-frame, block-by-block, tile-by-tile, or other basis.

The MUX (490) multiplexes the side information received from the other modules of the audio encoder (400) along with the entropy encoded data received from the entropy encoders (470, 474). The MUX (490) includes one or more buffers for rate control or other purposes.

D. Second Audio Decoder.

With reference to FIG. 5, the second audio decoder (500) receives a bitstream (505) of compressed audio information. The bitstream (505) includes entropy encoded data as well as side information from which the decoder (500) reconstructs audio samples (595).

The DEMUX (510) parses information in the bitstream (505) and sends information to the modules of the decoder (500). The DEMUX (510) includes one or more buffers to compensate for short-term variations in bit rate due to fluctuations in complexity of the audio, network jitter, and/or other factors.

The entropy decoder (520) losslessly decompresses entropy codes received from the DEMUX (510), typically applying the inverse of the entropy encoding techniques used in the encoder (400). When decoding data compressed in lossy coding mode, the entropy decoder (520) produces quantized spectral coefficient data.

The mixed/pure lossless decoder (522) and associated entropy decoder(s) (520) decompress losslessly encoded audio data for the mixed/pure lossless coding mode.

The tile configuration decoder (530) receives and, if necessary, decodes information indicating the patterns of tiles for frames from the DEMUX (590). The tile pattern information may be entropy encoded or otherwise parameterized. The tile configuration decoder (530) then passes tile pattern information to various other modules of the decoder (500).

The inverse multi-channel transformer (540) receives the quantized spectral coefficient data from the entropy decoder (520) as well as tile pattern information from the tile configuration decoder (530) and side information from the DEMUX (510) indicating, for example, the multi-channel transform used and transformed parts of tiles. Using this information, the inverse multi-channel transformer (540) decompresses the transform matrix as necessary, and selectively and flexibly applies one or more inverse multi-channel transforms to the audio data.

The inverse quantizer/weighter (550) receives information such as tile and channel quantization factors as well as quantization matrices from the DEMUX (510) and receives quantized spectral coefficient data from the inverse multi-channel transformer (540). The inverse quantizer/weighter (550) decompresses the received scale factor information as necessary. Various mechanisms for decoding scale factors in some embodiments are described in detail in section III. The quantizer/weighter (550) then performs the inverse quantization and weighting.

The inverse frequency transformer (560) receives the spectral coefficient data output by the inverse quantizer/weighter (550) as well as side information from the DEMUX (510) and tile pattern information from the tile configuration decoder (530). The inverse frequency transformer (570) applies the inverse of the frequency transform used in the encoder and outputs blocks to the overlapper/adder (570).

In addition to receiving tile pattern information from the tile configuration decoder (530), the overlapper/adder (570) receives decoded information from the inverse frequency transformer (560) and/or mixed/pure lossless decoder (522). The overlapper/adder (570) overlaps and adds audio data as necessary and interleaves frames or other sequences of audio data encoded with different modes.

The multi-channel post-processor (580) optionally re-matrixes the time-domain audio samples output by the overlapper/adder (570). For bitstream-controlled post-processing, the post-processing transform matrices vary over time and are signaled or included in the bitstream (505).

E. Scale Factor Coding for Multi-Channel Audio.

Figure 7:
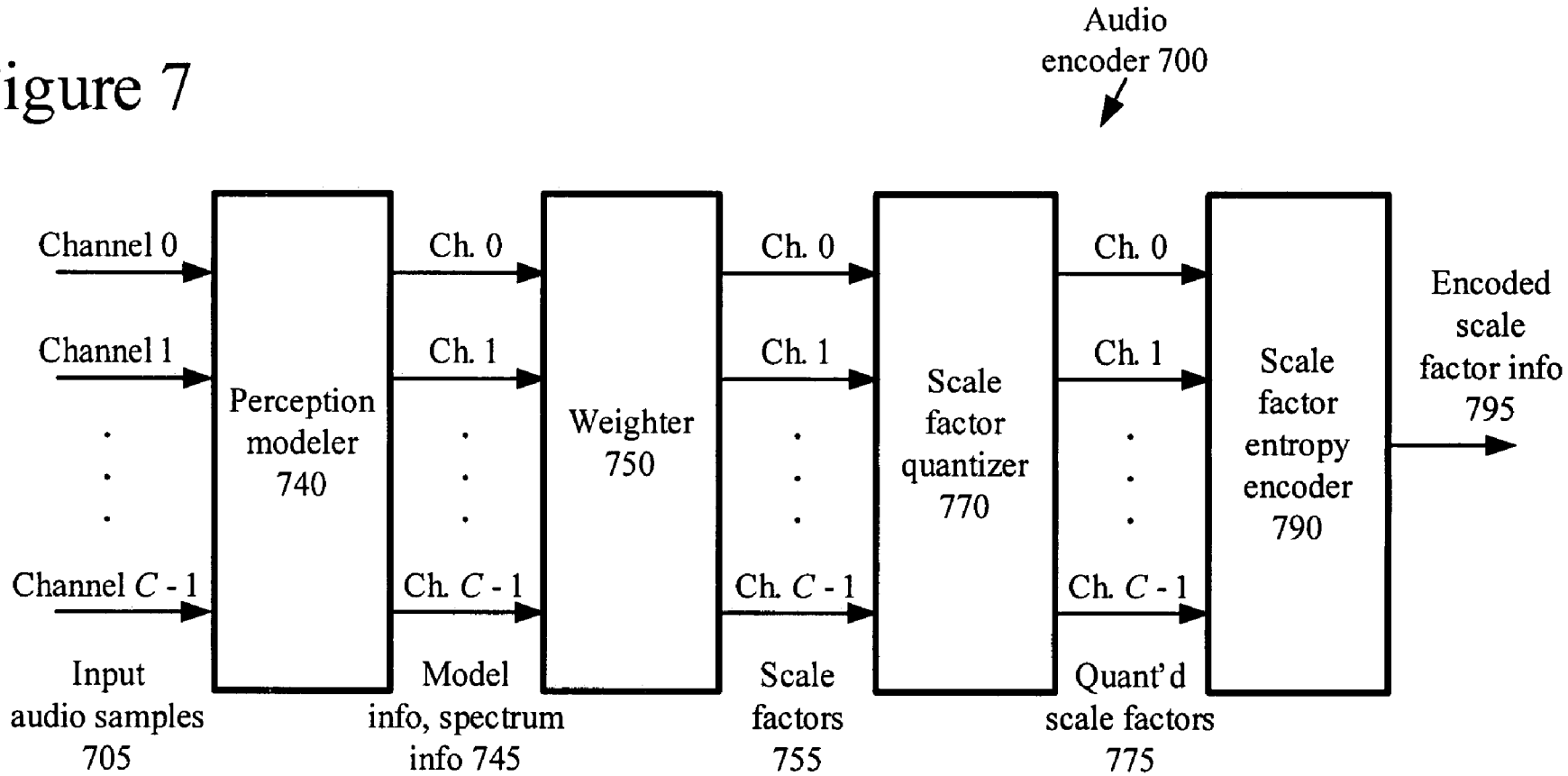
FIGS. 7 and 8 are block diagrams showing modules for scale factor coding and decoding, respectively, for multi-channel audio.

FIG. 7 shows modules for scale factor coding for multi-channel audio. The encoder (700) that includes the modules shown in FIG. 7 can be an encoder such as shown in FIG. 4 or some other encoder.

With reference to FIG. 7, a perception modeler (740) receives input audio samples (705) for multi-channel audio in C channels, labeled channel 0 through channel C-1 in FIG. 7. The perception modeler (740) models properties of the human auditory system, processing audio data according to an auditory model, generally as described above with reference to FIGS. 2 and 4. For each of the C channels, the perception modeler (740) outputs information (745) such as excitation patterns or other information about the spectra of the samples (705) in the channels.

The weighter (750) generates scale factors (755) for masks based upon per channel information (745) received from the perception modeler (740). The scale factors (755) act as quantization step sizes applied to groups of spectral coefficients in perceptual weighting during encoding and in corresponding inverse weighting during decoding. For example, the weighter (750) generates scale factors (755) for masks from the information (745) received from the perception modeler (740) using a technique described in U.S. Patent Application Publication No. 2003/0115051 A1, entitled "Quantization Matrices for Digital Audio," or U.S. Patent Application Publication No. 2004/0044527 A1, entitled, "Quantization and Inverse Quantization for Audio." Various mechanisms for adjusting the spectral resolution of scale factors (755) in some embodiments are described in detail in section III.B. Alternatively, the weighter (750) generates scale factors (755) for masks using some other technique.

The weighter (750) outputs the scale factors (755) per channel to the scale factor quantizer (770). The scale factor quantizer (770) quantizes the scale factors (755). For example, the scale factor quantizer (770) uniformly quantizes the scale factors (755) by a step size of 1 decibel ("dB"). Or, the scale factor quantizer (770) uniformly quantizes the scale factors (755) by a step size of any of 1, 2, 3, or 4 dB, with the encoder (700) selecting the step size on a frame-by-frame basis per channel to trade off bit rate and fidelity for the scale factor representation. The quantization step size for scale factors can be adaptively set on some other basis, for example, on a frame-by-frame basis for all channels, and/or have other available step sizes. Alternatively, the scale factor quantizer (770) quantizes the scale factors (755) using some other mechanism.

The scale factor entropy coder (790) entropy codes the quantized scale factors (775). Various mechanisms for encoding scale factors (quantized (775) or otherwise) in some embodiments are described in detail in section III. The scale factor entropy encoder (790) eventually outputs the encoded scale factor information (795) to another module of the encoder (700) (e.g., a multiplexer) or a bitstream.

The encoder (700) also includes modules (not shown) for reconstructing the quantized scale factors (775). For example, the encoder (700) includes a scale factor inverse quantizer such as the one shown in FIG. 8. The encoder (700) then outputs reconstructed scale factors per channel to another module of the encoder (700), for example, a weighter.

F. Scale Factor Decoding for Multi-Channel Audio.

Figure 8:
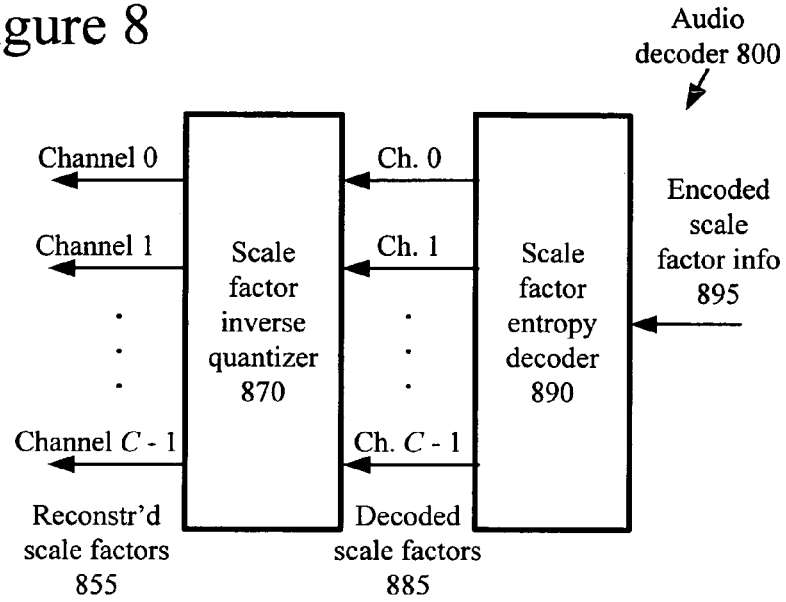

FIG. 8 shows modules for scale factor decoding for multi-channel audio. The decoder (800) that includes the modules shown in FIG. 8 can be a decoder such as shown in FIG. 5 or some other decoder.

The scale factor entropy decoder (890) receives entropy encoded scale factor information (895) from another module of the decoder (800) or a bitstream. The scale factor information is for multi-channel audio in C channels, labeled channel 0 through channel C-1 in FIG. 8. The scale factor entropy decoder (890) entropy decodes the encoded scale factor information (895). Various mechanisms for decoding scale factors in some embodiments are described in detail in section III.

The scale factor inverse quantizer (870) receives quantized scale factors and performs inverse quantization on the scale factors. For example, the scale factor inverse quantizer (870) reconstructs the scale factors (855) using a uniform step size of 1 decibel ("dB"). Or, the scale factor inverse quantizer (870) reconstructs the scale factors (855) using a uniform step size of 1, 2, 3, or 4 dB, or other dB step sizes, with the decoder (800) receiving (e.g., parsing from the bit stream) the selected the step size on a frame-by-frame or other basis per channel. Alternatively, the scale factor inverse quantizer (870) reconstructs the scale factors (855) using some other mechanism. The scale factor inverse quantizer (870) outputs reconstructed scale factors (855) per channel to another module of the decoder (800), for example, an inverse weighting module.

III. Coding and Decoding of Scale Factor Information

An audio encoder often uses scale factors to shape or control the distribution of quantization noise. Scale factors can consume a significant portion (e.g., 10-15%) of the total number of bits used for encoding. Various techniques and tools are described below which improve representation, coding, and decoding of scale factors. In particular, in some embodiments, an encoder such as one shown in FIG. 2, 4, or 7 represents and/or encodes scale factors using one or more of the techniques. A corresponding decoder (such as one shown in FIG. 3, 5, or 8) represents and/or decodes scale factors using one or more of the techniques.

For the sake of explanation and consistency, the following notation is used for scale factors for multi-channel audio, where frames of audio in the channels are split into sub-frames. Q[s][c][i] indicates a scale factor i in sub-frame s in channel c of a mask in Q. The range of scale factor i is 0 to I-1 , where I is the number of scale factors in a mask in Q. The range of channel c is 0 to C-1, where C is the number of channels. The range of sub-frame s is 0 to S-1, where S is the number of sub-frames in the frame for that channel. The exact data structures used to represent scale factors depend on implementation, and different implementations can include more or fewer fields in the data structures.

A. Example Problem Domain.

In a conventional transform-based audio encoder, an input audio signal is broken into blocks of samples, with each block possibly overlapping with other blocks. Each of the blocks is transformed through a linear, frequency transform into the frequency (or spectral) domain. The spectral coefficients of the blocks are quantized, which introduces loss of information. Upon reconstruction, the lost information causes potentially audible distortion in the reconstructed signal.

An encoder can use scale factors (also called weighting factors) in a mask (also called quantization matrix) to shape or control how distortion is distributed across the spectral coefficients. The scale factors in effect indicate proportions according to which distortion is spread, and the encoder usually sets the proportions according to psychoacoustic modeling of the audibility of the distortion. The encoder in WMA Standard, for example, uses a two-step process to generate the scale factors. First, the encoder estimates excitation patterns of the waveform to be compressed, performing the estimation on each channel of audio independently. Then, the encoder generates quantization matrices used for coding, accommodating constraints/features of the final syntax when generating the matrices.

Theoretically, scale factors are continuous numbers and can have a distinct value for each spectral coefficient. Representing such scale factor information could be very costly in terms of bit rate, not to mention unnecessary for practical applications. The encoder and decoder in WMA Standard use various tools for scale factor resolution reduction, with the goal of reducing bit rates for scale factor information. The encoder and decoder in WMA Pro also use various tools for scale factor resolution reduction, adding some tools to further reduce bit rates for scale factor information.

1. Reducing Scale Factor Resolution Spectrally.

For perfect noise shaping, an encoder would use a unique step size per spectral coefficient. For a block of 2048 spectral coefficients, the encoder would have 2048 scale factors. The bit rate for scale factors at such a spectral resolution could easily reach prohibitive levels. So, encoders are typically configured to generate scale factors at Bark band resolution or something close to Bark band resolution.

Figure 9:
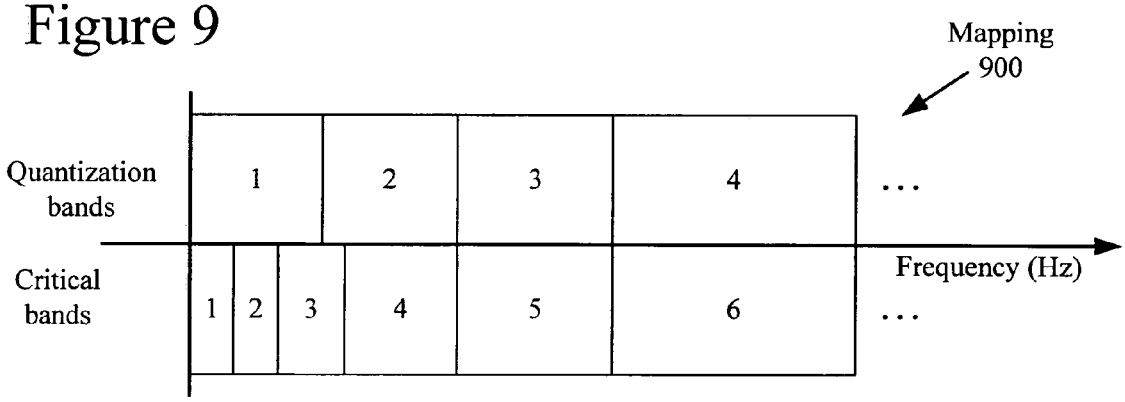
FIG. 9 is a diagram showing an example relation of quantization bands to critical bands.

The encoder and decoder in WMA Standard and WMA Pro use a scale factor per quantization band, where the quantization bands are related (but not necessarily identical) to critical bands used in psychoacoustic modeling. FIG. 9 shows an example relation of quantization bands to critical bands in WMA Standard and WMA Pro. In FIG. 9, the spectral resolution of quantization bands is lower than the spectral resolution of critical bands. Some critical bands have corresponding quantization bands for the same spectral resolution, and other adjacent critical bands in a group map to a single quantization band, but no quantization band is at sub-critical band resolution. Different sizes of blocks have different numbers of critical bands and quantization bands.

One problem with such an arrangement is the lack of flexibility in setting the spectral resolution of scale factors. For example, a spectral resolution appropriate at one bit rate could be too high for a lower bit rate and too low for a higher bit rate.

2. Reducing Scale Factor Resolution Temporally.

Figure 10:
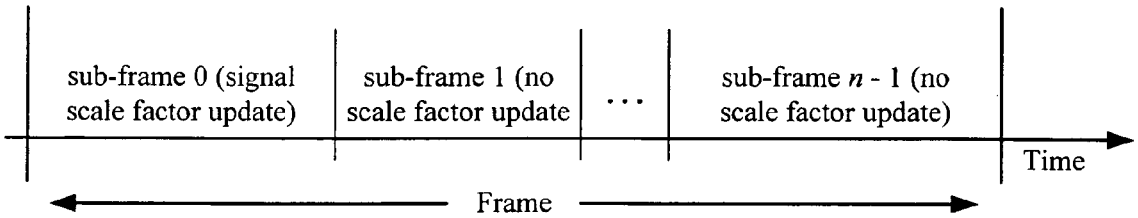
FIG. 10 is a diagram showing reuse of scale factors for sub-frames of a frame.

The encoder and decoder in WMA Standard can reuse the scale factors from one sub-frame for later sub-frames in the same frame. FIG. 10 shows an example in which an encoder and decoder use the scale factors for a first sub-frame for multiple, later sub-frames in the same frame. Thus, the encoder avoids encoding and signaling scale factors for the later sub-frames. For a later sub-frame, the encoder/decoder resamples the scale factors for the first sub-frame and uses the resampled scale factors.

Figure 11:
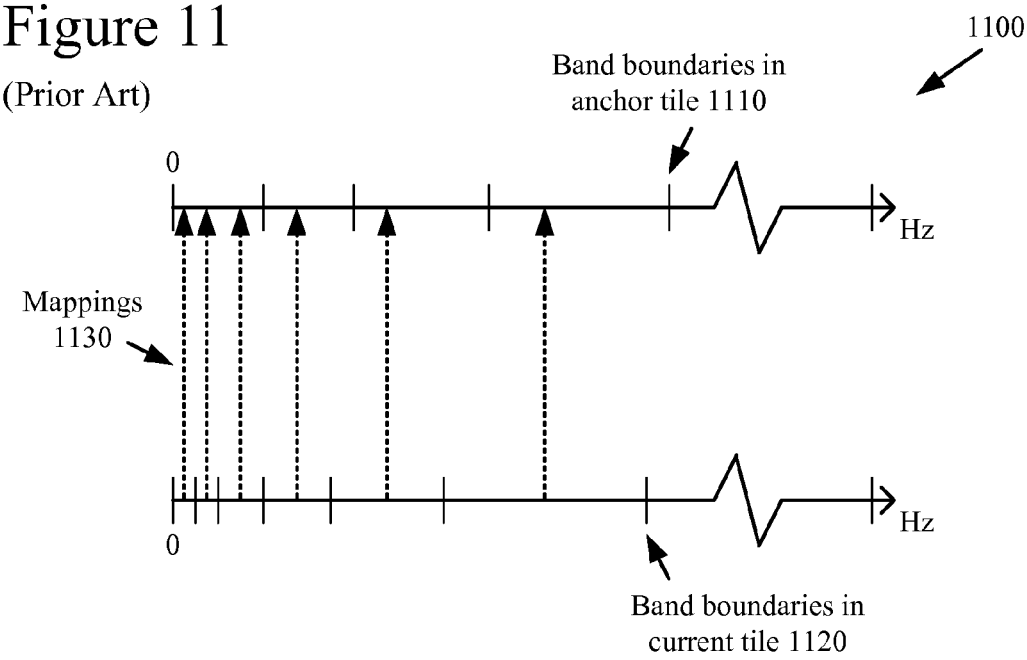
Figure 11 (Prior Art)
FIG. 11 is a diagram showing temporal prediction of scale factors for a sub-frame of a frame.

Rather than skip the encoding/decoding of scale factors for sub-frames, the encoder and decoder in WMA Pro can use temporal prediction of scale factors. For a current scale factor Q[s][c][i], the encoder computes a prediction Q'[s][c][i] based on previously available scale factor(s) Q[s'][c][i'], where s' indicates the anchor sub-frame for the temporal prediction and i' indicates a spectrally corresponding scale factor. For example, the anchor sub-frame is the first sub-frame in the frame for the same channel c. When the anchor sub-frame s' and current sub-frame s are the same size, the number of scale factors I per mask is the same, and the scale factor i from the anchor sub-frame s' is the prediction. When the anchor sub-frame s' and current sub-frame s are different sizes, the number of scale factors I per mask can be different, so the encoder finds the spectrally corresponding scale factor i' from the anchor sub-frame s' and uses the spectrally corresponding scale factor i' as the prediction. FIG. 11 shows one example mapping from quantization bands of a current sub-frame s in channel c of a current tile to quantization bands of an anchor sub-frame s' in channel c of an anchor tile. The encoder then computes the difference between the current scale factor Q[s][c][i] and the prediction Q'[s][c][i], and entropy codes the difference value.

The decoder, which has the scale factor(s) Q[s'][c][i'] of the anchor sub-frame from previous decoding, also computes the prediction Q'[s][c][i] for the current scale factor Q[s][c][i]. The decoder entropy decodes the difference value for the current scale factor Q[s][c][i] and combines the difference value with the prediction Q'[s][c][i] to reconstruct the current scale factor Q[s][c][i].

One problem with such temporal scale factor prediction is that, in some scenarios, entropy coding (e.g., run-level coding) is relatively inefficient for some common patterns in the temporal prediction residuals.

3. Reducing Resolution of Scale Factor Amplitudes.

The encoder and decoder in WMA Standard use a single quantization step size of 1.25 dB to quantize scale factors. The encoder and decoder in WMA Pro use any of multiple quantization step sizes for scale factors: 1 dB, 2 dB, 3 dB or 4 dB, and the encoder and decoder can change scale factor quantization step size on a per-channel basis in a frame.

While adjusting the uniform quantization step size for scale factors provides adaptivity in terms of bit rate and quality for the scale factors, it does not address smoothness/noisiness in the scale factor amplitudes for a given quantization step size.

4. Reducing Scale Factor Resolution Across Channels.

For stereo audio, the encoder and decoder in WMA Standard perform perceptual weighting and inverse weighting on blocks in the coded channels when a multi-channel transform is applied, not on blocks in the original channels. Thus, weighting is performed on sum and difference channels (not left and right channels) when a multi-channel transform is used.

The encoder and decoder in WMA Standard can use the same quantization matrix for a sub-frame in sum and difference channels of stereo audio. So, for such a sub-frame, the encoder and decoder can use Q[s][0][i] for both Q[s][0][i] and Q[s][1][i]. For multi-channel audio in original channels (e.g., left, right), the encoder and decoder use different sets of scale factors for different original channels. Moreover, even for jointly coded stereo channels, differences between scaling factors for the channels are not accommodated.

For multi-channel audio (e.g., stereo, 5.1), the encoder and decoder in WMA Pro perform perceptual weighting and inverse weighting on blocks in the original channels regardless of whether or not a multi-channel transform is applied. Thus, weighting is performed on blocks in the left, right, center, etc. channels, not on blocks in the coded channels. The encoder and decoder in WMA Pro do not reuse or predict scale factors between different channels. Suppose a bit stream includes information for 6 channels of audio. If a tile includes six channels, scale factors are separately coded and signaled for each of the six channels, even if the six sets of scale factors are identical. In some scenarios, a problem with this arrangement is that redundancy is not exploited between masks of different channels in a tile.

5. Reducing Remaining Redundancy in Scale Factors.

The encoder in WMA Standard can use differential coding of spectrally adjacent scale factors, followed by simple Huffman coding of the difference values. In other words, the encoder computes the difference value Q[s][c][i]−Q[s][c][i−1] and Huffman encodes the difference value for intra-mask compression.

The decoder in WMA Standard uses simple Huffman decoding of difference values and combines the difference values with predictions. In other words, for a current scale factor Q[s][c][i], the decoder Huffman decodes the difference value and combines the difference value with Q[s][c][i−1], which was previously decoded.

As for WMA Pro, when temporal scale factor prediction is used, the encoder uses run-level coding to encode the difference values Q[s][c][i]−Q'[s][c][i] from the temporal prediction. The run-level symbols are then Huffman coded. When temporal prediction is not used, the encoder uses differential coding of spectrally adjacent scale factors, followed by simple Huffman coding of the difference values, as in WMA Standard.

The decoder in WMA Pro, when temporal prediction is used, uses Huffman decoding to decode run-level symbols. To reconstruct a current scale factor Q[s][c][i], the decoder performs temporal prediction and combines the difference value for the scale factor with the temporal prediction Q'[s][c][i] for the scale factor. When temporal prediction is not used, the decoder uses simple Huffman decoding of difference values and combines the difference values with spectral predictions, as in WMA Standard.

Thus, in WMA Standard, the encoder and decoder perform spectral scale factor prediction. In WMA Pro, for anchor sub-frames, the encoder and decoder perform spectral scale factor prediction. For non-anchor sub-frames, the encoder and decoder perform temporal scale factor prediction. One problem with these approaches is that the type of scale factor prediction used for a given mask is inflexible. Another problem with these approaches is that, in some scenarios, entropy coding is relatively inefficient for some common patterns in the prediction residuals.

In summary, several problems have been described which can be addressed by improved techniques and tools for representing, coding, and decoding scale factors. Such improved techniques and tools need not be applied so as to address any or all of these problems, however.

B. Flexible Spectral Resolution for Scale Factors.

In some embodiments, an encoder and decoder select between multiple available spectral resolutions for scale factors. For example, the encoder selects between high spectral resolution, medium spectral resolution, or low spectral resolution for the scale factors to trade off bit rate of the scale factor representation versus degree of control in weighting. The encoder signals the selected scale factor spectral resolution to the decoder, and the decoder uses the signaled information to select scale factor spectral resolution during decoding.

1. Available Spectral Resolutions.

The encoder and decoder select a spectral resolution from a set of multiple available spectral resolutions for scale factors. The spectral resolutions in the set depend on implementation.

Figure 12:
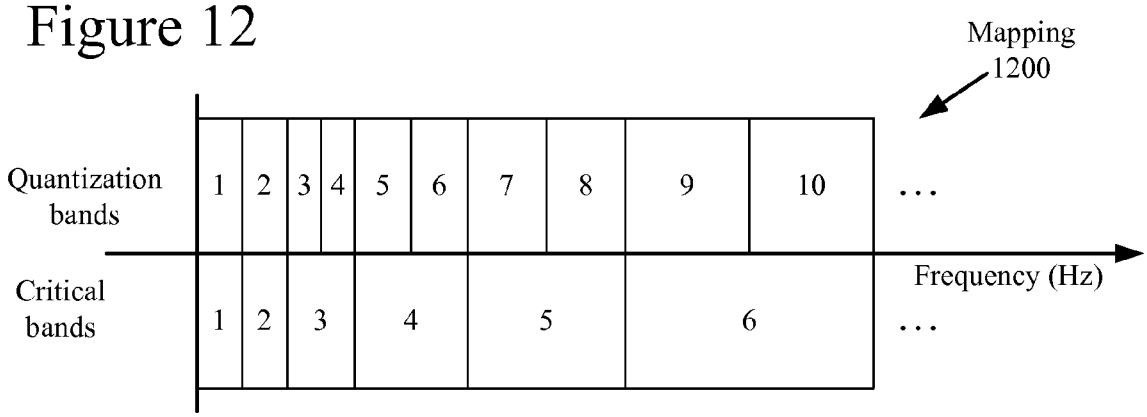
FIGS. 12 and 13 are diagrams showing example relations of quantization bands to critical bands at different spectral resolutions.
Figure 13:
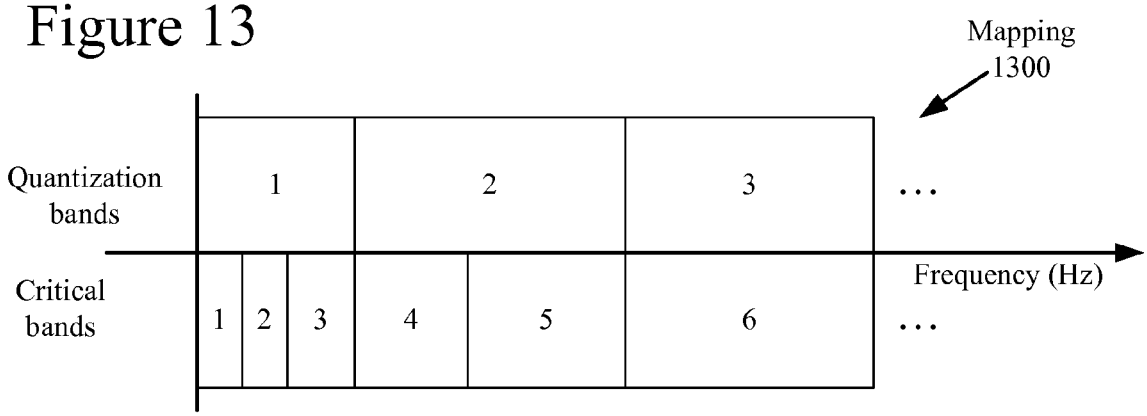

One common spectral resolution is critical band resolution, according to which quantization bands align with critical bands, and one scale factor is associated with each of the critical bands. FIGS. 12 and 13 show relations between scale factors and critical bands at two other spectral resolutions.

FIG. 12 illustrates a sub-critical band spectral resolution according to which a single critical band can map to multiple quantization bands/scale factors. In FIG. 12 several of the wider critical bands at higher frequencies each map to two quantization bands. For example, critical band 5 maps to quantization bands 7 and 8. So, each of the wider critical bands has two scale factors associated with it. In FIG. 12, the two narrowest critical bands are not split into sub-critical bands for scale factor purposes.

Compared to Bark spectral resolution, sub-Bark spectral resolutions allow finer control in spreading distortion across different frequencies. The added spectral resolution typically leads to higher bit rate for scale factor information. As such, sub-Bark spectral resolution is typically more appropriate for higher bit rate, higher quality encoding.

FIG. 13 illustrates a super-critical band spectral resolution according to which a single quantization band can have multiple critical bands mapped to it. In FIG. 13 several of the narrower critical bands at lower frequencies collectively map to a single quantization band. For example, critical bands 1, 2, and 3 merge to quantization band 1. In FIG. 13, the widest critical band is not merged with any other critical band. Compared to Bark spectral resolution, super-Bark spectral resolutions have lower scale factor overhead but coarser control in distortion spreading.

In FIGS. 12 and 13, the quantization band boundaries align with critical band boundaries. In other spectral resolutions, one or more quantization boundaries do not align with critical band boundaries.

In one implementation, the set of available spectral resolutions includes six available band layouts at different spectral resolutions. The encoder and decoder each have information indicating the layout of critical bands for different block sizes at Bark resolution, where the Bark boundaries are fixed and predetermined for different block sizes.

In this six-option implementation, one of the available band layouts simply has Bark resolution. For this spectral resolution, the encoder and decoder use a single scale factor per Bark. The other five available band layouts have different sub-Bark resolutions. There is no super-Bark resolution option in the implementation.

For the first sub-Bark resolution, any critical band wider than 1.6 kilohertz ("KHz") is split into enough uniformly sized sub-Barks that the sub-Barks are less than 1.6 KHz wide. For example, a 10 KHz-wide Bark is split into seven 1.43 KHz-wide sub-Barks, and a 1.8 KHz-wide Bark is split into two 0.9 KHz-wide sub-Barks. A 1.5 KHz-wide Bark is not split.

For the second sub-Bark resolution, any critical band wider than 800 hertz ("Hz") is split into enough uniformly sized sub-Barks that the sub-Barks are less than 800 Hz wide. For the third sub-Bark resolution, the width threshold is 400 Hz, and for the fourth sub-Bark resolution, the width threshold is 200 Hz. For the final sub-Bark resolution, the width threshold is 100 Hz. So, for the final sub-Bark resolution, a 110 Hz-wide Bark is split into two 55 Hz-wide sub-Barks, and a 210 Hz-wide Bark is split into three 70 Hz-wide sub-Barks.

In this implementation, the varying degrees of spectral resolution are simple to signal. Using reconstruction rules, the information about Bark boundaries for different block sizes, and an identification of one of the six layouts, an encoder and decoder determine which scale factors are used for any allowed block size.

Alternatively, an encoder and decoder use other and/or additional band layouts or spectral resolutions.

2. Selecting Scale Factor Spectral Resolution During Encoding.

Figure 14:
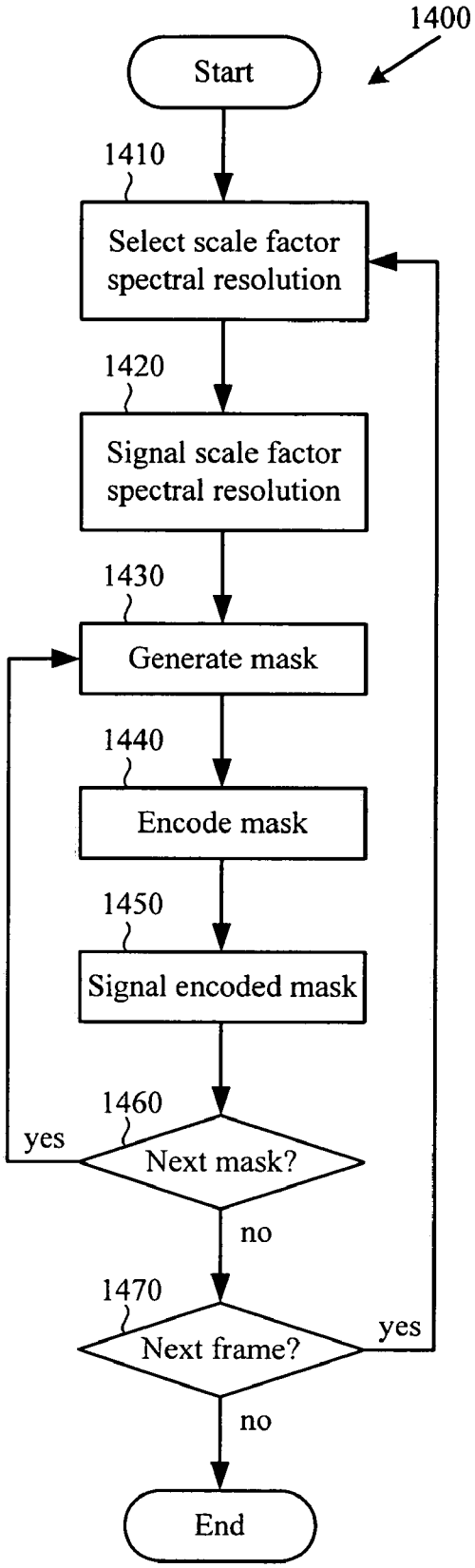
FIGS. 14 and 15 are flowcharts showing techniques for selection of spectral resolution of scale factors during encoding and decoding, respectively.

FIG. 14 shows a technique (1400) for selecting scale factor spectral resolution during encoding. An encoder such as the encoder shown in FIG. 2, 4, or 7 performs the technique (1400). Alternatively, another tool performs the technique (1400).

To start, the encoder selects (1410) a spectral resolution for scale factors. For example, in FIG. 14, for a frame of multichannel audio that includes multiple sub-frames having different sizes, the encoder selects a spectral resolution. More generally, the encoder selects the scale factor spectral resolution from multiple spectral resolutions available according to the syntax and/or rules for the encoder and decoder for a given portion of content.

The encoder can consider various criteria when selecting (1410) the spectral resolution for scale factors. For example, the encoder considers target bit rate, target quality, and/or user input or settings. The encoder can evaluate different spectral resolutions using a closed loop or open loop mechanism before selecting the scale factor spectral resolution.

The encoder then signals (1420) the selected scale factor spectral resolution. For example, the encoder signals a variable length code ("VLC") or fixed length code ("FLC") indicating a band layout at a particular spectral resolution. Alternatively, the encoder signals other information indicating the selected spectral resolution.

The encoder generates (1430) a mask having scale factors at the selected spectral resolution. For example, the encoder uses a technique described in section II to generate the mask.

The encoder then encodes (1440) the mask. For example, the encoder performs one or more of the encoding techniques described below on the mask. Alternatively, the encoder uses other encoding techniques to encode the mask. The encoder then signals (1450) the entropy coded information for the mask.

The encoder determines (1460) whether there is another mask to be encoded at the selected spectral resolution and, if so, generates (1430) that mask. Otherwise, the encoder determines (1470) whether there is another frame for which scale factor spectral resolution should be selected.

In FIG. 14, spectral resolution for scale factors is selected on a frame-by-frame basis. Thus, the sub-frames in different channels of a particular frame have scale factors with the spectral resolution set at the frame level. Alternatively, the spectral resolution for scale factors is selected on a tile-by-tile basis, sub-frame-by-sub-frame basis, sequence-by-sequence basis, or other basis.

3. Selecting Scale Factor Spectral Resolution During Decoding.

Figure 15:
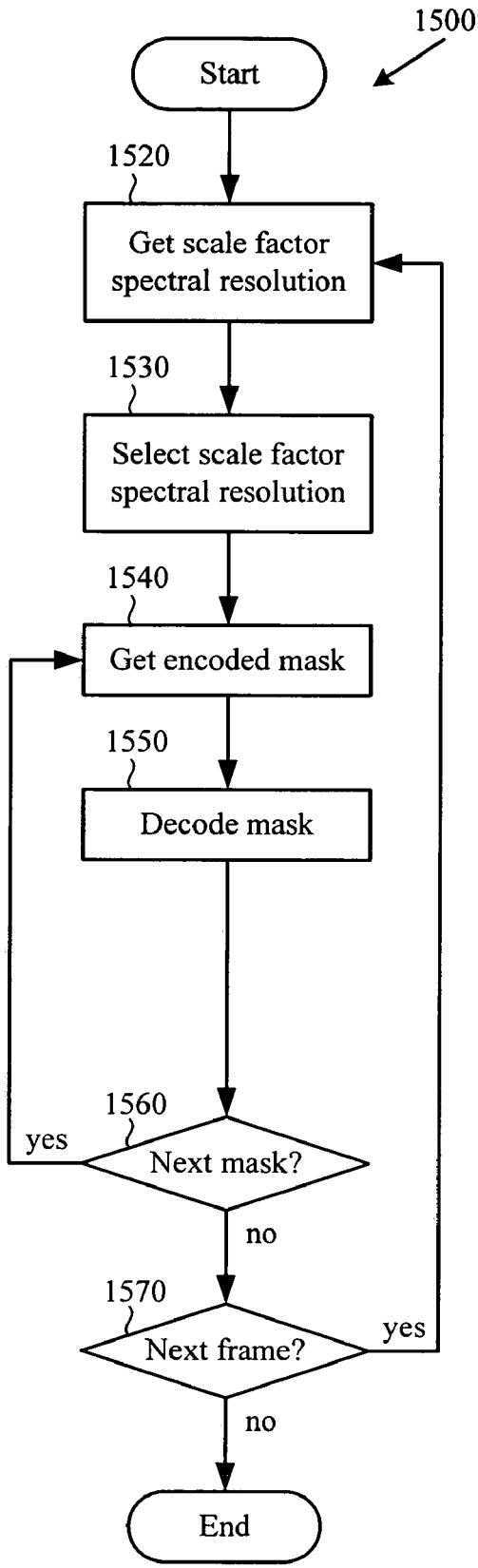

FIG. 15 shows a technique (1500) for selecting scale factor spectral resolution during decoding. A decoder such as the decoder shown in FIG. 3, 5, or 8 performs the technique (1500). Alternatively, another tool performs the technique (1500).

To start, the decoder gets (1520) information indicating a spectral resolution for scale factors. For example, the decoder parses and decodes a VLC or FLC indicating a band layout at a particular spectral resolution. Alternatively, the decoder parses from a bitstream and/or decodes other information indicating the scale factor spectral resolution. The decoder later selects (1530) a scale factor spectral resolution based upon that information.

The decoder gets (1540) an encoded mask. For example, the decoder parses entropy coded information for the mask from the bitstream. The decoder then decodes (1550) the mask. For example, the decoder performs one or more of the decoding techniques described below on the mask. Alternatively, the decoder uses other decoding techniques to decode the mask.

The encoder determines (1560) whether there is another mask with the selected scale factor spectral resolution to be decoded and, if so, gets (1530) that mask. Otherwise, the decoder determines (1570) whether there is another frame for which scale factor spectral resolution should be selected.

In FIG. 15, spectral resolution for scale factors is selected on a frame-by-frame basis. Thus, the sub-frames in different channels of a particular frame have scale factors with the spectral resolution set at the frame level. Alternatively, the spectral resolution for scale factors is selected on a tile-by-tile basis, sub-frame-by-sub-frame basis, sequence-by-sequence basis, or other basis.

C. Cross-channel Prediction for Scale Factors.

In some embodiments, an encoder and decoder perform cross-channel prediction of scale factors. For example, to predict the scale factors for a sub-frame in one channel, the encoder and decoder use the scale factors of another sub-frame in another channel. When an audio signal is comparable across multiple channels of audio, the scale factors for masks in those channels are often comparable as well. Cross-channel prediction typically improves coding performance for such scale factors.

The cross-channel prediction is spatial prediction when the prediction is between original channels for spatially separated playback positions, such as a left front position, right front position, center front position, back left position, back right position, and sub-woofer position.

1. Examples of Cross-channel Prediction of Scale Factors.

In terms of the scale factor notation introduced above, the scale factors Q[s][c][i] for channel c can use Q[s][c']][i] as predictors. The channel c' is the channel from which scale factors are obtained for the cross-channel prediction. An encoder computes the difference value Q[s][c][i]−Q[s][c']][i] and entropy codes the difference value. A decoder entropy decodes the difference value, computes the prediction Q[s][c']][i] and combines the difference value with the prediction Q[s][c']][i]. The channel c' can be called the anchor channel.

During encoding, cross-channel prediction can result in non-zero difference values. Thus, small variations in scale factors from channel to channel are accommodated. The encoder and decoder do not force all channels to have identical scale factors. At the same time, the cross-channel prediction typically reduces bit rate for different scale factors for different channels.

For channels 0 to C-1, when scale factors are decoded in channel order from 0 to C-1, then 0<=c'<c. Channel 0 qualifies as an anchor channel for other channels since scale factors for channel 0 are decoded first. Whatever technique the encoder/decoder uses to code/decode scale factors Q[s][0][i], those previous scale factors are available for cross-channel prediction of scale factors Q[s][c][i] for other channels for the same s and i. More generally, cross-channel scale factor prediction uses scale factors of a previously encoded/decoded mask, such that the scale factors are available for cross-channel prediction at both the encoder and decoder.

In implementations that use tiles, the numbering of channels starts from 0 for each tile and C is the number of channels in the tile. The scale factors Q[s][c][i] for a sub-frame s in channel c can use Q[s][c']][i] as a prediction, where c' indicates the anchor channel. For a tile, decoding of scale factors proceeds in channel order, so the scale factors of channel 0 (while not themselves cross-channel predicted) can be used for cross-channel predictions.

Figure 16:
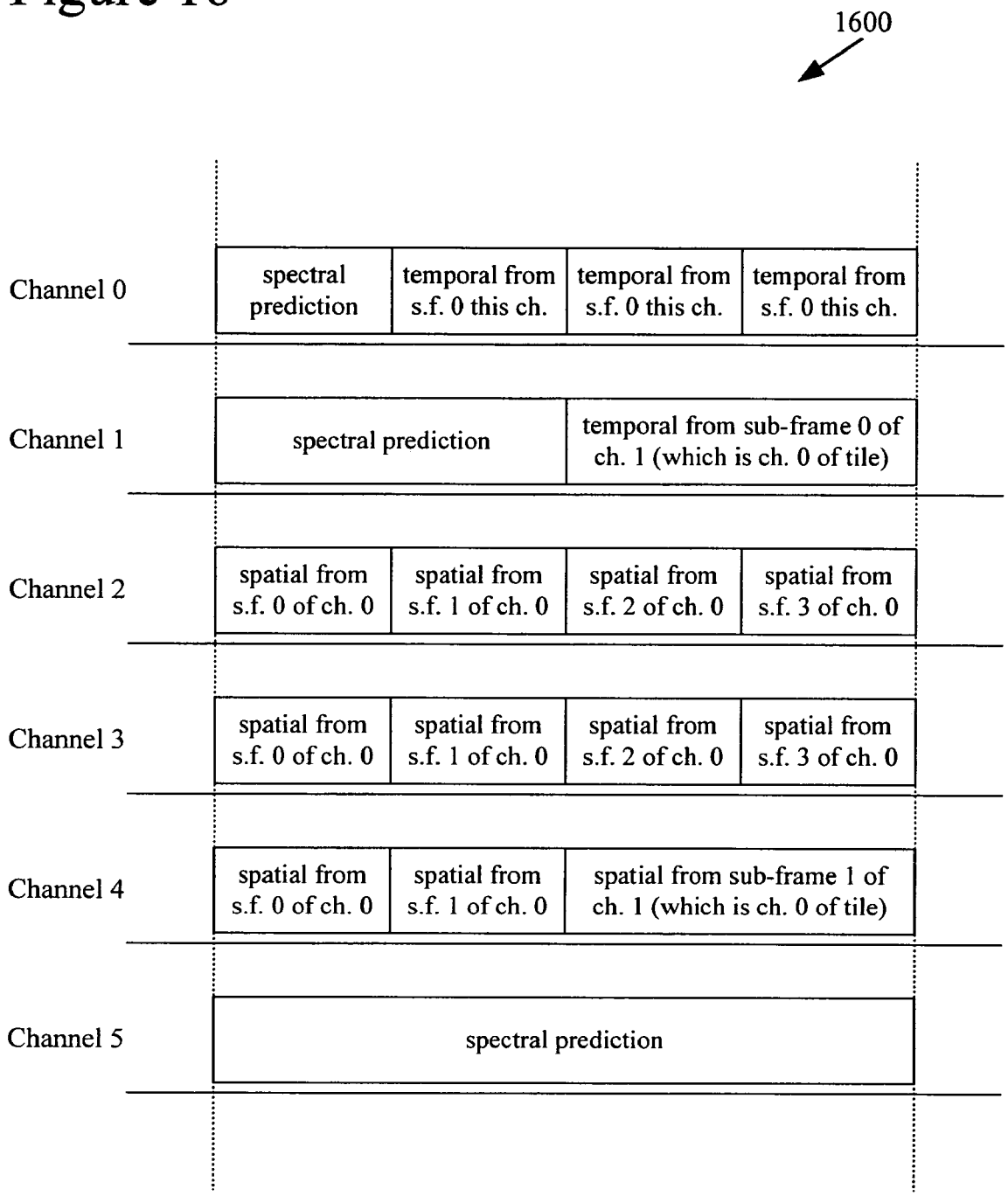
FIG. 16 is a diagram showing spatial prediction relations among sub-frames of a frame of multi-channel audio.

FIG. 16 shows prediction relations for scale factors for a tile (1600) having the tile configuration (600) of FIG. 6. The example in FIG. 16 shows some of the prediction relations possible for a tile when spatial scale factor prediction is used.

Channel 0 includes four sub-frames, the first of which (sub-frame 0) has scale factors encoded/decoded using spectral scale factor prediction. The next three sub-frames of channel 0 have scale factors encoded/decoded using temporal scale factor prediction relative to the first sub-frame in the channel. In channels 2 and 3, each of the sub-frames has scale factors encoded/decoded using spatial scale factor prediction relative to corresponding sub-frames (same positions) in channel 0. In channel 4, each of the first two sub-frames has scale factors encoded/decoded using spatial scale factor prediction relative to corresponding sub-frames (same positions) in channel 0, but the third sub-frame of channel 4 has a different anchor channel. The third sub-frame has scale factors encoded/decoded using spatial scale factor prediction relative to the corresponding sub-frame in channel 1 (which is channel 0 of the tile).

When weighting precedes a multi-channel transform during encoding (and inverse weighting follows an inverse multi-channel transform during decoding), the scale factors are for original channels of multi-channel audio (not multi-channel coded channels). Having different scale factors for different original channels facilitates distortion shaping, especially for those cases where the original channels have very different signals and scale factors. For many other cases, original channels have similar signals and scale factors, and spatial scale factor prediction reduces the bit rate associated with scale factors. As such, spatial prediction across original channels helps reduce the usual bit rate costs of having different scale factors for different channels.

Alternatively, an encoder and decoder perform cross-channel prediction on coded channels of multi-channel audio, following a multi-channel transform during encoding and prior to an inverse multi-channel transform during decoding.

When the identity of the anchor channel is fixed at the encoder and decoder (e.g., always channel 0 in a tile), the anchor is not signaled. Alternatively, the encoder and decoder select the anchor channel from multiple candidate channels (e.g., previously encoded/decoded channels available for cross-channel scale factor prediction), and the encoder signals information indicating the anchor channel selection.

While the preceding examples of cross-channel scale factor prediction use a single scale factor from an anchor as a prediction, alternatively, the cross-channel scale factor prediction is a combination of multiple scale factors. For example, the cross-channel prediction uses the average of scale factors at the same position in multiple previous channels. Or, the cross-channel scale factor prediction is computed using some other logic.

In FIG. 16, cross-channel scale factor prediction occurs between sub-frames having the same size. Alternatively, tiles are not used, the sub-frame of an anchor channel has a different size than the current sub-frame, and the encoder and decoder resample the anchor channel sub-frame to get the scale factors for cross-channel scale factor prediction.

2. Spatial Prediction of Scale Factors During Encoding.

Figure 17:
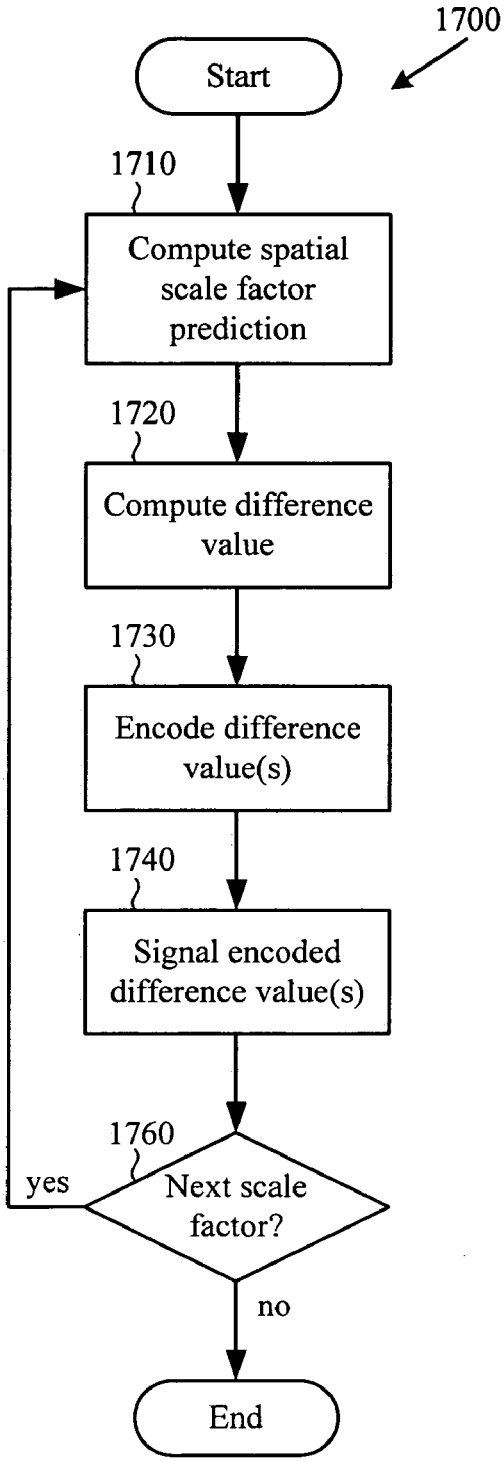
FIGS. 17 and 18 are flowcharts showing techniques for spatial prediction of scale factors during encoding and decoding, respectively.

FIG. 17 shows a technique (1700) for performing spatial prediction of scale factors during encoding. An encoder such as the encoder shown in FIG. 2, 4, or 7 performs the technique (1700). Alternatively, another tool performs the technique (1700).

To start, the encoder computes (1710) a spatial scale factor prediction for a current scale factor. For example, the current scale factor is in a current sub-frame of a current original channel, and the spatial prediction is a scale factor in an anchor channel sub-frame of an anchor original channel. Alternatively, the encoder computes the spatial prediction in some other way (e.g., as a combination of anchor scale factors).

In FIG. 17, the identity of the anchor channel is pre-determined for the current sub-frame, and the encoder performs no signaling of the identity of the anchor channel. Alternatively, the anchor is selected from multiple available anchors, and the encoder signals information identifying the anchor.

The encoder computes (1720) the difference value between the current scale factor and the spatial scale factor prediction. The encoder encodes (1730) the difference value and signals (1740) the encoded difference value. For example, the encoder performs simple Huffman coding and signals the results in a bit stream. In many implementations, the encoder batches the encoding (1730) and signaling (1740) such that multiple difference values are encoded using run-level coding or some other entropy coding on a group of difference values.

The encoder determines (1760) whether to continue with the next scale factor and, if so, computes (1710) the spatial scale factor prediction for the next scale factor. For example, when the encoder performs spatial scale factor prediction per mask, the encoder iterates across the scale factors of the current mask. Or, the encoder iterates across some other set of scale factors.

3. Spatial Prediction of Scale Factors During Decoding.

Figure 18:
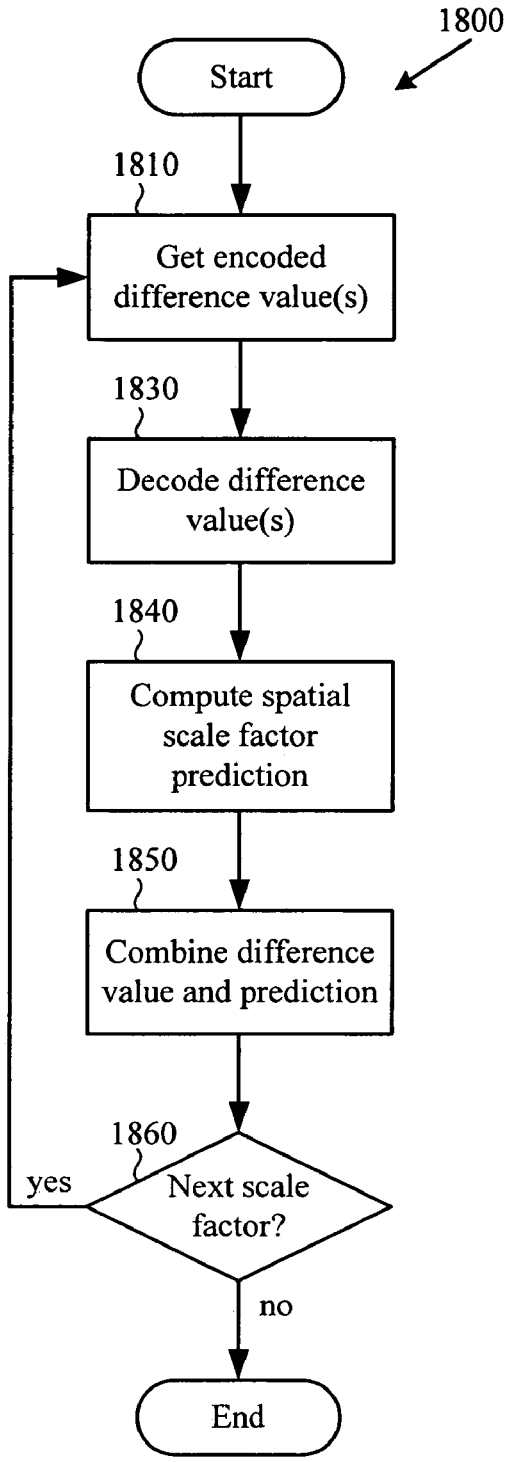

FIG. 18 shows a technique (1800) for performing spatial prediction of scale factors during decoding. A decoder such as the decoder shown in FIG. 3, 5, or 8 performs the technique (1800). Alternatively, another tool performs the technique (1800).

The decoder gets (1810) and decodes (1830) the difference value between a current scale factor and its spatial scale factor prediction. For example, the encoder parses the encoded difference value from a bit stream and performs simple Huffman decoding on the encoded difference value. In many implementations, the decoder batches the getting (1810) and decoding (1830) such that multiple difference values are decoded using run-level decoding or some other entropy decoding on a group of difference values.

The decoder computes (1840) a spatial scale factor prediction for the current scale factor. For example, the current scale factor is in a current sub-frame of a current original channel, and the spatial prediction is a scale factor in an anchor channel sub-frame of an anchor original channel. Alternatively, the decoder computes the spatial scale factor prediction in some other way (e.g., as a combination of anchor scale factors). The decoder then combines (1850) the difference value with the spatial scale factor prediction for the current scale factor.

In FIG. 18, the identity of the anchor channel is pre-determined for the current sub-frame, and the decoder gets no information indicating the identity of the anchor channel. Alternatively, the anchor is selected from multiple available anchors, and the decoder gets information identifying the anchor.

The decoder determines (1860) whether to continue with the next scale factor and, if so, gets (1810) the next encoded difference value (or computes (1840) the next spatial scale factor prediction when the difference value has been decoded). For example, when the decoder performs spatial scale factor prediction per mask, the decoder iterates across the scale factors of the current mask. Or, the decoder iterates across some other set of scale factors.

D. Flexible Scale Factor Prediction.

In some embodiments, an encoder and decoder perform flexible prediction of scale factors in which the encoder and decoder select between multiple available scale factor prediction modes. For example, the encoder selects between spectral prediction, spatial (or other cross-channel) prediction, and temporal prediction for a mask, signals the selected mode, and performs scale factor prediction according to the selected mode. In this way, the encoder can pick the scale factor prediction mode suited for the scale factors and context.

1. Architectures for Flexible Prediction of Scale Factors.

Figure 19:
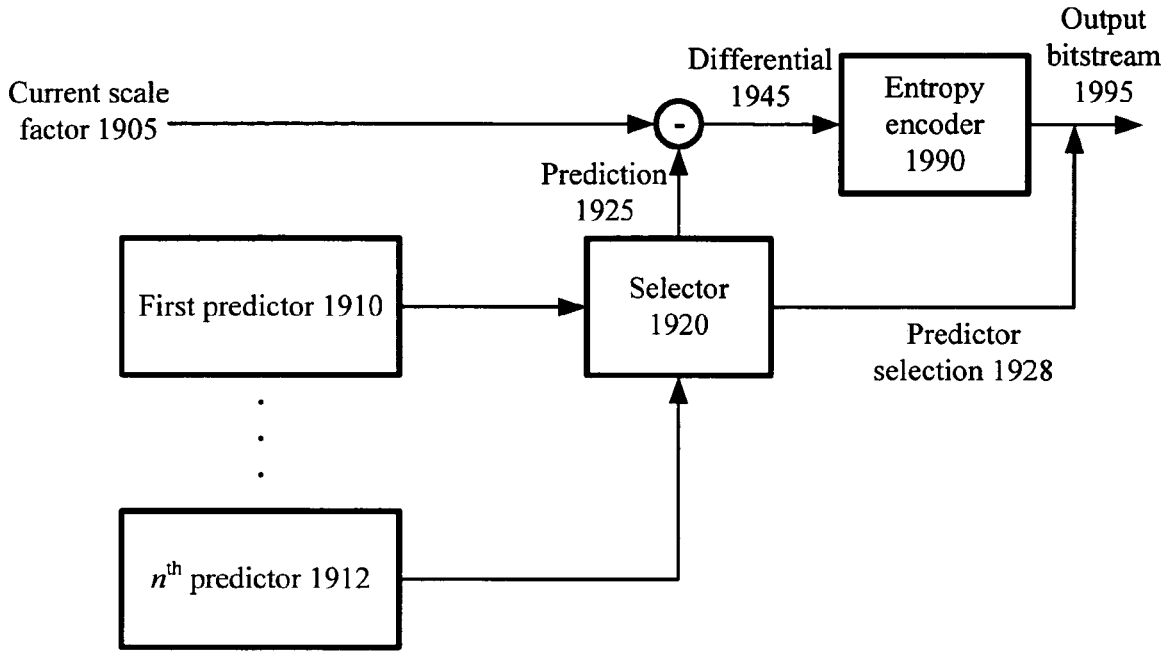
FIGS. 19 and 20 are diagrams showing architectures for flexible prediction of scale factors during encoding.
Figure 20:
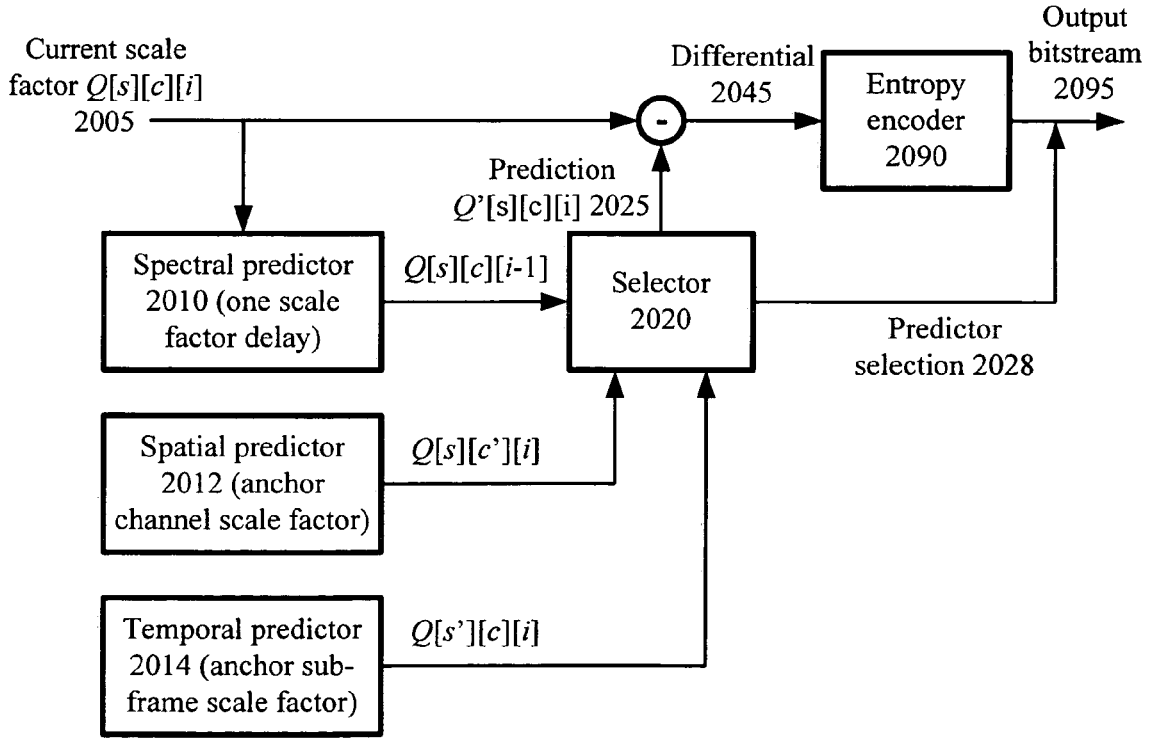
Figure 21:
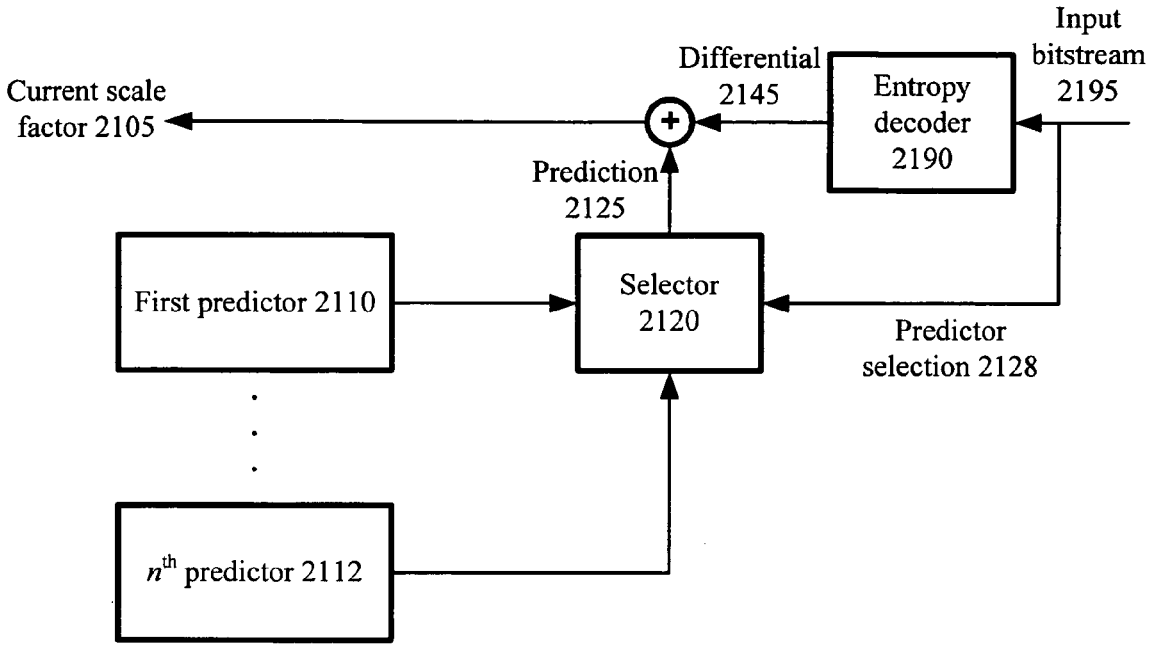
FIGS. 21, and 22 are block diagrams showing architectures for flexible prediction of scale factors during decoding.
Figure 22:
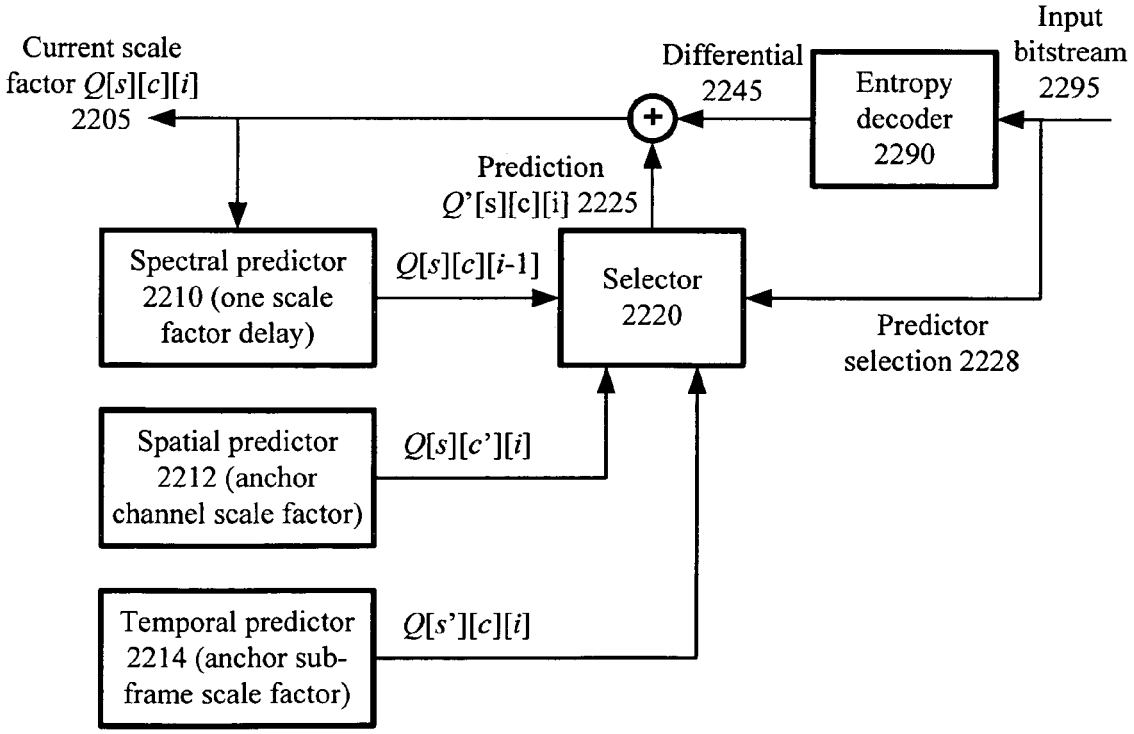

FIGS. 19 and 21 show generalized architectures for flexible prediction of scale factors in encoding and decoding, respectively. An encoder such as one shown in FIG. 2, 4, or 7 can include the modules shown in FIG. 19, and a decoder such as one shown in FIG. 3, 5, or 8 can include the modules shown in FIG. 21. FIGS. 20 and 22 show specific examples of such architectures in encoding and decoding, respectively.

With reference to FIG. 19, the encoder computes a difference value (1945) for a current scale factor (1905) as the difference between the current scale factor (1905) and a scale factor prediction (1925).

With the selector (1920), the encoder selects between the multiple available scale factor prediction modes. In general, the encoder selects between the prediction modes depending on scale factor characteristics or evaluation of the different modes. The encoder computes the prediction (1925) using any of several different prediction modes (shown as first predictor (1910) through $n^{th}$ predictor (1912) in FIG. 19). For example, the prediction modes include spectral prediction, temporal prediction, and spatial (or other cross-channel) prediction modes. Alternatively, the prediction modes include other and/or addition prediction modes, and the prediction modes can include more or fewer modes. The selector (1920) outputs the prediction (1925) according to the selected scale factor prediction mode, for the differencing operation.

The selector (1920) also signals scale factor predictor mode selection information (1928) to the output bitstream (1995). Typically, each vector of coded scale factors is preceded by an indication of which scale factor prediction mode was used for the coded scale factors, which enables a decoder to select the same prediction mode during decoding. For example, predictor selection information is signaled as a VLC or FLC. Alternatively, the predictor selection information is signaled using some other mechanism, for example, adjusting the VLCs or FLCs when certain scale factor prediction modes are disabled for a particular position of mask, and/or using a series of codes. The signaling syntax in one implementation is described with reference to FIGS. 39*a* and 39*b*.

The entropy encoder (1990) entropy encodes the difference value (potentially as a batch with other difference values) and signals the encoded information in an output bitstream (1995). For example, the entropy encoder (1990) performs simple Huffman coding, run-level coding, or some other encoding of difference values. In some implementations, the entropy encoder (1990) switches between entropy coding modes (e.g., simple Huffman coding, vector Huffman coding, run-level coding) depending on the scale factor prediction mode used, the scale factor position in the mask, and/or which mode provides better results (in which case, the encoder performs corresponding signaling of entropy coding mode selection information).

Typically, the encoder selects a scale factor prediction mode for the prediction (1925) on a mask-by-mask basis, and signals prediction mode information (1928) per mask. Alternatively, the encoder performs the selection and signaling on some other basis.

While FIG. 19 shows simple selection of one predictor or another from the multiple available scale factor predictors, alternatively, the selector (1920) incorporates more complex logic, for example, to combine multiple scale factor predictions for use as the prediction (1925). Or, the encoder performs multiple stages of scale factor prediction for a current scale factor (1905), for example, performing spatial or temporal prediction, then performing spectral prediction on the results of the spatial or temporal prediction.

With reference to FIG. 20, the encoder computes a difference value (2045) for a current scale factor Q[s][c][i] (2005) as the difference between the current scale factor Q[s][c][i] (2005) and a scale factor prediction Q'[s][c][i] (2025). The encoder selects a scale factor prediction mode for the prediction (2025) on a mask-by-mask basis.

With the selector (2020), the encoder selects between spectral prediction mode (2010) (for which the encoder buffers the previously encoded scale factor), spatial prediction mode (2012), and temporal prediction mode (2014). The encoder selects between the prediction modes (2010, 2012, 2014) depending on scale factor characteristics or evaluation of the different scale factor prediction modes for the current mask. The selector (2020) outputs the selected prediction Q'[s][c][i] (2025) for the differencing operation.

The spectral prediction (2010) is performed, for example, as described in section III.A. Typically, spectral prediction (2010) works well if scale factors for a mask are smooth. Spectral prediction (2010) is also useful for coding the first sub-frame of the first channel to be encoded/decoded for a given frame, since that sub-frame lacks a temporal anchor and spatial anchor. Spectral prediction (2010) is also useful for sub-frames that include signal transients, when temporal prediction (2012) fails to perform well due to changes in the signal since the temporal anchor sub-frame.

The spatial prediction (2012) is performed, for example, as described in section III.C. Spatial prediction (2012) often works well when channels in a tile convey similar signals. This is the case for many natural signals.

The temporal prediction (2014) is performed, for example, as described in section III.A. Temporal prediction (2014) often works well when the signal in a channel is relatively stationary from sub-frame to sub-frame of a frame. Again, this is the case for sub-frames in many natural signals.

The selector (2020) also signals scale factor predictor mode selection information (2028) for a mask to the output bitstream (2095). The encoder adjusts the signaling when certain prediction modes are disabled for a particular position of mask. For example, for a mask for a sub-frame in a first (or only) channel to be decoded (e.g., anchor channel 0), spatial scale factor prediction is not an option. For the first sub-frame of a particular channel (e.g., anchor sub-frame for that channel), temporal scale factor prediction is not an option.

The entropy encoder (2090) entropy encodes the difference value (potentially as a batch with other difference values) and signals the encoded information in an output bitstream (2095). For example, the entropy encoder (2090) performs simple Huffman coding, run-level coding, or some other encoding of difference values.

With reference to FIG. 21, the decoder combines a difference value (2145) for a current scale factor (2105) with a scale factor prediction (2125) for the current scale factor (2105) to reconstruct the current scale factor (2105).

The entropy decoder (2190) entropy decodes the difference value (potentially as a batch with other difference values) from encoded information parsed from an input bitstream (2195). For example, the entropy decoder (2190) performs simple Huffman decoding, run-level decoding, or some other decoding of difference values. In some implementations, the entropy decoder (2190) switches between entropy decoding modes (e.g., simple Huffman decoding, vector Huffman decoding, run-level decoding) depending on the scale factor prediction mode used, the scale factor position in the mask, and/or entropy decoding mode selection information signaled from the encoder.

The selector (2120) parses predictor mode selection information (2128) from the input bitstream (2195). Typically, each vector of coded scale factors is preceded by an indication of which scale factor prediction mode was used for the coded scale factors, which enables the decoder to select the same scale factor prediction mode during decoding. For example, predictor selection information (2128) is signaled as a VLC or FLC. Alternatively, the predictor selection information is signaled using some other mechanism. Decoding prediction mode selection information in one implementation is described with reference to FIGS. 39*a* and 39*b*.

With the selector (2120), the decoder selects between the multiple available scale factor prediction modes. In general, the decoder selects between the prediction modes based upon the information signaled by the encoder. The decoder computes the prediction (2125) using any of several different prediction modes (shown as first predictor (2110) through $n^{th}$ predictor (2112) in FIG. 21). For example, the prediction modes include spectral prediction, temporal prediction, and spatial (or other cross-channel) prediction modes, and the prediction modes can include more or fewer prediction modes. Alternatively, the prediction modes include other and/or addition prediction modes. The selector (2120) outputs the prediction (2125) according to the selected scale factor prediction mode, for the combination operation.

Typically, the decoder selects a scale factor prediction mode for the prediction (2125) on a mask-by-mask basis, and parses prediction mode information (2128) per mask. Alternatively, the decoder performs the selection and parsing on some other basis.

While FIG. 21 shows simple selection of one predictor or another from the multiple available scale factor predictors, alternatively, the selector (2120) incorporates more complex logic, for example, to combine multiple scale factor predictions for use as the prediction (2125). Or, the decoder performs multiple stages of scale factor prediction for a current scale factor (2105), for example, performing spectral prediction then performing spatial or temporal prediction on the reconstructed residuals resulting from the spectral prediction.

With reference to FIG. 22, the decoder combines a difference value (2245) for a current scale factor Q[s][c][i] (2205) with a scale factor prediction Q'[s][c][i] (2225) for the current scale factor Q[s][c][i] (2205) to reconstruct the current scale factor Q[s][c][i] (2205). The decoder selects a scale factor prediction mode for the prediction Q'[s][c][i] (2225) on a mask-by-mask basis.

The entropy decoder (2290) entropy decodes the difference value (potentially as a batch with other difference values) from encoded information parsed from an input bitstream (2295). For example, the entropy decoder (2290) performs simple Huffman decoding, run-level decoding, or some other decoding of difference values.

The selector (2220) parses scale factor predictor mode selection information (2228) for a mask from the input bitstream (2295). The parsing logic changes when certain scale factor prediction modes are disabled for a particular position of mask. For example, for a mask for a sub-frame in a first (or only) channel to be decoded (e.g., anchor channel 0), spatial scale factor prediction is not an option. For the first sub-frame of a particular channel (e.g., anchor sub-frame for that channel), temporal scale factor prediction is not an option.

With the selector (2220), the decoder selects between spectral prediction mode (2210) (for which the decoder buffers the previously decoded scale factor), spatial prediction mode (2212), and temporal prediction mode (2214). The spectral prediction (2210) is performed, for example, as described in section III.A. The spatial prediction (2212) is performed, for example, as described in section III.C. The temporal prediction (2214) is performed, for example, as described in section III.A. In general, the decoder selects between the scale factor prediction modes based upon the information parsed from the bitstream and selection rules. The selector (2220) outputs the prediction (2225) according to the selected scale factor prediction mode, for the combination operation.

2. Examples of Flexible Prediction of Scale Factors.

In terms of the scale factor notation introduced above, the scale factors Q[s][c][i] for scale factor i of sub-frame s in channel c generally can use Q[s][c][i−1] as a spectral scale factor predictor, Q[s][c']][i] as a spatial scale factor predictor, or Q[s']][c][i] as a temporal scale factor predictor.

Figure 23:
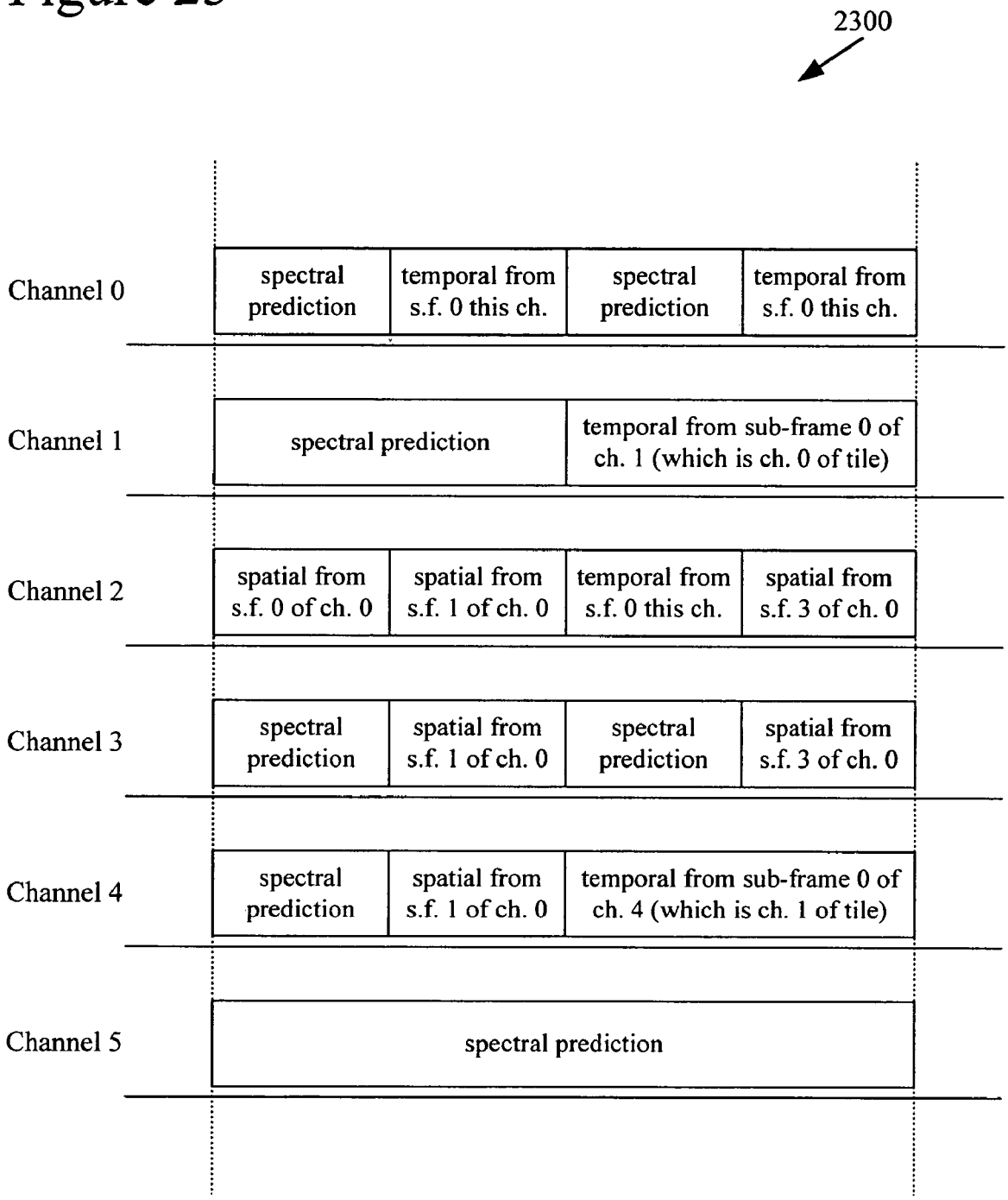
FIG. 23 is a diagram showing flexible scale factor prediction relations among sub-frames of a frame of multi-channel audio.

FIG. 23 shows flexible scale factor prediction relations for a tile (2300) having the tile configuration (600) of FIG. 6. The example in FIG. 23 shows some of the scale factor prediction relation possible for a tile when scale factor prediction is flexible.

Channel 0 includes four sub-frames, the first and third of which (sub-frames 0 and 2) have scale factors encoded/decoded using spectral scale factor prediction. Each of the second and fourth sub-frames of channel 0 has scale factors encoded/decoded using temporal scale factor prediction relative to the first sub-frame in the channel.

Channel 1 includes 2 sub-frames, the first of which (sub-frame 0) has scale factors encoded/decoded using spectral prediction. The second sub-frame of channel 1 has scale factors encoded/decoded using temporal prediction relative to the first sub-frame in the channel.

In channel 2, each of the first, second, and fourth sub-frames has scale factors encoded/decoded using spatial prediction relative to corresponding sub-frames (same positions) in channel 0. The third sub-frame of channel 2 has scale factors encoded/decoded using temporal prediction relative to the first sub-frame in the channel.

In channel 3, each of the second and fourth sub-frames has scale factors encoded/decoded using spatial prediction relative to corresponding sub-frames (same positions) in channel 0. Each of the first and third sub-frames of channel 3 has scale factors encoded/decoded using spectral prediction.

In channel 4, the first sub-frame has scale factors encoded/decoded using spectral prediction, and the second sub-frame has scale factors encoded/decoded using spatial prediction relative to the corresponding sub-frame in channel 0. The third sub-frame of channel 4 has scale factors encoded/decoded using temporal prediction relative to the first sub-frame in the channel.

In channel 5, the only sub-frame has scale factors encoded/decoded using spectral prediction.

3. Flexible Prediction of Scale Factors During Encoding.

Figure 24:
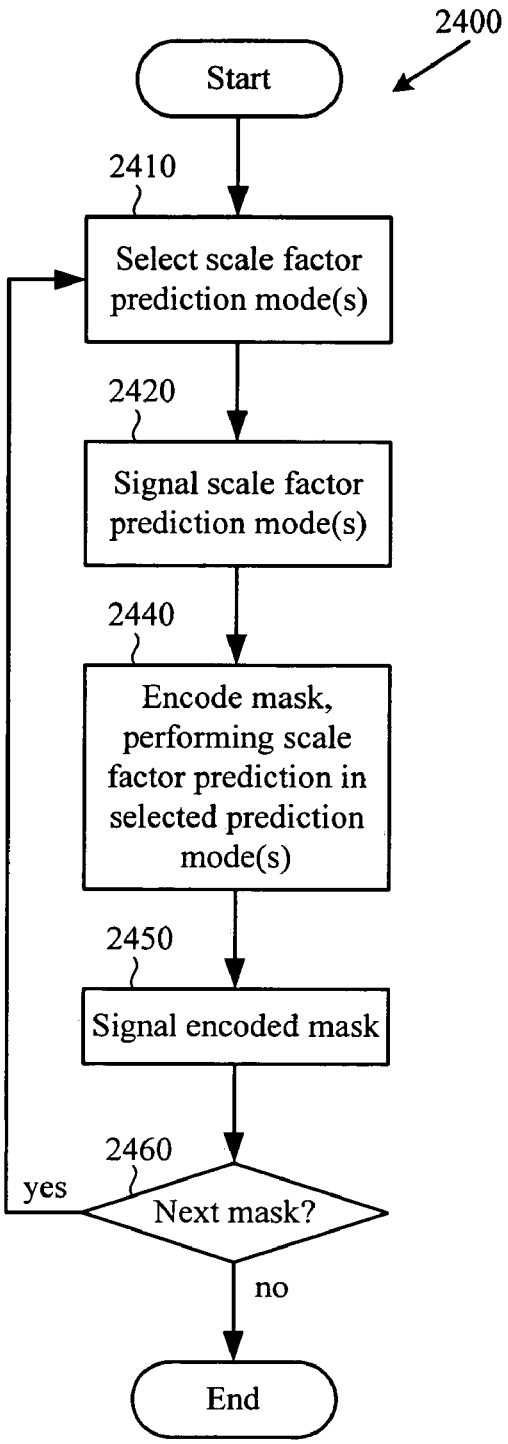
FIGS. 24 and 25 are flowcharts showing techniques for flexible prediction of scale factors during encoding and decoding, respectively.

FIG. 24 shows a technique (2400) for performing flexible prediction of scale factors during encoding. An encoder such as the encoder shown in FIG. 2, 4, or 7 performs the technique (2400). Alternatively, another tool performs the technique (2400).

The encoder selects (2410) one or more scale factor prediction modes to be used when encoding the scale factors for a current mask. For example, the encoder selects between spectral prediction, temporal prediction, spatial prediction, temporal+spectral prediction, and spatial+spectral prediction modes depending on which provides the best results in encoding the scale factors. Alternatively, the encoder selects between other and/or additional scale factor prediction modes.

The encoder then signals (2420) information indicating the selected scale factor prediction mode(s). For example, the encoder signals VLC(s) and/or FLC(s) indicating the selection mode(s), or the encoder signals information according to the syntax shown in FIGS. 39*a* and 39*b*. Alternatively, the encoder signals the scale factor prediction mode information using another signaling mechanism.

The encoder encodes (2440) the scale factors for the current mask, performing prediction in the selected scale factor prediction mode(s). For example, the encoder performs spectral, temporal, or spatial scale factor prediction, followed by entropy coding of the prediction residuals. Alternatively, the encoder performs other and/or additional scale factor prediction. The encoder then signals (2450) the encoded information for the mask.

The encoder determines (2460) whether there is another mask for which scale factors are to be encoded and, if so, selects the scale factor prediction mode(s) for the next mask. Alternatively, the encoder selects and switches scale factor prediction modes on some other basis.

4. Flexible Prediction of Scale Factors During Decoding.

Figure 25:
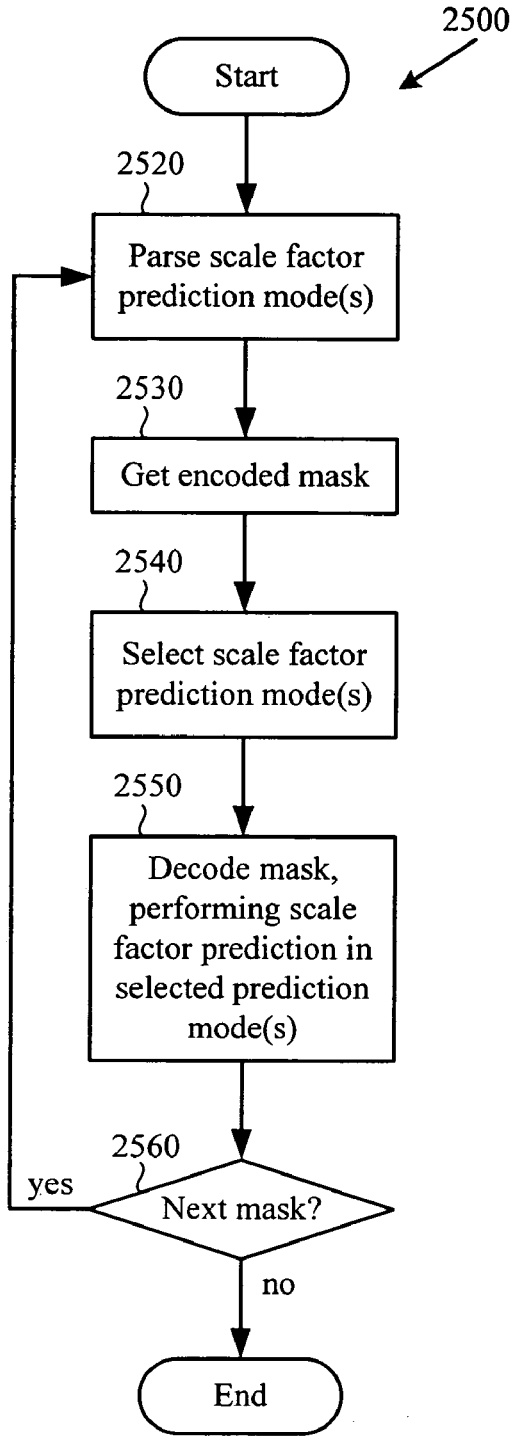

FIG. 25 shows a technique (2500) for performing flexible prediction of scale factors during decoding. A decoder such as the decoder shown in FIG. 3, 5, or 8 performs the technique (2500). Alternatively, another tool performs the technique (2500).

Figure 39A:
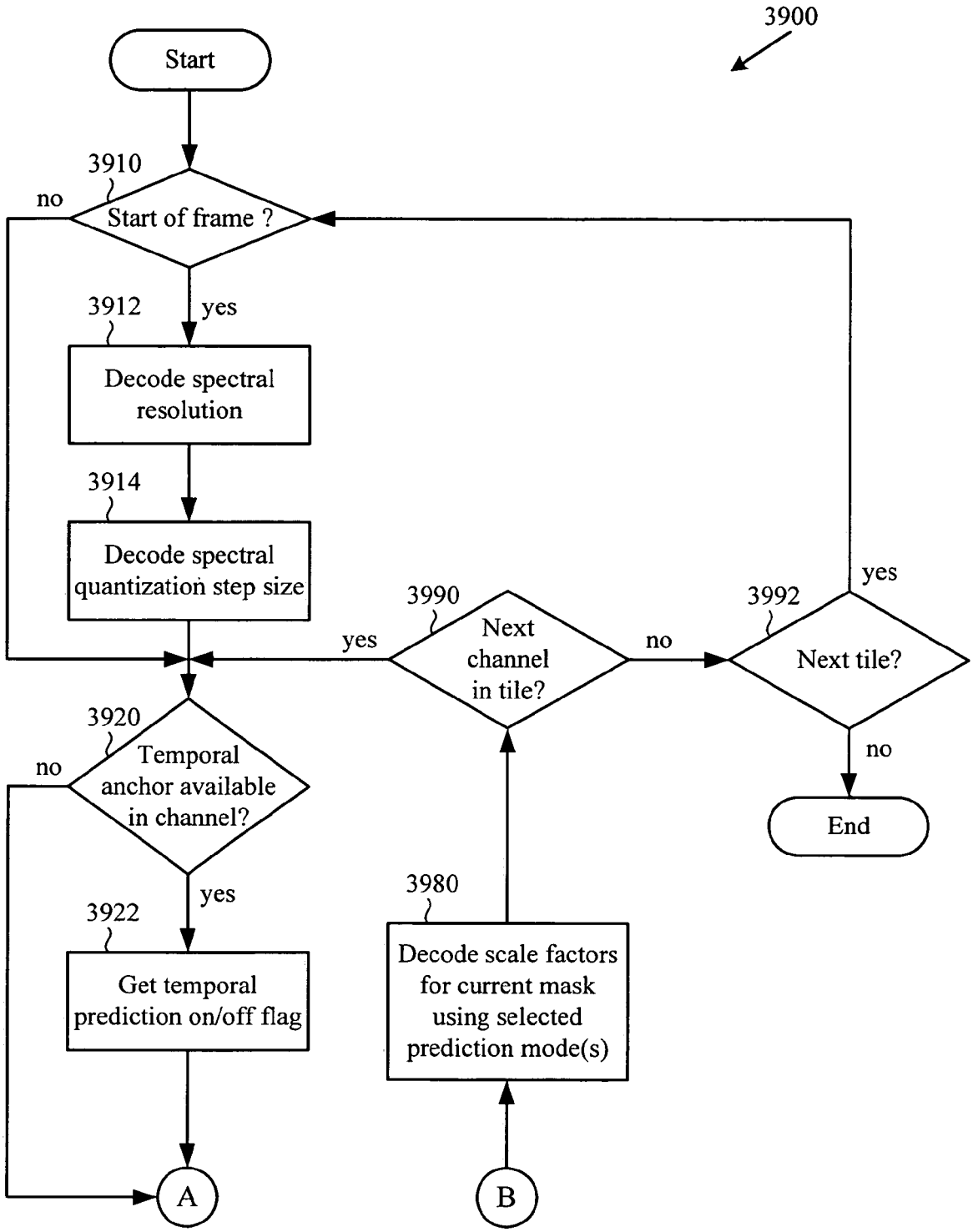
FIGS. 39*a* and 39*b* are flowcharts showing a technique for parsing signaled information for flexible scale factor prediction, possibly including spatial prediction and two-stage prediction.
Figure 39B:
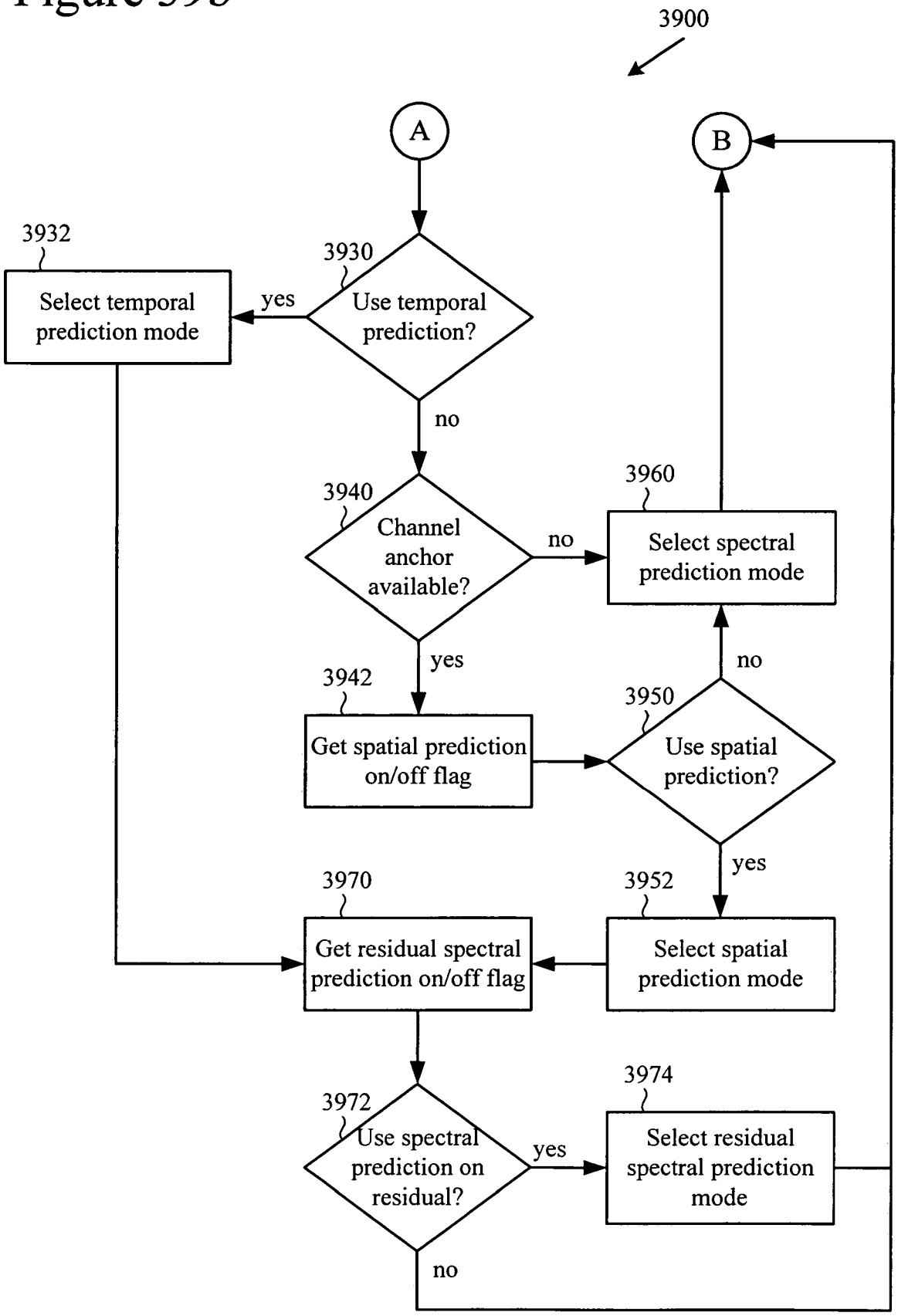

The decoder gets (2520) information indicating scale factor prediction mode(s) to be used during decoding of the scale factors for a current mask. For example, the decoder parses VLC(s) and/or FLC(s) indicating the selection mode(s), or the decoder parses information as shown in FIGS. 39*a* and 39*b*. Alternatively, the decoder gets scale factor prediction mode information signaled using another signaling mechanism. The decoder also gets (2530) the encoded information for the mask.

The decoder selects (2540) one or more scale factor prediction modes to be used during decoding the scale factors for the current mask. For example, the decoder selects between spectral prediction, temporal prediction, spatial prediction, temporal+spectral prediction, and spatial+spectral prediction modes based on parsed prediction mode information and selection rules. Alternatively, the decoder selects between other and/or additional scale factor prediction modes.

The decoder decodes (2550) the scale factors for the current mask, performing prediction in the selected scale factor prediction mode(s). For example, the decoder performs entropy decoding of the prediction residuals, followed by spectral, temporal, or spatial scale factor prediction. Alternatively, the decoder performs other and/or additional scale factor prediction.

The decoder determines (2560) whether there is another mask for which scale factors are to be decoded and, if so, selects the scale factor prediction mode(s) for the next mask. Alternatively, the decoder selects and switches scale factor prediction modes on some other basis.

E. Smoothing High-resolution Scale Factors.

In some embodiments, an encoder performs smoothing on scale factors. For example, the encoder smoothes the amplitudes of scale factors (e.g., sub-Bark scale factors or other high spectral resolution scale factors) to reduce excessive small variation in the amplitudes before scale factor prediction. In performing the smoothing on scale factors, however, the encoder preserves significant, relatively low amplitudes to help quality.

Original scale factor amplitudes can show an extreme amount of small variation in amplitude from scale factor to scale factor. This is especially true when higher resolution, sub-Bark scale factors are used for encoding and decoding. Variation or noise in scale factor amplitudes can limit the efficiency of subsequent scale factor prediction because of the energy remaining in the difference values following scale factor prediction, which results in higher bit rates for entropy encoded scale factor information.

Figure 26:
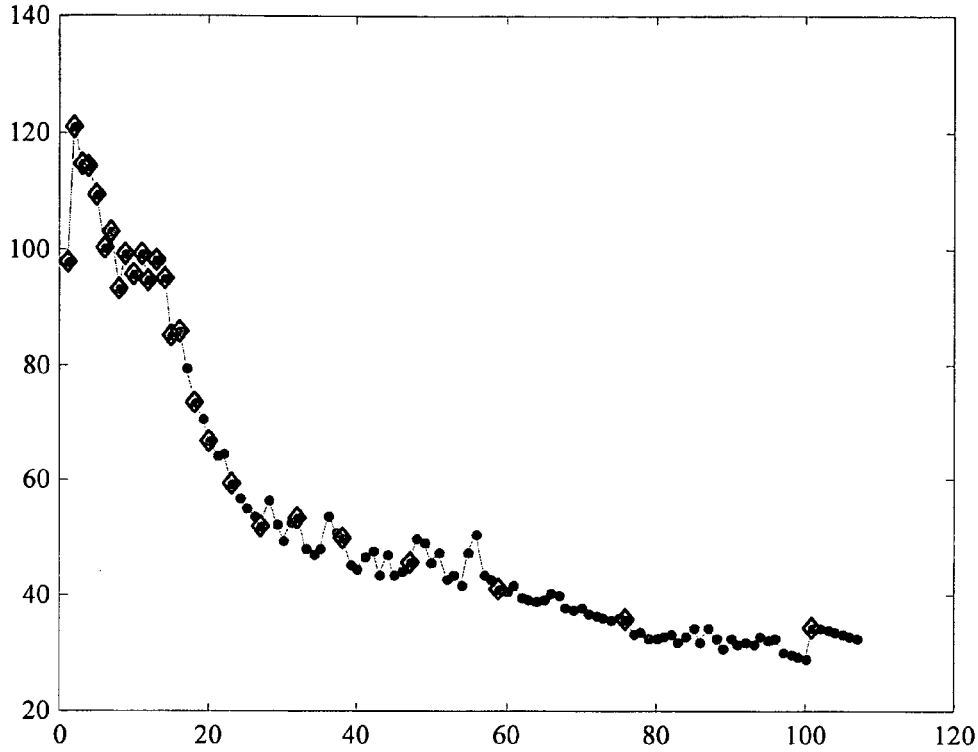
FIG. 26 is a chart showing noisiness in scale factor amplitudes before smoothing.

FIG. 26 shows an example of original scale factors at a sub-Bark spectral resolution. The points in FIG. 26 represent scale factor amplitudes numbered from 1 to 117 in terms of dB of amplitude. The points with black diamonds around them represent scale factor amplitudes at boundaries of Bark bands. When spectral scale factor prediction is applied to scale factors shown in FIG. 26, even after quantization of the scale factors, there can be many non-zero prediction residuals, which tend to consume more bits than zero-value prediction residuals in entropy encoding. Similarly, spatial scale factor prediction and temporal scale factor prediction can result in many non-zero prediction residuals, consuming an inefficient amount of bits in subsequent entropy encoding.

Fortunately, in various common encoding scenarios, it is not necessary to use high spectral resolution throughout an entire vector of sub-critical band scale factors. In such scenarios, the main advantage of using scale factors at a high spectral resolution is the ability to capture deep scale factor valleys; the spectral resolution of scale factors between such scale factor valleys is not as important.

Figure 29:
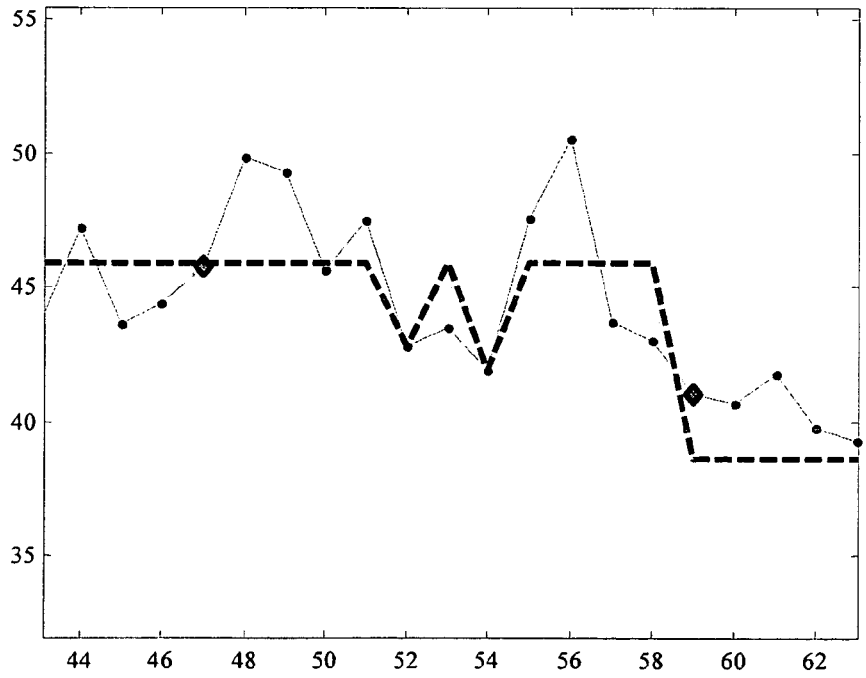
FIG. 29 is a chart showing some of the scale factor amplitudes of FIG. 26 before and after smoothing.

In general, a scale factor valley is a relatively small amplitude scale factor surrounded by relatively larger amplitude scale factors. A typical scale factor valley is due to a corresponding valley in the spectrum of the corresponding original audio. FIG. 29 shows scale factor amplitudes for a Bark band. The points in FIG. 29 represent original scale factor amplitudes from from FIG. 26 for the $44^{th}$ scale factor to the $63^{rd}$ scale factor, and the points with black diamonds around them indicate boundaries of Bark bands at original $47^{th}$ and $59^{th}$ scale factors. The solid line in FIG. 29 charts the original scale factor amplitudes and illustrates noisiness in the scale factor amplitudes. For the Bark band starting at the $47^{th}$ scale factor and ending at the $58^{th}$ scale factor, there are three scale factor valleys, with bottoms at the $50^{th}$, $52^{nd}$, and $54^{th}$ scale factors.

With Bark-resolution scale factors, an encoder cannot represent the short-term scale factor valleys shown in FIG. 29. Instead, a single scale factor amplitude is used per Bark band; the area starting at the $47^{th}$ scale factor and ending at the $58^{th}$ scale factor in FIG. 29 is instead represented with a single scale factor. If the amplitude of the single scale factor is the amplitude of the lowest valley point shown in FIG. 29, then large parts of the Bark band are likely coded at a higher quality and bit rate than is desirable under the circumstances. On the other hand, if the amplitude of the single scale factor is the amplitude of one of the larger scale factor amplitudes around the valleys, coefficients in deeper spectrum valleys are quantized by too large of a quantization step size, which can create spectrum holes that hurt the quality of the compressed audio.

For this reason, in some embodiments, an encoder performs smoothing on scale factors (e.g., sub-Bark scale factors) to reduce noise in the scale factor amplitudes while preserving scale factor valleys. Smoothing of scale factor amplitudes by Bark band for sub-Bark scale factors is one example of smoothing of scale factors. In other scenarios, an encoder performs smoothing on other types of scale factor information, on scale factors at other spectral resolutions, and/or using other smoothing logic.

Figure 27:
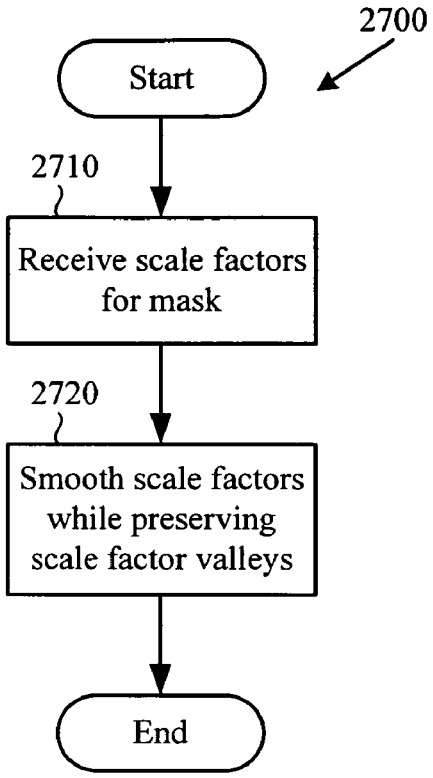
FIGS. 27 and 28 are flowcharts showing techniques for smoothing scale factor amplitudes before scale factor prediction and/or entropy encoding.

FIG. 27 shows a generalized technique (2700) for scale factor smoothing. An encoder such as one shown in FIG. 2, 4, or 7 performs the technique (2700). Alternatively, another tool performs the technique (2700).

To start, the encoder receives (2710) the scale factors for a mask. For example, the scale factors are at sub-Bark resolution or some other high spectral resolution. Alternatively, the scale factors are at some other spectral resolution.

The encoder then smoothes (2720) the amplitudes of the scale factors while preserving one or more of any significant scale factor valleys in the amplitudes. For example, the encoder performs the smoothing technique (2800) shown in FIG. 28. Alternatively, the encoder performs some other smoothing technique. For example, the encoder computes short-term averages of scale factor amplitudes and checks amplitudes against the short-term averages. Or, the encoder applies a filter that outputs averaged amplitudes for most scale factors but outputs original amplitudes for scale factor valleys. In some implementations, unlike a quantization operation, the smoothing does not reduce or otherwise alter the amplitude resolution of the scale factor amplitudes.

In general, the encoder can control the degree of the smoothing depending on bit rate, quality, and/or other criteria before encoding and/or during encoding. For example, the encoder can control the filter length, whether averaging is short-term, long-term, etc., and the encoder can control the threshold for classifying something as a valley (to be preserved) or smaller hole (to be smoothed over).

Figure 28:
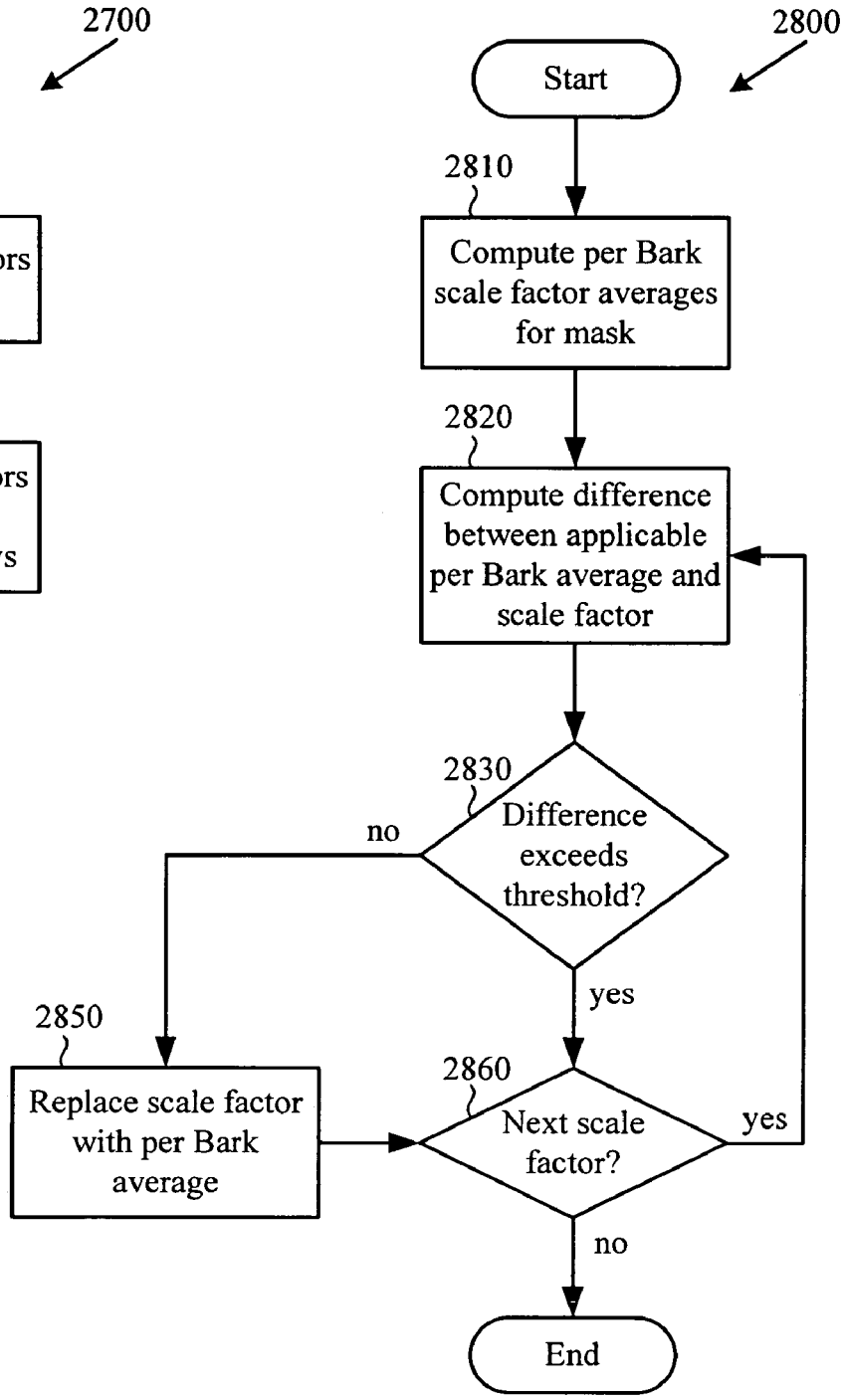

FIG. 28 shows a more specific technique (2800) for scale factor smoothing of sub-Bark scale factor amplitudes. An encoder such as one shown in FIG. 2, 4, or 7 performs the technique (2800). Alternatively, another tool performs the technique (2800).

To start, the encoder computes (2810) scale factor averages per Bark band for a mask. So, for each of the Bark bands in the mask, the encoder computes the average amplitude value for the sub-Barks in the Bark band. If the Bark band includes one scale factor, that scale factor is the average value. Alternatively, the computation of per Bark averages is interleaved with the rest of the technique (2800) one Bark band at a time.

For the next scale factor amplitude in the mask, the encoder computes (2820) the difference between the applicable per Bark average (for the Bark band that includes the scale factor) and the original scale factor amplitude itself. The encoder then checks (2830) whether the difference value exceeds a threshold and, if not, the encoder replaces (2850) the original scale factor amplitude with the per Bark average. For example, if the per Bark average is 46 dB and the original scale factor amplitude is 44 dB, the difference is 2 dB. If the threshold is 3 dB, the encoder replaces the original scale factor amplitude of 44 dB with the value of 46 dB. On the other hand, if the scale factor amplitude is 41 dB, the difference is 5 dB, which exceeds the 3 dB threshold, so the 41 dB amplitude is preserved. Essentially, the encoder compares the original scale factor amplitude with the applicable average. If the original scale factor amplitude is more than 3 dB lower than the average, the encoder keeps the original scale factor amplitude. Otherwise, the encoder replaces the original amplitude with the average.

In general, the threshold value establishes a tradeoff in terms of bit rate and quality. The higher the threshold, the more likely scale factor valleys will be smoothed over, and the lower the threshold, the more likely scale factor valleys will be preserved. The threshold value can be preset and static. Or, the encoder can set the threshold value depending on bit rate, quality, or other criteria during encoding. For example, when bit rate is low, the encoder can raise the threshold above 3 dB to make it more likely that valleys will be smoothed.

Returning to FIG. 28, the encoder determines (2860) whether there are more scale factors to smooth and, if so, computes (2820) the difference for the next scale factor.

FIG. 29 shows the results of smoothing with a valley threshold of 3 dB. For the Bark band from the $47^{th}$ scale factor through the $58^{th}$ scale factor, the average amplitude is 46 dB. Along the dashed line, the original scale factor amplitudes above 46 dB, and other original amplitudes less than 3 dB below the average, have been replaced with amplitudes of 46 dB. A local valley point at the $50^{th}$ scale factor, which was already close to the average, has also been smoothed. Two valley points at the $52^{nd}$ and $54^{th}$ scale factors have been preserved, with the original amplitudes kept after the smoothing. The next drop is at the $59^{th}$ scale factor, due to a change in per Bark averages. After the smoothing, most of the scale factors have amplitudes that can be efficiently converted to zero-value spectral prediction residuals, improving the gain from subsequent entropy encoding. At the same time, two significant scale factor valleys have been preserved.

In experiments on various audio sources, it has been observed that smoothing out scale factor valleys deeper than 3 dB below Bark average often causes spectrum holes when sub-Bark resolution scale factors are used. On the other hand, smoothing out scale factor values less than 3 dB deep typically does not cause spectrum holes. Therefore, the encoder uses a 3 dB threshold to reduce scale factor noise and thereby reduce bit rate associated with the scale factors.

The preceding examples involve smoothing from scale factor amplitude to scale factor amplitude in a single mask. This type of smoothing improves the gain from subsequent spectral scale factor prediction and, when applied to anchor scale factors (in an anchor channel or an anchor sub-frame of the same channel) can improve the gain from spatial scale factor prediction and temporal scale factor prediction as well. Alternatively, the encoder computes averages for scale factors at the same position (e.g., $23^{rd}$ scale factor) of a sub-frame in different channels and performs smoothing across channels, as pre-processing for spatial scale factor prediction. Or, the encoder computes scale factors for the same (or same as mapped) position of sub-frames in a given channel, as pre-processing for temporal scale factor prediction.

F. Reordering Prediction Residuals for Scale Factors.

In some embodiments, an encoder and decoder reorder scale factor prediction residuals. For example, the encoder reorders scale factor prediction residuals prior to entropy encoding to improve the efficiency of the entropy encoding. Or, a decoder reorders scale factor prediction residuals following entropy decoding to reverse reordering performed during encoding.

Figure 30:
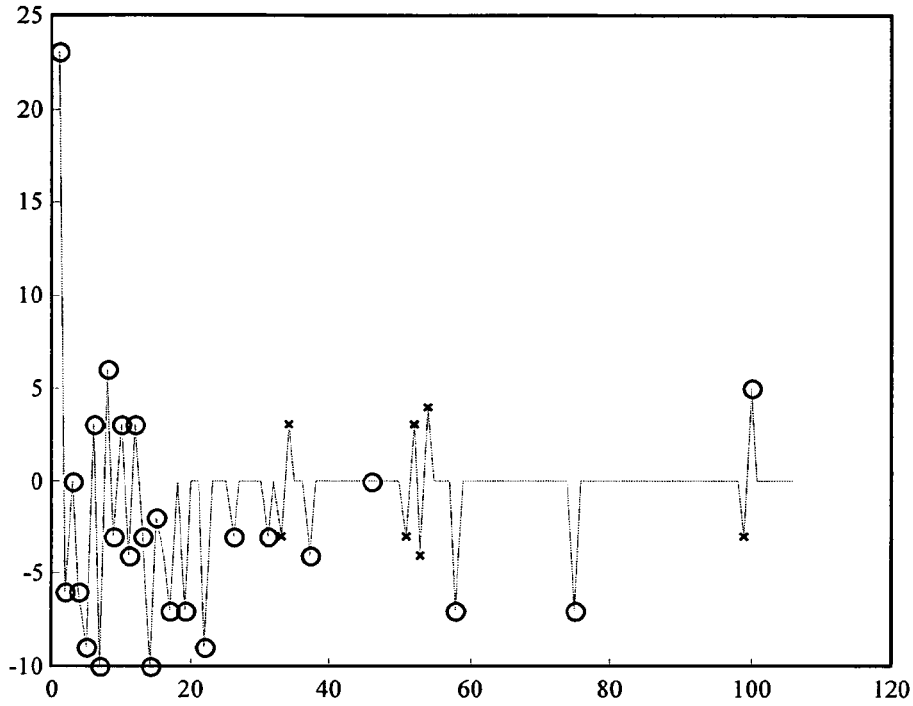
FIG. 30 is a chart showing scale factor prediction residuals before reordering.

Continuing the example of FIGS. 26 and 29, if spectral scale factor prediction is applied to smoothed, high spectral resolution scale factors (e.g., sub-Bark scale factors), non-zero prediction residuals occur at Bark band boundaries and scale factor valleys. FIG. 30 shows scale factor prediction residuals following spectral prediction of the smoothed scale factors. In FIG. 30, the circles indicate amplitudes of spectral prediction residuals for scale factors at Bark boundaries (e.g., the $47^{th}$ and $59^{th}$ scale factors). Many (but not all) of these are non-zero values due to changes in the Bark band averages. The crosses in FIG. 30 indicate amplitudes of spectral prediction residuals at or following scale factor valleys (e.g., the $52^{nd}$ and $54^{th}$ scale factors). These are non-zero amplitudes.

Many of the non-zero prediction residuals in FIG. 30 are separated by runs of one or more zero-value spectral prediction residuals. This pattern of values can be efficiently coded using run-level coding. The efficiency of run-level coding decreases, however, as runs of the prevailing value (here, zero) get shorter, interrupted by other values (here, non-zero values).

In FIG. 30, many of the non-zero spectral prediction residuals are for scale factors at Bark boundaries. The positions of the Bark boundaries are typically fixed according to block size and other configuration details, and this information is available at the encoder and decoder. The encoder and decoder can thus use this information to group prediction residuals at Bark boundaries together, which tends to group non-zero residuals, and also to group other prediction residuals together. This tends merge zero-value residuals and thereby increase run lengths for zero-value residuals, which typically improves the efficiency of subsequent run-level coding.

Figure 31:
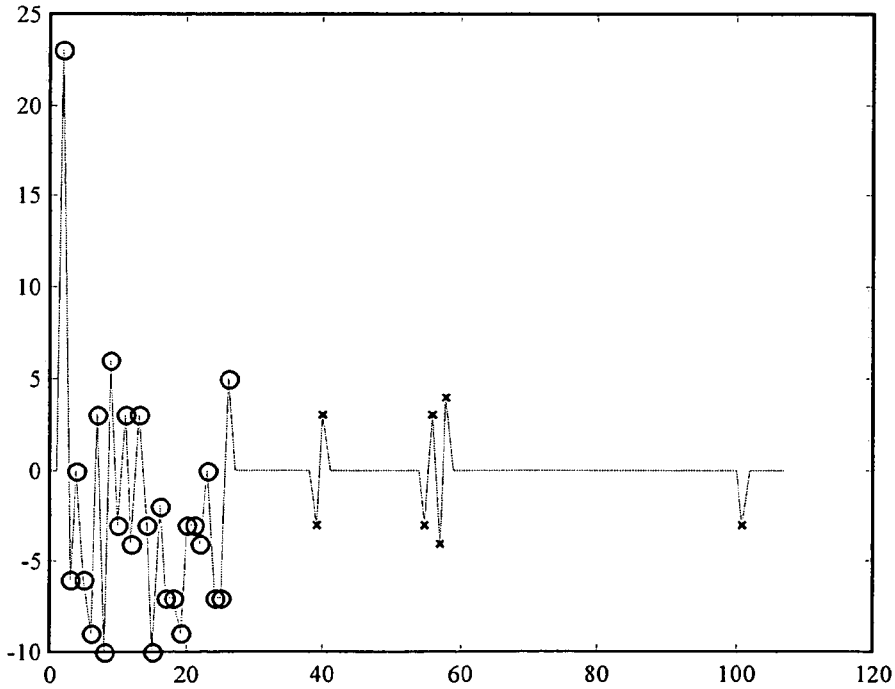
FIG. 31 is a chart showing the scale factor prediction residuals of FIG. 30 after reordering.

FIG. 31 shows the result of reordering the spectral prediction residuals shown in FIG. 30. In the reordered prediction residuals, the non-zero residuals are more tightly grouped towards the beginning, and the runs of zero-value residuals are longer. At least some of the spectral prediction residuals are coded with run-level coding (followed by simple Huffman coding of run-level symbols). The grouped non-zero residuals towards the beginning can be encoded with simple Huffman coding, vector Huffman coding, or some other entropy coding suited for non-zero values.

Reordering of spectral prediction residuals by Bark band for sub-Bark scale factors is one example of reordering of scale factor prediction residuals. In other scenarios, an encoder and decoder perform reordering on other types of scale factor information, on scale factors at other spectral resolutions, and/or using other reordering logic.

1. Architectures for Reordering Scale Factor Prediction Residuals.

Figure 32:
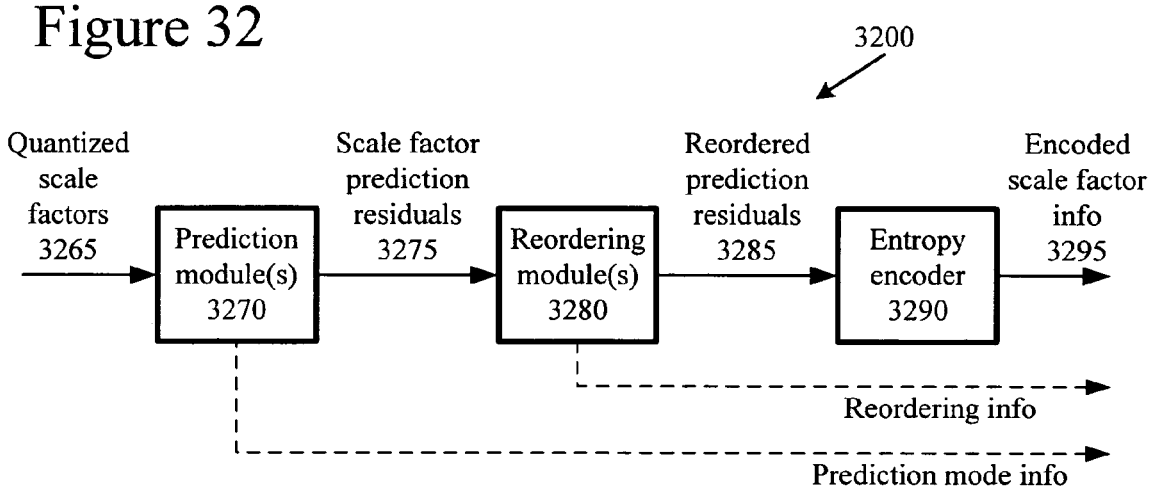
FIGS. 32 and 33 are block diagrams showing architectures for reordering of scale factor prediction residuals during encoding and decoding, respectively.
Figure 33:
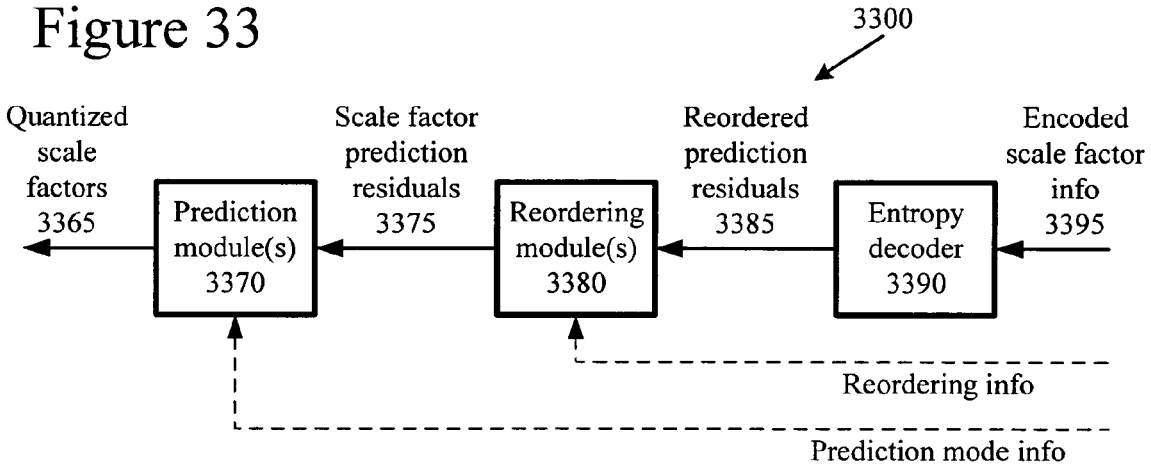

FIGS. 32 and 33 show generalized architectures for reordering of scale factor prediction residuals during encoding and decoding, respectively. An encoder such as one shown in FIG. 2, 4, or 7 can include the modules shown in FIG. 32, and a decoder such as one shown in FIG. 3, 5, or 8 can include the modules shown in FIG. 33.

With reference to FIG. 32, one or more scale factor prediction modules (3270) perform scale factor prediction on quantized scale factors (3265). For example, the scale factor prediction includes temporal, spatial, or spectral prediction. Alternatively, the scale factor prediction includes other kinds of scale factor prediction or combinations of different scale factor prediction. The prediction module(s) (3270) can signal scale factor prediction mode information indicating the type(s) of prediction used, for example, signaling the information in a bitstream. The prediction module(s) (3270) output scale factor prediction residuals (3275) to the reordering module(s) (3280).

The reordering module(s) (3280) reorder the scale factor prediction residuals (3275), producing reordered scale factor prediction residuals (3285). For example, the reordering module(s) (3280) reorder the residuals (3275) using a preset reordering logic and information available at the encoder and decoder, in which case the encoder does not signal reordering information to the decoder. Or, the reordering module(s) (3280) selectively perform reordering and signal reordering on/off information. Or, the reordering module(s) (3280) perform reordering according to one of multiple preset reordering schemes and signal reordering mode selection information indicating the reordering scheme used. Or, the reordering module(s) (3280) perform reordering according to a more flexible scheme and signal reordering information such as a reordering start position and/or a reordering stop position, which describes the reordering.

The entropy encoder (3290) receives and entropy encodes the reordered prediction residuals (3285). For example, the entropy encoder (3290) performs run-level coding (followed by simple Huffman coding of run-level symbols). Or, the entropy encoder (3290) performs vector Huffman coding for prediction residuals up to a particular scale factor position, then performs run-level coding (followed by simple Huffman coding) on the rest of the prediction residuals. Alternatively, the entropy encoder (3290) performs some other type or combination of entropy encoding. The entropy encoder (3290) outputs encoded scale factor information (3295), for example, signaling the information (3295) in a bitstream.

With reference to FIG. 33, the entropy decoder (3390) receives encoded scale factor information (3395), for example, parsing the information (3395) from a bitstream. The entropy decoder (3390) entropy decodes the encoded information (3395), producing reordered prediction residuals (3385). For example, the entropy decoder (3390) performs run-level decoding (after simple Huffman decoding of run-level symbols). Or, the entropy decoder (3390) performs vector Huffman decoding for residuals up to a particular position, then performs run-level decoding (followed by simple Huffman coding) for the rest of the residuals. Alternatively, the entropy decoder (3390) performs some other type or combination of entropy encoding.

The reordering module(s) (3380) reverse any reordering performed during encoding for the decoded, reordered prediction residuals (3385), producing the scale factor prediction residuals (3375) in original scale factor order. Generally, the reordering module(s) (3380) reverse whatever reordering was performed during encoding. The reordering module(s) (3380) can get information describing whether or not to perform reordering and/or how to perform the reordering.

The prediction module(s) (3370) perform scale factor prediction using the prediction residuals (3375) in original scale factor order. Generally, the scale factor prediction module(s) (3370) perform whatever scale factor prediction was performed during encoding, so as to reconstruct the quantized scale factors (3365) from the prediction residuals (3375) in original order. The scale factor prediction module(s)

(3370) can get information describing whether or not to perform scale factor prediction and/or how to perform the scale factor prediction (e.g., prediction modes).

2. Reordering Scale Factor Prediction Residuals During Encoding.

Figure 34A:
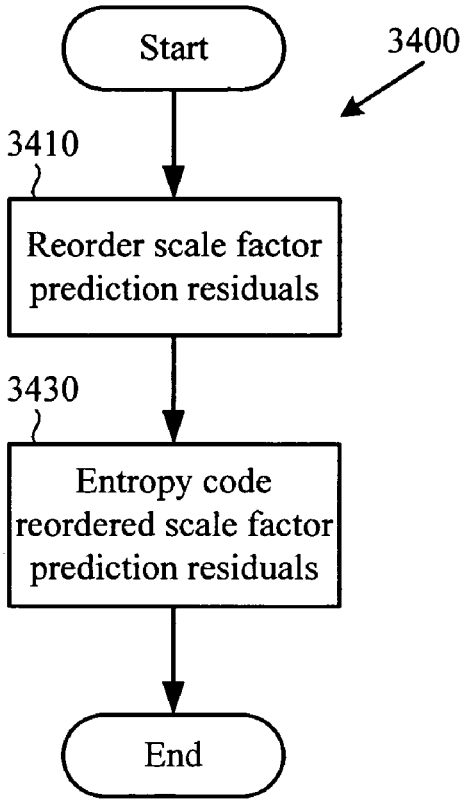
FIGS. 34*a* and 34*b* are flowcharts showing a technique for reordering scale factor prediction residuals before entropy encoding.
Figure 34B:
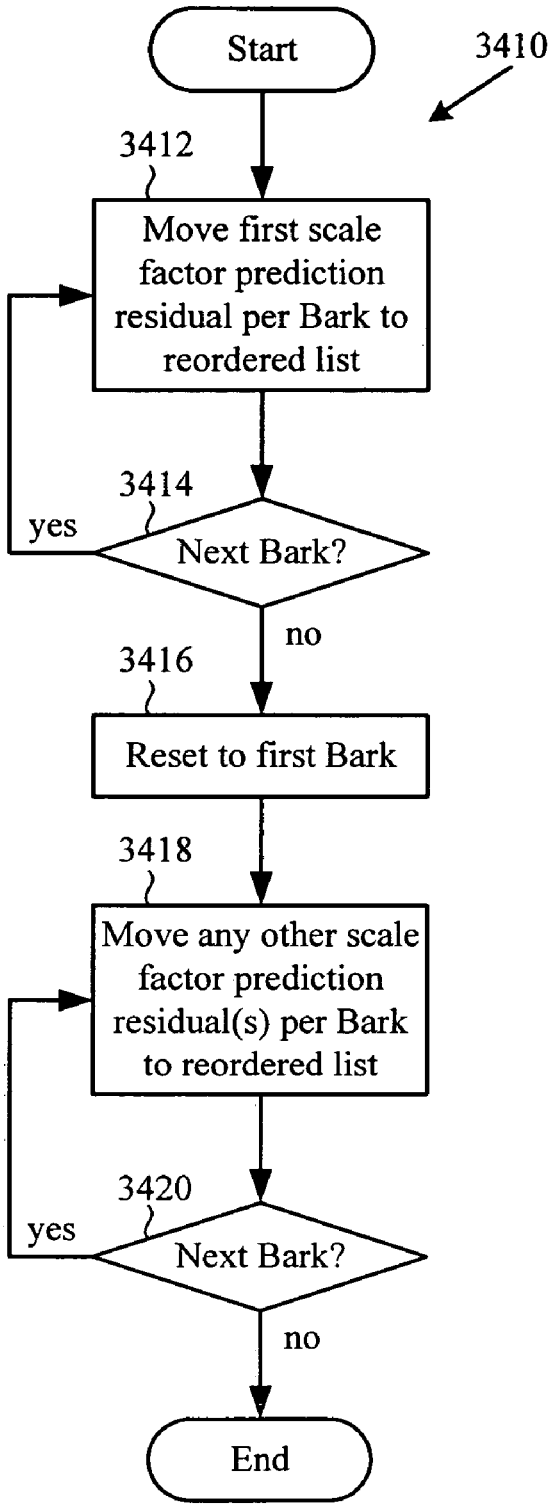

FIG. 34*a* shows a generalized technique (3400) for reordering scale factor prediction residuals for a mask during encoding. An encoder such as the encoder shown in FIG. 2, 4, or 7 performs the technique (3400). Alternatively, another tool performs the technique (3400). FIG. 34*b* details a possible way to perform one of the acts of the technique (3400) for sub-Bark scale factor prediction residuals.

With reference to FIG. 34*a*, an encoder reorders (3410) scale factor prediction residuals for the mask. For example, the encoder uses the reordering technique shown in FIG. 34*b*. Alternatively, the encoder uses some other reordering mechanism.

With reference to FIG. 34*b*, in one implementation, the encoder browses through the vector of scale factors twice to accomplish the reordering (3410). In general, in the first pass the encoder gathers those prediction residuals at Bark band boundaries, and in the second pass the encoder gathers those prediction residuals not at Bark band boundaries.

More specifically, the encoder moves (3412) the first scale factor prediction residual per Bark band to a list of reordered scale factor prediction residuals. The encoder then checks (3414) whether to continue with the next Bark band. If so, the encoder moves (3412) the first prediction residual at the next Bark band boundary to the next position in the list of reordered prediction residuals. Eventually, for each Bark band, the first prediction residual is in the reordered list in Bark band order.

After the encoder has reached the last Bark band in the mask, the encoder resets (3416) to the first Bark band and moves (3418) any remaining scale factor prediction residuals for that Bark band to the next position(s) in the list of reordered prediction residuals. The encoder then checks (3420) whether to continue with the next Bark band. If so, the encoder moves (3418) any remaining prediction residuals for that Bark band to the next position(s) in the list of reordered prediction residuals. For each of the Bark bands, any non-first prediction residuals maintain their relative order. Eventually, for each Bark band, any non-first prediction residual(s) are in the reordered list, band after band.

Returning to FIG. 34*a*, the encoder entropy encodes (3430) the reordered scale factor prediction residuals. For example, the encoder performs run-level coding (followed by simple Huffman coding of run-level symbols) or a combination of such run-level coding and vector Huffman coding. Alternatively, the encoder performs some other type or combination of entropy encoding.

3. Reordering Scale Factor Prediction Residuals During Decoding.

Figure 35A:
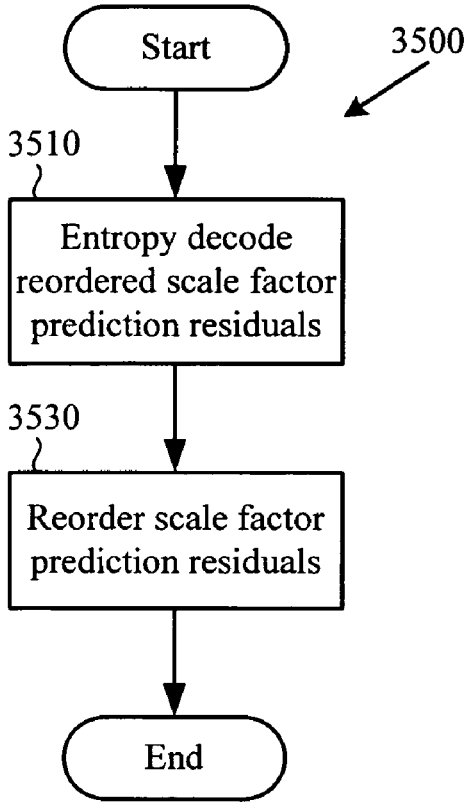
FIGS. 35*a* and 35*b* are flowcharts showing a technique for reordering scale factor prediction residuals after entropy decoding.
Figure 35B:
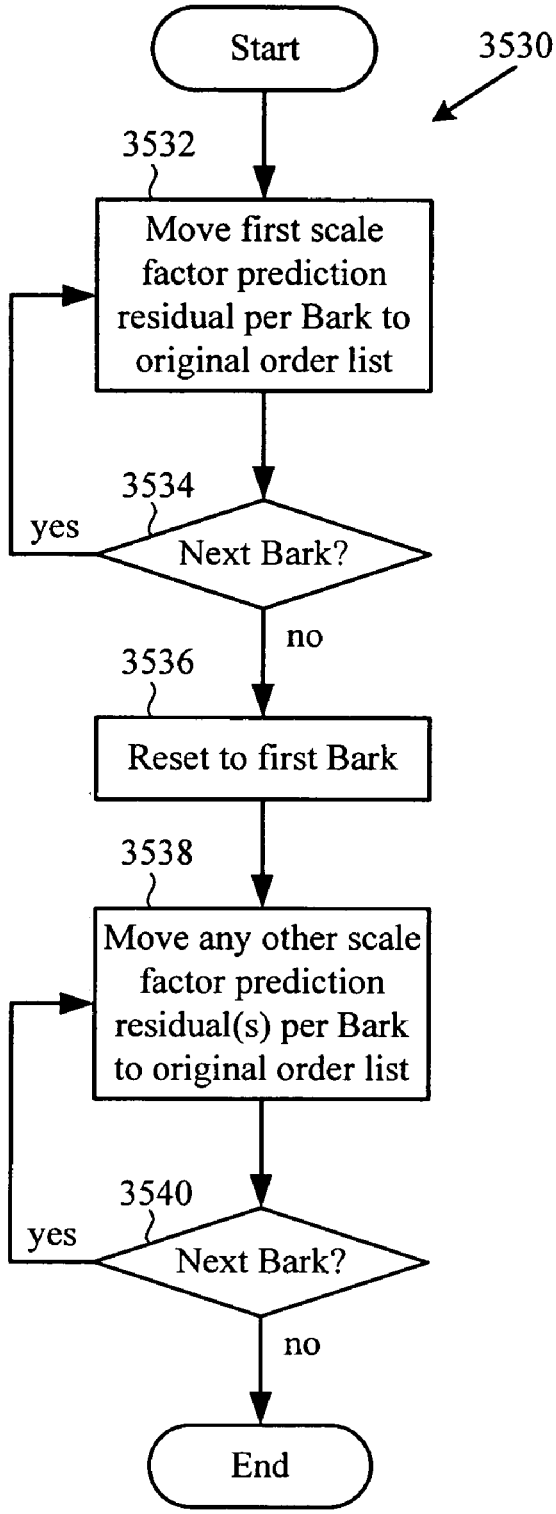

FIG. 35*a* shows a generalized technique (3500) for reordering scale factor prediction residuals for a mask during decoding. A decoder such as the decoder shown in FIG. 3, 5, or 8 performs the technique (3500). Alternatively, another tool performs the technique (3500). FIG. 35*b* details a possible way to perform one of the acts of the technique (3500) for sub-Bark scale factor prediction residuals.

With reference to FIG. 35*a*, the decoder entropy decodes (3510) the reordered scale factor prediction residuals. For example, the decoder performs run-level decoding (after simple Huffman decoding of run-level symbols) or a combination of such run-level decoding and vector Huffman decoding. Alternatively, the decoder performs some other type or combination of entropy decoding.

The decoder reorders (3530) scale factor prediction residuals for the mask. For example, the decoder uses the reordering technique shown in FIG. 35*b*. Alternatively, the decoder uses some other reordering mechanism.

With reference to FIG. 35*b*, in one implementation, the decoder moves (3532) the first scale factor prediction residual per Bark band to a list of scale factor prediction residuals in original order. For example, the decoder uses Bark band boundary information to place prediction residuals at appropriate positions in the original order list. The decoder then checks (3534) whether to continue with the next Bark band. If so, the decoder moves (3532) the first prediction residual at the next Bark band boundary to the appropriate position in the list of prediction residuals in original order. Eventually, for each Bark band, the first prediction residual is in the original order list in its original position.

After the decoder has reached the last Bark band in the mask, the decoder resets (3536) to the first Bark band and moves (3538) any remaining scale factor prediction residuals for that Bark band to the appropriate position(s) in the list of residuals in original order. The decoder then checks (3540) whether to continue with the next Bark band. If so, the decoder moves (3438) any remaining prediction residuals for that Bark band to the appropriate position(s) in the list of residuals in original order. Eventually, for each Bark band, any non-first prediction residual(s) are in the original order list in original position(s).

4. Alternatives—Cross-Layer Scale Factor Prediction.

Alternatively, an encoder can achieve grouped patterns of non-zero prediction residuals and longers runs of zero-value prediction residuals (similar to common patterns in prediction residuals after reordering) by using two-layer scale factor coding or pyramidal scale factor coding. The two-layer scale factor coding and pyramidal scale factor coding in effect provide intra-mask scale factor prediction.

For example, for a two-layer approach, the encoder downsamples high spectral resolution (e.g., sub-Bark resolution) scale factors to produce lower spectral resolution (e.g., Bark resolution) scale factors. Alternatively, the higher spectral resolution is a spectral resolution other than sub-Bark and/or the lower spectral resolution is a spectral resolution other than Bark.

The encoder performs spectral scale factor prediction on the lower spectral resolution, downsampled (e.g., Bark band resolution) scale factors. The encoder then entropy encodes the prediction residuals resulting from the spectral scale factor prediction. The results tend to have most non-zero prediction residuals for the mask in them. For example, the encoder performs simple Huffman coding, vector Huffman coding or some other entropy coding on the spectral prediction residuals.

The encoder upsamples the lower spectral resolution (e.g., Bark band resolution) scale factors back to the original, higher spectral resolution for use as an intra-mask anchor/reference for the original scale factors at the original, higher spectral resolution.

The encoder computes the differences between the respective original scale factors at the higher spectral resolution and the corresponding upsampled, reference scale factors at the higher resolution. The differences tend to have runs of zero-value prediction residuals in them. The encoder entropy encodes these difference values, for example, using run-level coding (followed by simple Huffman coding of run-level symbols) or some other entropy coding.

At the decoder side, a corresponding decoder entropy decodes the spectral prediction residuals for the lower spectral resolution, downsampled (e.g., Bark band resolution) scale factors. For example, the decoder applies simple Huffman decoding, vector Huffman decoding, or some other entropy decoding. The decoder then applies spectral scale factor prediction to the entropy decoded spectral prediction residuals.

The decoder upsamples the reconstructed lower spectral resolution, downsampled (e.g., Bark band resolution) scale factors back to the original, higher spectral resolution, for use as an intra-mask anchor/reference for the scale factors at the original, higher spectral resolution.

The decoder entropy decodes the differences between the original high spectral resolution scale factors and corresponding upsampled, reference scale factors. For example, the decoder entropy decodes these difference values using run-level decoding (after simple Huffman decoding of run-level symbols) or some other entropy decoding.

The decoder then combines the differences with the corresponding upsampled, reference scale factors to produce a reconstructed version of the original high spectral resolution scale factors.

This example illustrates two-layer scale factor coding/decoding. Alternatively, in an approach with more than two layers, the lower resolution, downsampled scale factors at an intermediate layer can themselves be difference values.

Two-layer and other multi-layer scale factor coding/decoding involve cross-layer scale factor prediction that can be viewed as a type of intra-mask scale factor prediction. As such, cross-layer scale factor prediction provides an additional prediction mode for flexible scale factor prediction (section III.D) and multi-stage scale factor prediction (section III.G). Moreover, an upsampled version of a particular mask can be used as an anchor for cross-channel prediction (section III.C) and temporal prediction.

G. Multi-stage Scale Factor Prediction.

In some embodiments, an encoder and decoder perform multiple stages of scale factor prediction. For example, the encoder performs a first scale factor prediction then performs a second scale factor prediction on the prediction residuals from the first scale factor prediction. Or, a decoder performs the two stages of scale factor prediction in the reverse order.

Figure 36:
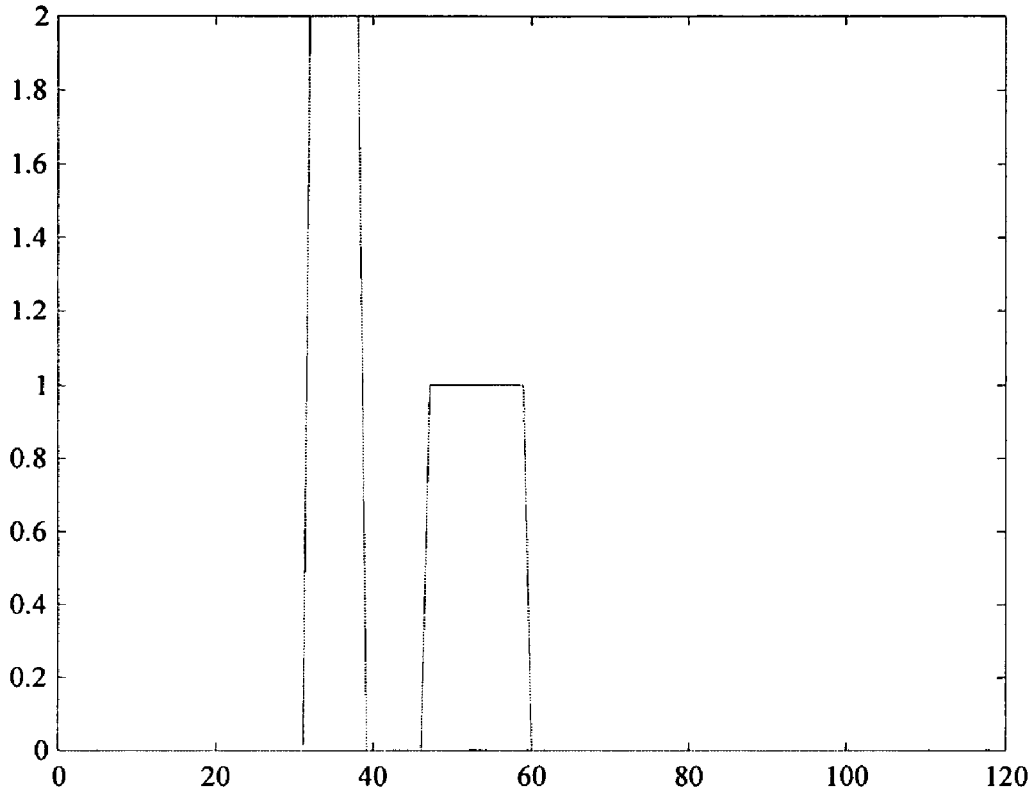
FIG. 36 is a chart showing a common pattern in prediction residuals from spatial scale factor prediction or temporal scale factor prediction.

In many scenarios, when temporal or spatial scale factor prediction is used for a mask of sub-Bark scale factors, most of the scale factor prediction residuals have the same value (e.g., zero), and only the prediction residuals for one Bark band or a few Bark bands have other (e.g., non-zero) values. FIG. 36 shows an example of such a pattern of scale factor prediction residuals. In FIG. 36, most of the scale factor prediction residuals are zero-value residuals. For one Bark band, however, the prediction residuals are non-zero but consistently have the value two. For another Bark band, the prediction residuals are non-zero but consistently have the value one. Run-level coding becomes less efficient as runs of the prevailing value (here, zero) get shorter and other values (here, one or two) appear. In view of the runs of non-zero values, however, the encoder and decoder can perform spectral scale factor prediction on the spatial or temporal scale factor prediction residuals to improve the efficiency of subsequent run-level coding.

For critical band bounded spectral prediction, the spatial or temporal prediction residual at a critical band boundary is not predicted; it is passed through unchanged. Any spatial or temporal prediction residuals in the critical band after the critical band boundary are spectrally predicted, however, up until the beginning of the next critical band. Thus, the critical band bounded spectral prediction stops at the end of each critical band and restarts at the beginning of the next critical band. When the spatial or temporal prediction residual at a critical band boundary has a non-zero value, it still has a non-zero value after the critical band bounded spectral prediction. When the spatial or temporal prediction residual at a subsequent critical band boundary has a zero value, however, it still has zero value after the critical band bounded spectral prediction. (In contrast, after regular spectral prediction, this zero-value spatial or temporal prediction residual could have a non-zero difference value relative to the last scale factor prediction residual from the prior critical band.) For example, for the spatial or temporal prediction residuals shown in FIG. 36, performing a regular spectral prediction results in four non-zero spectral prediction residuals positioned at critical band transitions. On the other hand, performing a critical band bounded spectral prediction results in two non-zero spectral prediction residuals at the starting positions of the two critical bands that had non-zero spatial or temporal prediction residuals.

Performing critical band bounded spectral scale factor prediction following spatial or temporal scale factor prediction is one example of multi-stage scale factor prediction. In other scenarios, an encoder and decoder perform multi-stage scale factor prediction with different scale factor prediction modes, with more scale factor prediction stages, and/or for scale factors at other spectral resolutions.

1. Multi-stage Scale Factor Prediction During Encoding

Figure 37A:
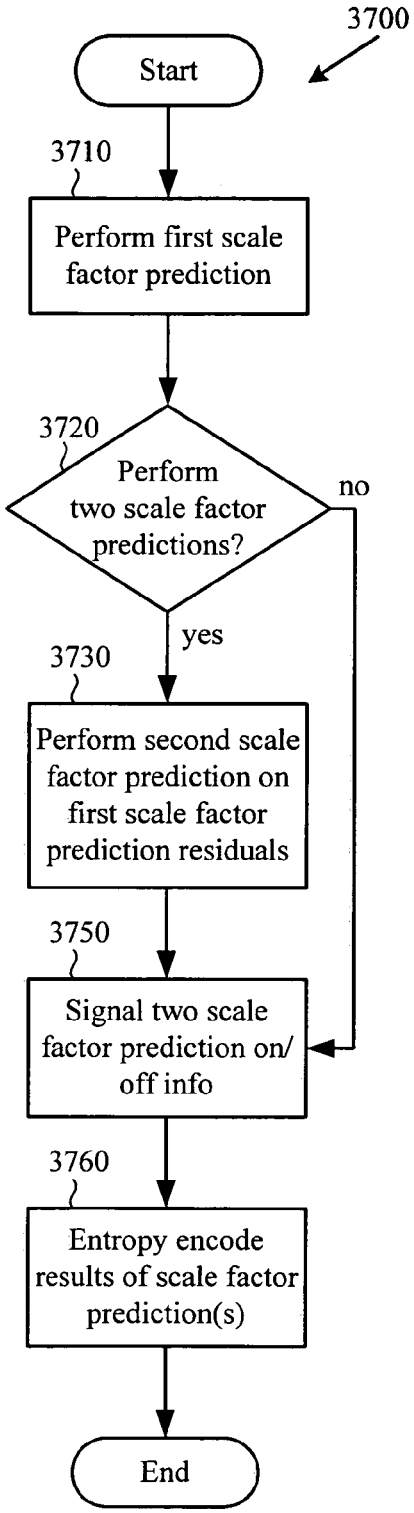
FIGS. 37*a* and 37*b* are flowcharts showing a technique for two-stage scale factor prediction during encoding.
Figure 37B:
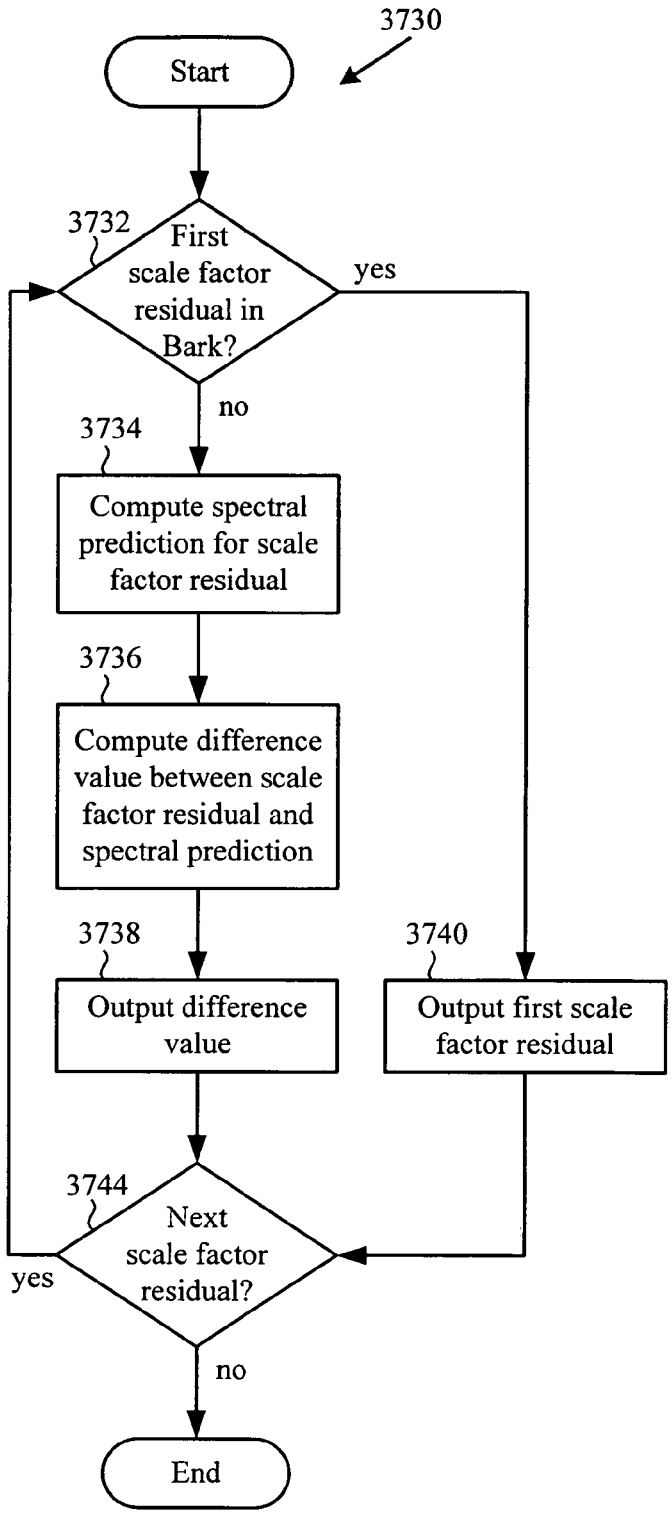

FIG. 37*a* shows a generalized technique (3700) for multi-stage scale factor prediction during encoding. An encoder such as the encoder shown in FIG. 2, 4, or 7 performs the technique (3700). Alternatively, another tool performs the technique (3700). FIG. 37*b* details a possible way to perform one of the acts of the technique (3700) for sub-Bark scale factor prediction residuals from spatial or temporal prediction.

The encoder performs (3710) a first scale factor prediction for the scale factors of a mask. For example, the first scale factor prediction is a spatial scale factor prediction or a temporal scale factor prediction. Alternatively, the first scale factor prediction is some other kind of scale factor prediction.

The encoder then determines (3720) whether or not it should perform an extra stage of scale factor prediction. (Such extra prediction does not always help coding efficiency in some implementations.) Alternatively, the encoder always performs the second stage of scale factor prediction, and skips the determining (3720) as well as the signaling (3750).

If the encoder does perform the extra scale factor prediction, the encoder performs (3730) the second scale factor prediction on prediction residuals from the first scale factor prediction. For example, the encoder performs Bark band bounded spectral prediction (as shown in FIG. 37*b*) on prediction residuals from spatial or temporal scale factor prediction. Alternatively, the encoder performs some other variant of spectral scale factor prediction or other type of scale factor prediction in the second prediction stage.

With reference to FIG. 37*b*, the encoder processes sub-Bark scale factor prediction residuals of a mask, residual after residual, for Bark band bounded spectral scale factor prediction. Starting with the first scale factor prediction residual as the current residual, the encoder checks (3732) whether or not the residual is the first scale factor residual in a Bark band. If the current residual is the first scale factor residual in a Bark band, the encoder outputs (3740) the current residual.

Otherwise, the encoder computes (3734) a spectral scale factor prediction for the current residual. For example, the spectral prediction is the value of the preceding scale factor prediction residual. The encoder then computes (3736) the difference between the current residual and the spectral prediction and outputs (3738) the difference value.

The encoder checks (3744) whether or not to continue with the next scale factor prediction residual in the mask. If so, the encoder checks (3732) whether the next scale factor residual in the mask is the first scale factor residual in a Bark band. The encoder continues until the scale factor prediction residuals for the mask have been processed.

Returning to FIG. 37*a*, the encoder also signals (3750) information indicating whether or not the second stage of scale factor prediction is performed for the scale factors of the mask. For example, the encoder signals a single bit on/off flag. In some implementations, the encoder performs the signaling (3750) for some masks (e.g., when the first scale factor prediction is spatial or temporal scale factor prediction) but not others, depending on the type of prediction used for the first scale factor prediction.

The encoder then entropy encodes (3760) the prediction residuals from the scale factor prediction(s). For example, the encoder performs run-level coding (followed by simple Huffman coding of run-level symbols) or a combination of such run-level coding and vector Huffman coding. Alternatively, the encoder performs some other type or combination of entropy encoding.

2. Multi-stage Scale Factor Prediction During Decoding

Figure 38A:
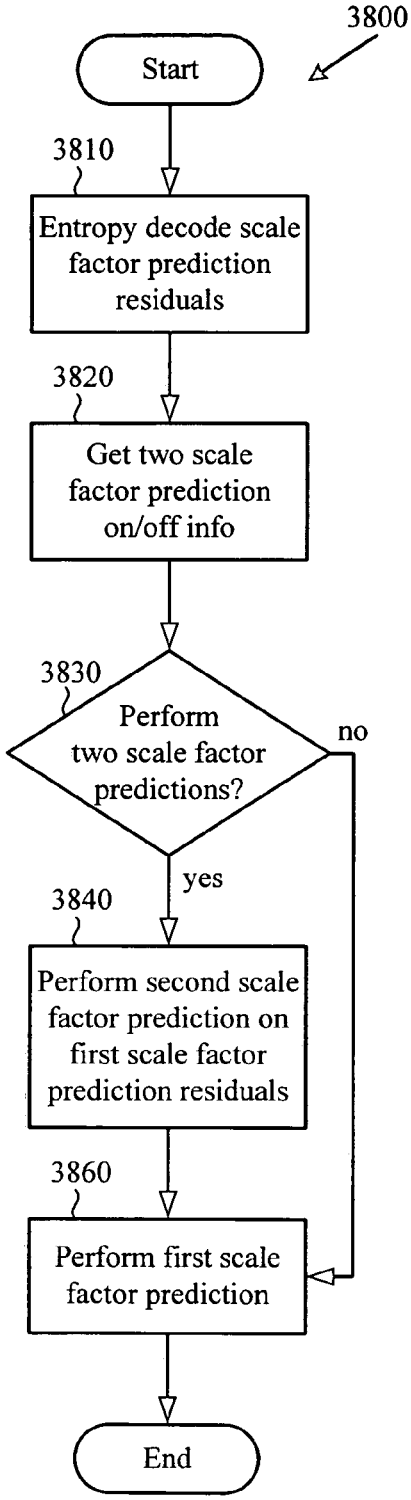
FIGS. 38*a* and 38*b* are flowcharts showing a technique for two-stage scale factor prediction during decoding.
Figure 38B:
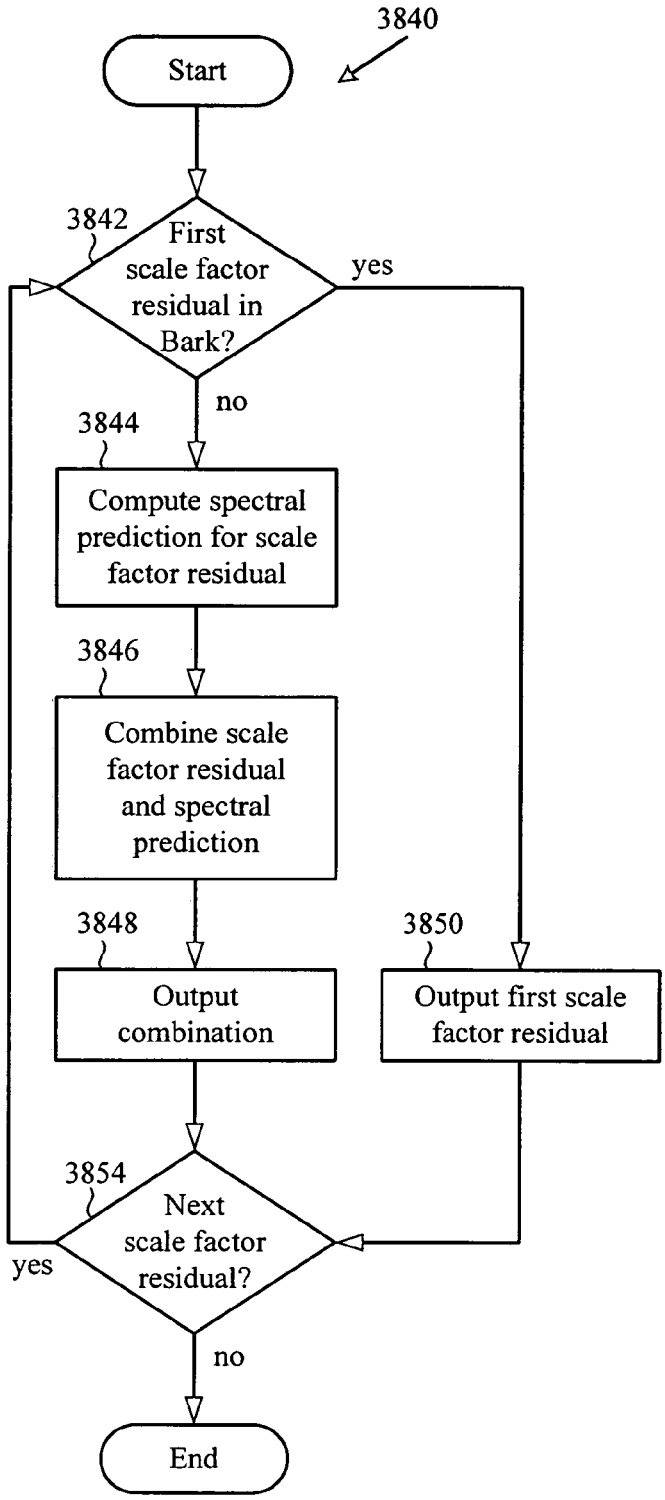

FIG. 38*a* shows a generalized technique (3800) for multi-stage scale factor prediction during decoding. A decoder such as the decoder shown in FIG. 3, 5, or 8 performs the technique (3800). Alternatively, another tool performs the technique (3800). FIG. 38*b* details a possible way to perform one of the acts of the technique (3800) for sub-Bark scale factor prediction residuals from spatial or temporal prediction.

The decoder entropy decodes (3810) the prediction residuals from scale factor prediction(s) for the scale factors of a mask. For example, the decoder performs run-level decoding (after simple Huffman decoding of run-level symbols) or a combination of such run-level decoding and vector Huffman decoding. Alternatively, the decoder performs some other type or combination of entropy decoding.

The decoder parses (3820) information indicating whether or not a second stage of scale factor prediction is performed for the scale factors of the mask. For example, the decoder parses from a bitstream a single bit on/off flag. In some implementations, the decoder performs the parsing (3820) for some masks but not others, depending on the type of prediction used for the first scale factor prediction.

The decoder then determines (3830) whether or not it should perform an extra stage of scale factor prediction. Alternatively, the decoder always performs the second stage of scale factor prediction, and skips the determining (3830) as well as the parsing (3820).

If the decoder does perform the extra scale factor prediction, the encoder performs (3840) the second scale factor prediction on prediction residuals from the "first" scale factor prediction (not yet performed during decoding, but performed as the first prediction during encoding). For example, the decoder performs Bark band bounded spectral prediction (as shown in FIG. 38*b*) on prediction residuals from spatial or temporal scale factor prediction. Alternatively, the decoder performs some other variant of spectral scale factor prediction or other type of scale factor prediction.

With reference to FIG. 38*b*, the decoder processes sub-Bark scale factor prediction residuals of a mask, residual after residual, for Bark band bounded spectral scale factor prediction. Starting with the first scale factor prediction residual as the current residual, the decoder checks (3842) whether or not the residual is the first scale factor residual in a Bark band. If the current residual is the first scale factor residual in a Bark band, the decoder outputs (3850) the current residual.

Otherwise, the decoder computes (3844) a spectral scale factor prediction for the current residual. For example, the spectral prediction is the value of the preceding scale factor residual. The decoder then combines (3846) the current residual and the spectral prediction and outputs (3848) the combination.

The decoder checks (3854) whether or not to continue with the next scale factor prediction residual in the mask. If so, the decoder checks (3842) whether the next scale factor residual in the mask is the first scale factor residual in a Bark band. The decoder continues until the scale factor prediction residuals for the mask have been processed.

Whether or not extra scale factor prediction has been performed, the decoder performs (3860) a "first" scale factor prediction for the scale factors of the mask (perhaps not first during decoding, but performed as the first scale factor prediction during encoding). For example, the first scale factor prediction is a spatial scale factor prediction or a temporal scale factor prediction. Alternatively, the first scale factor prediction is some other kind of scale factor prediction.

H. Combined Implementation.

FIGS. 39*a* and 39*b* show a technique (3900) for parsing signaled scale factor information for flexible scale factor prediction, possibly including spatial scale factor prediction and two-stage scale factor prediction, according to one implementation. A decoder such as one shown in FIG. 3, 5, or 8 performs the technique (3900). Alternatively, another tool performs the technique (3900). In summary, FIG. 39 shows a process for decoding scale factors on a mask-by-mask, tile-by-tile basis for frames of multi-channel audio, where the tiles are co-sited sub-frames of different channels. A corresponding encoder performs corresponding signaling in this implementation.

With reference to FIG. 39*a*, the decoder checks (3910) whether the current mask is at the start of a frame. If so, the decoder parses and decodes (3912) information indicating spectral resolution (e.g., which one of six band layouts to use), and the decoder parses and decodes (3914) quantization step size for scale factors (e.g., 1 dB, 2 dB, 3 dB, or 4 dB).

The decoder checks (3920) whether a temporal anchor is available for the current mask. For example, if the anchor channel is always channel 0 for a tile, the decoder checks whether the current mask is for channel 0 for the current tile. If a temporal anchor is available, the decoder gets (3922) information indicating on/off status for temporal scale factor prediction. For example, the information is a single bit.

With reference to FIG. 39*b*, the decoder checks (3930) whether or not to use temporal scale factor prediction when decoding the current mask. For example, the decoder evaluates the on/off status information for temporal prediction. If temporal scale factor prediction is to be used for the current mask, the decoder selects (3932) temporal prediction mode.

Otherwise (when on/off information indicates no temporal prediction or a temporal anchor is not available), the decoder checks (3940) whether or not a channel anchor is available for the current mask. If a channel anchor is not available, spatial scale factor prediction is not an option, and the decoder selects (3960) spectral scale factor prediction mode and proceeds to parsing and decoding (3980) of the scale factors for the current mask.

Otherwise (when a channel anchor is available), the decoder gets (3942) information indicating on/off status for spatial scale factor prediction. For example, the information is a single bit. With the information, the decoder checks (3950) whether or not to use spatial prediction. If not, the decoder selects (3960) spectral scale factor prediction mode and proceeds to parsing and decoding (3980) of the scale factors for the current mask. Otherwise, the decoder selects (3952) spatial scale factor prediction mode.

When the decoder has selected temporal prediction mode (3932) or spatial prediction mode (3952), the decoder also gets (3970) information indicating on/off status for residual spectral prediction. For example, the information is a single bit. The decoder checks (3972) whether or not to use spectral prediction on the prediction residuals from temporal or spatial prediction. If so, the decoder selects (3974) the residual spectral scale factor prediction mode. Either way, the decoder proceeds to parsing and decoding (3980) of the scale factors for the current mask.

With reference to FIG. 39*a*, the decoder parses and decodes (3980) the scale factors for the current mask using the selected scale factor prediction mode(s). For example, the decoder uses (a) spectral prediction, (b) temporal prediction, (c) residual spectral prediction followed by temporal prediction, (d) spatial prediction, or (e) residual spectral prediction followed by spatial prediction.

The decoder checks (3990) whether a mask for the next channel in the current tile should be decoded. In general, the current tile can include one or more first sub-frames per channel, or the current tile can include one or more subsequent sub-frames per channel. Therefore, when continuing for a mask in the current tile, the decoder checks (3920) whether a temporal anchor is available in the channel for the next mask, and continues from there.

If the mask for the last channel in the current tile has been decoded, the decoder checks (3992) whether any masks for another tile should be decoded. If so, the decoder proceeds with the next tile by checking (3910) whether the next tile is at the start of a frame.

I. Results.

The scale factor processing techniques and tools described herein typically reduce the bit rate of encoded scale factor information for a given quality, or improve the quality of scale factor information for a given bit rate.

For example, when a particular stereo song at a 32 KHz sampling rate was encoded with WMA Pro, the scale factor information consumed an average of 2.3 Kb/s out of the total available bit rate of 32 Kb/s. Thus, 7.2% of the overall bit rate was used to represent the scale factors for this song.

Using scale factor processing techniques and tools described herein (while keeping the spatial, temporal, and spectral resolutions of the scale factors the same as the WMA Pro encoding case), the scale factor information consumed an average of 1.6 Kb/s, for an overhead of 4.9% of the overall bit rate. This amounts to a reduction of 32%. From the average savings of 0.7 Kb/s, the encoder can use the bits elsewhere (e.g., lower uniform quantization step size for spectral coefficients) to improve the quality of actual audio coefficients. Or, the extra bits can be spent to improve the spatial, temporal, and/or spectral quality of the scale factors.

If additional reductions to spatial, temporal, or spectral resolution are selectively allowed, the scale factor processing techniques and tools described herein lower scale factor overhead even further. The quality penalty for such reductions starts small but increases as resolutions decrease.

J. Alternatives.

Much of the preceding description has addressed representation, coding, and decoding of scale factor information for audio. Alternatively, one or more of the preceding techniques or tools is applied to scale factors for some other kind of information such as video or still images.

For example, in some video compression standards such as MPEG-2, two quantization matrices are allowed. One quantization matrix is for luminance samples, and the other quantization matrix is for chrominance samples. These quantization matrices allow spectral shaping of distortion introduced due to compression. The MPEG-2 standard allows changing of quantization matrices on at most a picture-by-picture basis, partly because of the high bit overhead associated with representing and coding the quantization matrices. Several of the scale factor processing techniques and tools described herein can be applied to such quantization matrices.

For example, the quantization matrix/scale factors for a macroblock can be predictively coded relative to the quantization matrix/scale factors for a spatially adjacent macroblock (e.g., left, above, top-right), a temporally adjacent macroblock (e.g., same coordinates but in a reference picture, coordinates of macroblock(s) referenced by motion vectors in a reference picture), or a macroblock in another color plane (e.g., luminance scale factors predicted from chrominance scale factors, or vice versa). Where multiple candidate quantization matrices/scale factors are available for prediction, values can be selected from different candidates (e.g., median values) or averages computed (e.g., average of two reference pictures' scale factors). When multiple predictors are available, prediction mode selection information can be signaled. Aside from this, multiple entropy coding/decoding modes can be used to encode/decode scale factors prediction residuals.

In various examples herein, an entropy encoder performs simple or vector Huffman coding, and an entropy decoder performs simple or vector Huffman decoding. The VLCs in such contexts need not be Huffman codes. In some implementations, the entropy encoder performs another variety of simple or vector variable length coding, and the entropy decoder performs another variety of simple or vector variable length decoding.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A computer-implemented method performed by a decoder, the method comprising:

with the decoder:

parsing, from a bit stream, information indicating a selected scale factor prediction mode, wherein the selected scale factor prediction mode is selected from plural scale factor prediction modes, wherein each of the plural scale factor prediction modes is available for processing a particular mask;

performing scale factor prediction according to the selected scale factor prediction mode;

entropy decoding difference values;

combining the difference values with results of the scale factor prediction to produce plural current scale factors;

reconstructing media using the plural current scale factors; and outputting the reconstructed media.

2. The method of claim 1 wherein the selecting occurs on a mask-by-mask basis.

3. The method of claim 1 wherein the plural scale factor prediction modes include two or more of a temporal scale factor prediction mode, a spectral scale factor prediction mode, a spatial or other cross-channel scale factor prediction mode, and a cross-layer scale factor prediction mode.

4. The method of claim 1 wherein each of the plural scale factor prediction modes predicts the plural current scale factor from a prediction, and wherein the prediction is plural previous scale factors.

5. The method of claim 1 wherein the particular mask is for a sub-frame.

6. The method of claim 1 wherein the selected scale factor prediction mode is a temporal scale factor prediction mode or a spatial scale factor prediction mode, the method further comprising performing second scale factor prediction according to a spectral scale factor prediction mode.

7. The method of claim 1 wherein the selected scale factor prediction mode is a spectral scale factor prediction mode, the method further comprising reordering difference values after entropy decoding.

8. The method of claim 1 wherein the selected scale factor prediction mode is a cross-channel scale factor prediction mode, and wherein the scale factor prediction includes predicting the plural current scale factors from plural previous scale factors from another channel.

9. A computer-implemented method performed by a decoder, the method comprising:

with the decoder:

parsing, from a bit stream, information indicating a spectral resolution for scale factors;

selecting a scale factor spectral resolution from plural scale factor spectral resolutions, wherein the selecting is based at least in part upon the parsed information, wherein the plural scale factor spectral resolutions include six different pre-defined resolutions, wherein one of the six different pre-defined resolutions is a critical band resolution and the remaining five different pre-defined resolutions are sub-critical band resolutions, and wherein the information indicating the spectral resolution indicates one of the six different pre-defined resolutions;

processing spectral coefficients with scale factors at the selected scale factor spectral resolution; and outputting reconstructed audio samples.

10. The method of claim 9 wherein the plural scale factor spectral resolutions further include a super-critical band resolution.

11. The method of claim 9 wherein the selecting occurs for a frame that includes the spectral coefficients.

12. A computer-implemented method performed by a decoder, the method comprising:

with the decoder:

parsing, from a bit stream, information indicating a spectral resolution for scale factors;

selecting a scale factor spectral resolution from plural scale factor spectral resolutions, wherein the selecting is based at least in part upon the parsed information, wherein each of the plural scale factor spectral resolutions is available for processing a particular sub-frame of spectral coefficients, wherein the plural scale factor spectral resolutions include six different pre-defined resolutions, wherein one of the six different pre-defined resolutions is a critical band resolution and the remaining five different pre-defined resolutions are sub-critical band resolutions, and wherein the information indicating the spectral resolution indicates one of the six different pre-defined resolutions;

processing spectral coefficients including the particular sub-frame of spectral coefficients with scale factors at the selected scale factor spectral resolution; and outputting reconstructed audio samples.

13. The method of claim 12 wherein the processing includes inverse weighting according to the scale factors.

14. The method of claim 12 wherein the selecting occurs on a frame-by-frame basis.

15. A computer-implemented method performed by an encoder, the method comprising:

with the encoder:

selecting a scale factor prediction mode from plural scale factor prediction modes, wherein each of the plural scale factor prediction modes is available for processing a particular mask;

performing scale factor prediction according to the selected scale factor prediction mode;

signaling, in a bit stream, information indicating the selected scale factor prediction mode;

computing difference values between plural scale factors for the particular mask and results of the scale factor prediction;

entropy coding the difference values; and signaling, in the bit stream, the entropy coded difference values.

16. The method of claim 15 wherein the selecting occurs on a mask-by-mask basis.

17. The method of claim 15 wherein the plural scale factor prediction modes include two or more of a temporal scale factor prediction mode, a spectral scale factor prediction mode, a spatial or other cross-channel scale factor prediction mode, and a cross-layer scale factor prediction mode.

18. The method of claim 15 wherein each of the plural scale factor prediction modes predicts a current scale factor of the plural scale factors of the particular mask from a prediction, and wherein the prediction is a previous scale factor of a previous mask.

19. The method of claim 15 wherein the particular mask is for a sub-frame, and wherein the encoder performs the selecting based at least in part upon position of the sub-frame in a frame of multi-channel audio.

20. The method of claim 15 wherein the selected scale factor prediction mode is a temporal scale factor prediction mode or a spatial scale factor prediction mode, the method further comprising performing second scale factor prediction according to a spectral scale factor prediction mode.

21. The method of claim 15 wherein the selected scale factor prediction mode is a spectral scale factor prediction mode, the method further comprising reordering difference values prior to entropy coding.

22. The method of claim 15 wherein the selected scale factor prediction mode is a cross-channel scale factor prediction mode, and wherein the scale factor prediction includes predicting a current scale factor the plural scale factors of the particular mask from a previous scale factor of another mask from another channel.

23. A computer-implemented method performed by an encoder, the method comprising:

with the encoder:

selecting a scale factor spectral resolution from plural scale factor spectral resolutions, wherein the plural scale factor spectral resolutions include six different pre-defined resolutions, wherein one of the six different pre-defined resolutions is a critical band resolution and the remaining five different pre-defined resolutions are sub-critical band resolutions;

processing spectral coefficients with scale factors at the selected scale factor spectral resolution; and signaling, in a bit stream, information indicating the selected scale factor spectral resolution, wherein the selected scale factor spectral resolution is one of the six different pre- defined resolutions.

24. The method of claim 23 wherein the selecting occurs for a frame that includes the spectral coefficients.

25. A computer-implemented method performed by an encoder, the method comprising:

with the encoder:

selecting a scale factor spectral resolution from plural scale factor spectral resolutions, wherein each of the plural scale factor spectral resolutions is available for processing a particular sub-frame of spectral coefficients, wherein the encoder performs the selecting based at least in part on criteria including one or more of bit rate and quality, wherein the plural scale factor spectral resolutions include six different pre-defined resolutions, wherein one of the six different pre-defined resolutions is a critical band resolution and the remaining five different pre-defined resolutions are sub-critical band resolutions;

processing spectral coefficients including the particular sub-frame of spectral coefficients with scale factors at the selected scale factor spectral resolution, wherein the processing includes weighting according to the scale factors; and signaling, in a bit stream, information indicating the selected scale factor resolution, wherein the selected scale factor spectral resolution is one of the six different pre-defined resolutions.

26. The method of claim 25 wherein the selecting occurs on a frame-by-frame basis.

* * * * *